US011850721B2

(12) United States Patent
Lane et al.

(10) Patent No.: US 11,850,721 B2
(45) Date of Patent: Dec. 26, 2023

(54) SYSTEM AND METHOD TO INSTALL AND REMOVE AN ANCHORING MEMBER ON AN ANCHORAGE STRUCTURE IN AN OVERHEAD AREA

(71) Applicant: The Boeing Company, Chicago, IL (US)

(72) Inventors: John G. Lane, Puyallup, WA (US); Allen B. Claunch, Burien, WA (US)

(73) Assignee: The Boeing Company, Arlington, VA (US)

( * ) Notice: Subject to any disclaimer, the term of this patent is extended or adjusted under 35 U.S.C. 154(b) by 96 days.

(21) Appl. No.: 17/744,693

(22) Filed: May 15, 2022

(65) Prior Publication Data

US 2023/0364772 A1 Nov. 16, 2023

(51) Int. Cl.
*B25G 1/04* (2006.01)
*A62B 35/00* (2006.01)

(52) U.S. Cl.
CPC ..... *B25G 1/04* (2013.01); *A62B 35/0068* (2013.01)

(58) Field of Classification Search
CPC ..... B25G 1/04
See application file for complete search history.

(56) References Cited

U.S. PATENT DOCUMENTS 3,072,429 A 1/1963 Stipan
4,595,223 A * 6/1986 Hawie ..... F16B 45/021 294/175
5,228,202 A * 7/1993 Liao ..... A01G 3/0255 30/296.1
5,622,399 A 4/1997 Albright
6,027,154 A 2/2000 Costa
6,412,432 B1 7/2002 White et al.
9,469,025 B1 * 10/2016 Ostrobrod ..... A62B 35/0068
9,662,518 B1 * 5/2017 Lay ..... B63B 21/54
10,004,926 B2 6/2018 Ostrobrod
10,286,232 B2 5/2019 Ostrobrod
2005/0247523 A1 * 11/2005 Sewell ..... B26B 11/00 182/187

OTHER PUBLICATIONS

Product Listing web pages for 3M Product No. 2104527, from 3M Website at web address <https://www.3m.com/3M/en_US/p/d/v000431302/>, 2022, 9 pages.
Product Listing web pages for 3M Product No. 2104528, from 3M Website at web address <https://www.3m.com/3M/en_US/p/d/v000431340/>, 2022, 9 pages.

* cited by examiner

*Primary Examiner* — Jason L Vaughan
*Assistant Examiner* — Amanda Kreiling

(57) ABSTRACT

There is provided a system to install and remove an anchoring member on an anchorage structure in an overhead area. The system has a pole for providing access to the overhead area. The system further has a positioning arm for attachment to the pole. The positioning arm has a first end, and a second end offset from the first end. The positioning arm further has an elongated body having an outboard portion and an inboard portion, a recessed area formed in the outboard portion, and a dogleg shaped portion formed along the inboard portion. The system further has a safety hook assembly for attachment to the pole. The safety hook assembly has a hook end, and a safety latch mechanism having a safety latch engageable with the hook end. The safety latch mechanism is remotely operated by an operator, via a pull cord attached to the safety latch mechanism.

20 Claims, 31 Drawing Sheets

SYSTEM AND METHOD TO INSTALL AND REMOVE AN ANCHORING MEMBER ON AN ANCHORAGE STRUCTURE IN AN OVERHEAD AREA

FIELD

The disclosure relates generally to systems and methods for installing and removing an anchorage member on an overhead anchorage structure, and more specifically, to remote anchoring systems and methods for installing and removing a fall protection strap to and from an overhead beam.

BACKGROUND

Many buildings require elevated access to systems including lighting, plumbing, steam, fire protection, HVAC, communication, seismic, structural, painting, and other systems. Manufacturing activities or facility maintenance activities may require access to such building systems in overhead areas above handrails of platforms or catwalks, and where aerial work platforms may have difficulty accessing. When workers work in such overhead or elevated areas, personal fall arrest or protection equipment is used to mitigate a risk of falling. However, such personal fall arrest or protection equipment typically needs to be attached to an attachment point on an anchorage structure, such as an overhead beam, above the worker, and there may be no anchor point for attachment of the personal fall arrest or protection equipment to the overhead beam. One way to provide an anchor point is to install a strap, such as a fall protection strap, over an overhead beam. Such strap typically has a large D-ring at one end and a small D-ring at the other end, and after the strap is installed or hung over the overhead beam, the small D-ring is passed through the large D-ring.

A known remote anchoring system exists for installing such a strap, for example, the fall protection strap. Such known remote anchoring system includes a placement arm and a hook portion attached to a pole, via an attachment tool assembly, where the placement arm is used to install the strap over the overhead beam. However, where the overhead beam has a limited clearance area or narrow area between the top of the overhead beam and a ceiling or roof, for example, an upper truss chord on a corrugated roof panel, the hook portion needs to be removed to provide clearance at the top of the pole. Further, the limited clearance area, or narrow area, may not be able to provide sufficient clearance for a combined thickness of the D-ring and the known placement arm holding the D-ring, thus preventing passage of the placement arm and strap through the limited clearance area and over the overhead beam. Moreover, the strap, such as the fall protection strap, may have integral chafe protection and may be difficult to fit with the placement arm.

In addition, a messenger line, i.e., a small diameter cord or rope, may need to be used to facilitate passage of the strap through the limited clearance area and over the overhead beam. The use of such a messenger line increases the time and complexity of installation.

Further, the known placement arm of the known remote anchoring system has a linear profile with a first end and a second end in the same plane and not offset from each other. When the known remote anchoring system is in use, this may result in a center of balance of the known placement arm being in front of an operator grip area near a bottom end of the pole, and may require a greater effort by the operator to hold the pole and the placement arm upright. This, in turn, may result in decreased ergonomic control.

Moreover, with removal of the strap from the overhead beam, an operator uses the known hook portion of the known remote anchoring system to capture a D-ring and pull the strap off of the overhead beam, and with securing the strap to the overhead beam, the operator uses the known hook portion to pull one D-ring through the other D-ring to tighten the strap around the overhead beam. However, the known hook portion of the known remote anchoring system does not have a latch or locking mechanism to latch or lock the D-ring of the strap to the hook portion, when the hook portion is used to remove the strap from, or secure the strap to, the overhead beam. Thus, there is a risk that the strap may fall free from the hook portion and fall on the operator, other workers, structures, or materials on the floor or ground below the overhead area and below the hook portion attached at the top of the pole.

Accordingly, there is a need in the art for an improved system and method to install and remove an anchoring member, such as a strap, on an anchorage structure, such as a beam, in an overhead area, that provides improved clearance in limited clearance areas, that provides improved ergonomic control, that avoids or eliminates use of a messenger line, that reduces, or eliminates, a risk of a falling strap, and that provide advantages over known systems and methods.

SUMMARY

Example implementations of the present disclosure provide a system and a method to install and remove an anchoring member on an anchorage structure in an overhead area. As discussed in the below detailed description, versions of the system and method may provide significant advantages over known systems and methods.

In a version of the disclosure, there is provided a system to install and remove an anchoring member on an anchorage structure in an overhead area. The system comprises a pole for providing access to the overhead area. The system further comprises a positioning arm configured for attachment to the pole, to position the anchoring member over a top portion of the anchorage structure.

The positioning arm comprises a first end, and a second end offset from the first end. The positioning arm further comprises an elongated body having an outboard portion and an inboard portion. The positioning arm further comprises a recessed area formed in the outboard portion at the first end. The positioning arm further comprises a dogleg shaped portion formed along the inboard portion at the second end.

The system further comprise a safety hook assembly configured for attachment to the pole, to secure the anchoring member to, and to remove the anchoring member from, the anchorage structure. The safety hook assembly comprises a hook end, and a safety latch mechanism having a safety latch engageable with the hook end. The safety latch mechanism is remotely operated by an operator, via a pull cord attached to the safety latch mechanism, such that when the operator pulls the pull cord, the safety latch opens, and when the operator releases the pull cord, the safety latch closes.

In another version of the disclosure, there is provided a remote anchoring system to install and remove a beam strap on a beam in an overhead area. The remote anchoring system comprises an extension pole having a pole first end accessible to the overhead area, and a pole second end manually operated by an operator.

The remote anchoring system further comprises a positioning arm configured for attachment to the pole first end, via an attachment tool assembly, to position the beam strap over a top portion of the beam. The positioning arm comprises a first end having a notched portion, and a second end offset from the first end at an offset angle. The positioning arm further comprises an elongated body having an outboard portion attached to an inboard portion. The positioning arm further comprises a recessed area formed in the outboard portion at the first end. The positioning arm further comprises a dogleg shaped portion formed along an area of the inboard portion at the second end.

The remote anchoring system further comprises a safety hook assembly configured for attachment to the pole first end, via the attachment tool assembly, to secure and install the beam strap to the beam, and to remove the beam strap from the beam. The safety hook assembly comprises a hook body, a hook cover attached to the hook body, and a safety hook portion with a hook end. The safety hook further comprises a safety latch mechanism disposed between the hook body and the hook cover. The safety latch mechanism has a safety latch engageable with the hook end, and has a spring element in communication with the safety latch.

The safety latch mechanism is remotely operated by the operator, via a pull cord attached to the safety latch mechanism, such that when the operator pulls the pull cord, the safety latch opens, and when the operator releases the pull cord, the spring element causes the safety latch to close.

In another version of the disclosure, there is provided a method to install and remove an anchoring member on an anchorage structure in an overhead area. The method comprises the step of attaching a positioning arm to an extension pole, via an attachment tool assembly. The positioning arm comprises a first end, and a second end offset from the first end at an offset angle, an elongated body having an outboard portion and an inboard portion, a recessed area formed in the outboard portion at the first end, and a dogleg shaped portion formed along the inboard portion at the second end.

The method further comprises the step of using the positioning arm to position the anchoring member over a top portion of the anchorage structure. The method further comprises the step of attaching a safety hook assembly to the extension pole, via the attachment tool assembly.

The safety hook assembly comprises a hook body, a hook cover attached to the hook body, a safety hook portion with a hook end, and a safety latch mechanism disposed between the hook body and the hook cover. The safety latch mechanism has a safety latch engageable with the hook end, and has a spring element in communication with the safety latch.

The method further comprises the step of remotely operating the safety hook assembly, to secure and install the anchoring member around the anchorage structure. The method further comprises the step of remotely operating the safety hook assembly, to remove the anchoring member from the anchorage structure. The safety latch mechanism of the safety hook assembly is remotely operated by an operator, via a pull cord attached to the safety latch mechanism, such that when the operator pulls the pull cord, the safety latch opens, and when the operator releases the pull cord, the spring element causes the safety latch to close.

The features, functions, and advantages that have been discussed can be achieved independently in various versions of the disclosure or may be combined in yet other versions, further details of which can be seen with reference to the following description and drawings.

BRIEF DESCRIPTION OF THE DRAWINGS

The disclosure can be better understood with reference to the following detailed description taken in conjunction with the accompanying drawings, which illustrate preferred and exemplary versions, but which are not necessarily drawn to scale. The drawings are examples and not meant as limitations on the description or claims.

The figures shown in this disclosure represent various aspects of the versions presented, and only differences will be discussed in detail.

DETAILED DESCRIPTION

Disclosed versions will now be described more fully hereinafter with reference to the accompanying drawings, in which some, but not all of the disclosed versions are shown. Indeed, several different versions may be provided and should not be construed as limited to the versions set forth herein. Rather, these versions are provided so that this disclosure will be thorough and fully convey the scope of the disclosure to those skilled in the art.

This specification includes references to "one version" or "a version". The instances of the phrases "one version" or "a version" do not necessarily refer to the same version. Particular features, structures, or characteristics may be combined in any suitable manner consistent with this disclosure.

As used herein, "comprising" is an open-ended term, and as used in the claims, this term does not foreclose additional structures or steps.

As used herein, "configured to" means various parts or components may be described or claimed as "configured to" perform a task or tasks. In such contexts, "configured to" is used to connote structure by indicating that the parts or components include structure that performs those task or tasks during operation. As such, the parts or components can be said to be configured to perform the task even when the specified part or component is not currently operational (e.g., is not on).

As used herein, the terms "first", "second", etc., are used as labels for nouns that they precede, and do not imply any type of ordering (e.g., spatial, temporal, logical, etc.).

As used herein, an element or step recited in the singular and preceded by the word "a" or "an" should be understood as not necessarily excluding the plural of the elements or steps.

As used herein, the phrase "at least one of," when used with a list of items, means different combinations of one or more of the listed items may be used, and only one of each item in the list may be needed. In other words, "at least one of" means any combination of items and number of items may be used from the list, but not all of the items in the list are required. The item may be a particular object, a thing, or a category.

Figure 1:
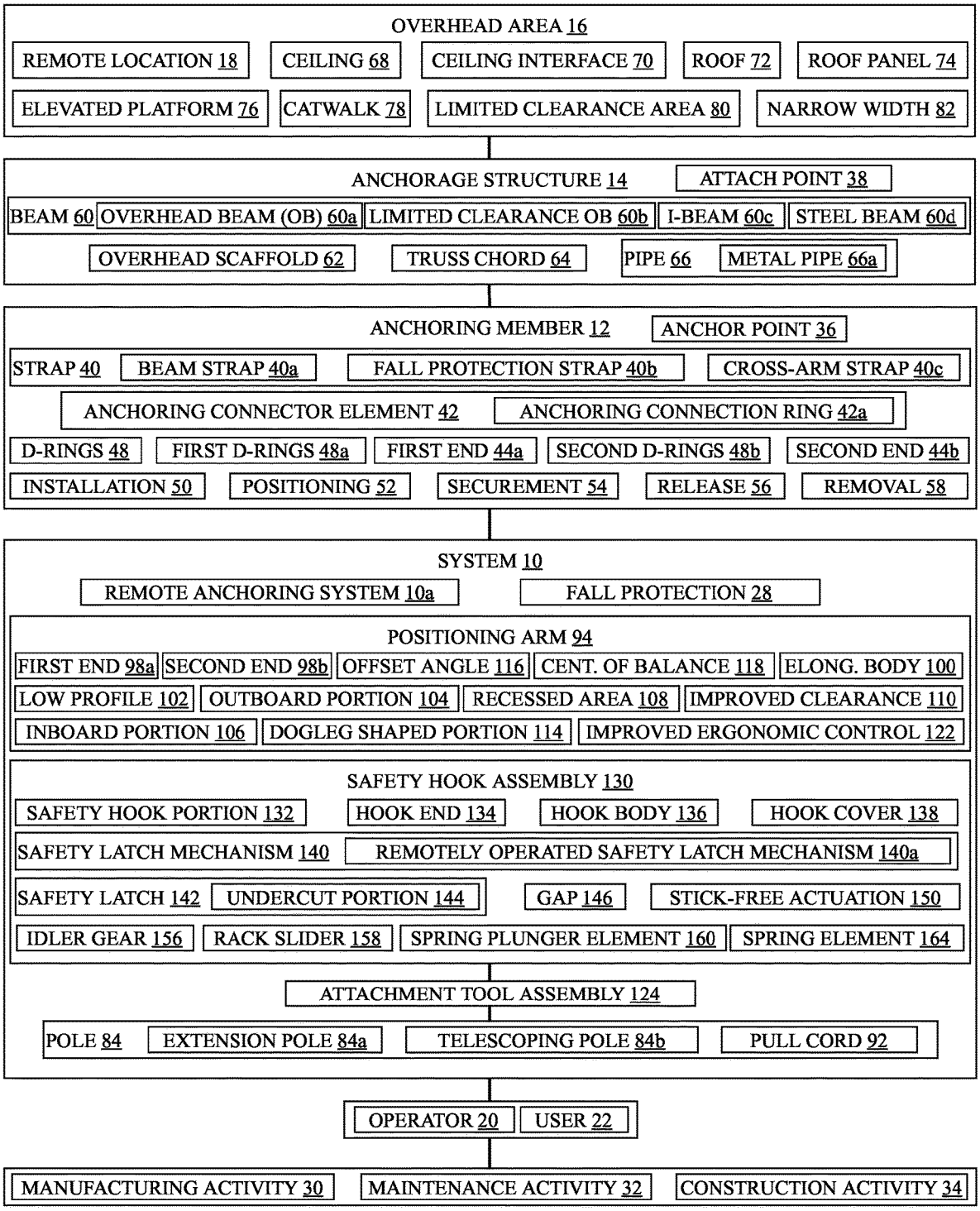
FIG. 1 is an illustration of a block diagram of an exemplary system of the disclosure.

Now referring to Figures, FIG. 1 is an illustration of a block diagram of an exemplary system 10, such as a remote anchoring system 10*a*, of the disclosure. The blocks in FIG. 1 represent elements, and lines connecting the various blocks do not imply any particular dependency of the elements. Furthermore, the connecting lines shown in the various Figures contained herein are intended to represent example functional relationships and/or physical couplings between the various elements, but it is noted that other alternative or additional functional relationships or physical connections may be present in versions disclosed herein. One or more of these blocks may be combined, divided, or combined and divided into different blocks when implemented in an illustrative example. Further, the illustrations of the system 10, such as a remote anchoring system 10*a*, in FIG. 1 is not meant to imply physical or architectural limitations to the manner in which an illustrative example may be implemented. Other components in addition to or in place of the ones illustrated may be used. Some components may be unnecessary.

Figure 8B:
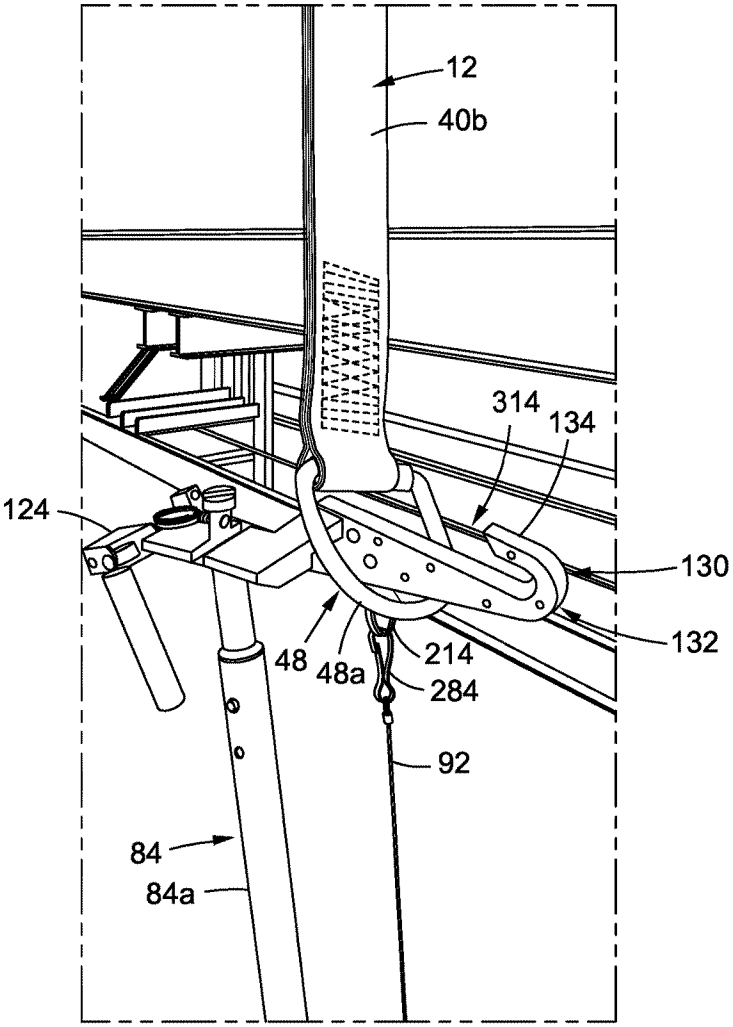
FIG. 8B is an illustration of a close-up right side perspective view of the system of FIG. 8A, showing the safety hook assembly in an open position, and a hook end inserted through a first D-ring of the anchoring member.
Figure 8A:
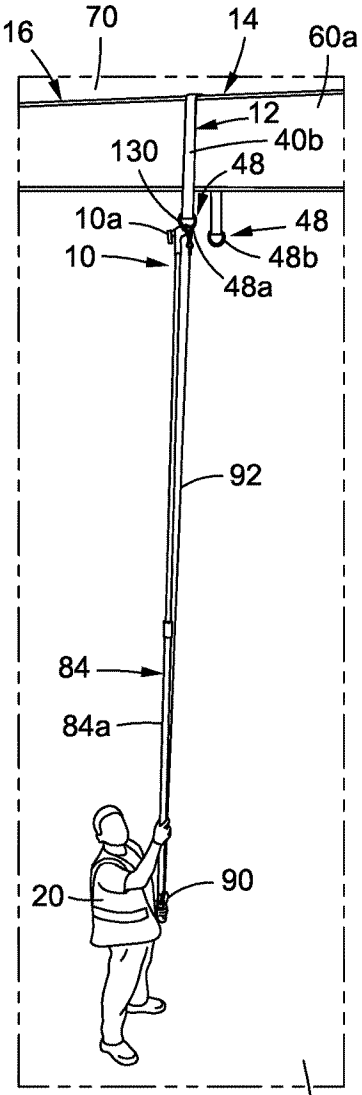
FIG. 8A is an illustration of a right side perspective view of an operator using an exemplary version of a system of the disclosure, to secure, with a safety hook assembly, an anchoring member to an anchorage structure in an overhead area.
Figure 8C:
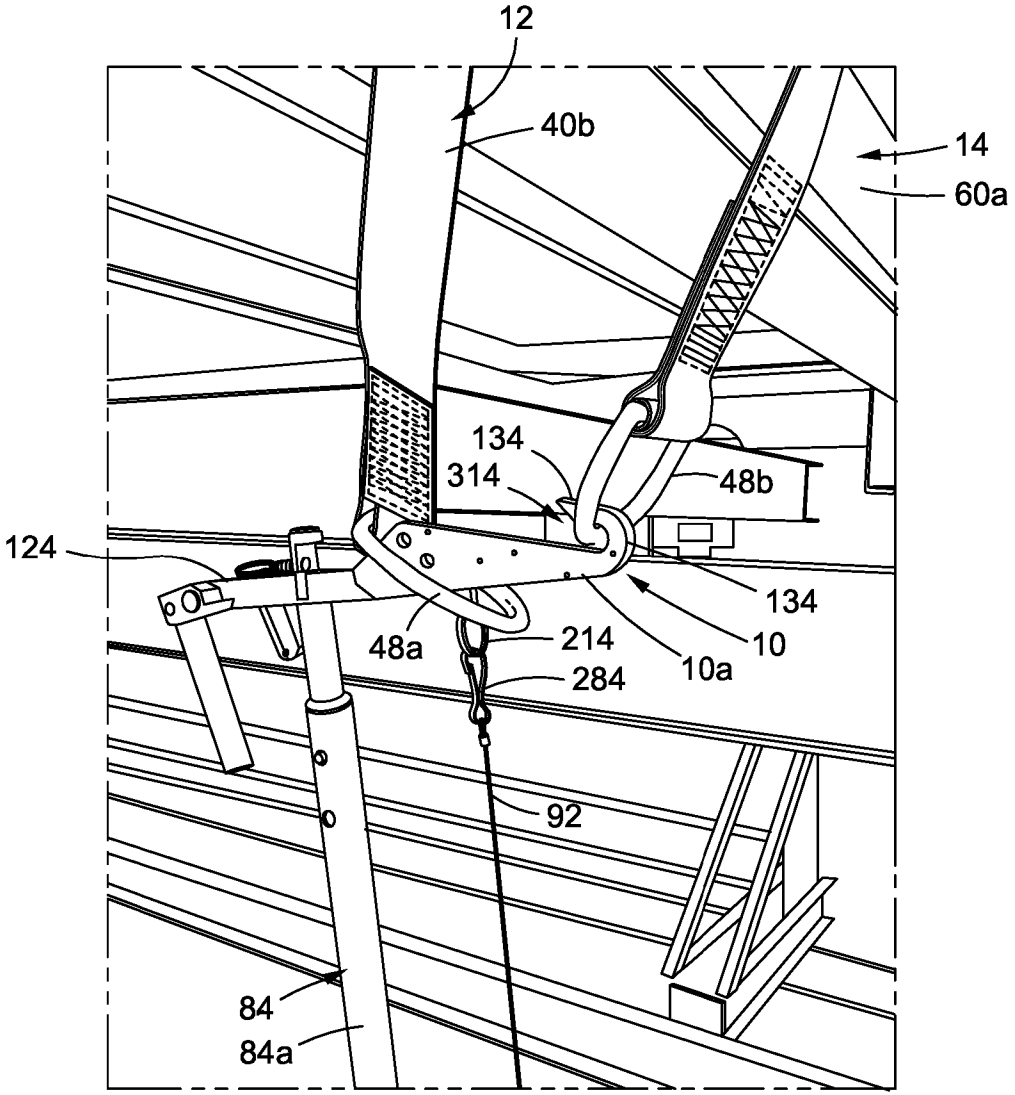
FIG. 8C is an illustration of a close-up right side perspective view of the system of FIG. 8A, showing the hook end of the safety hook assembly capturing a second D-ring of the anchoring member.
Figure 8E:
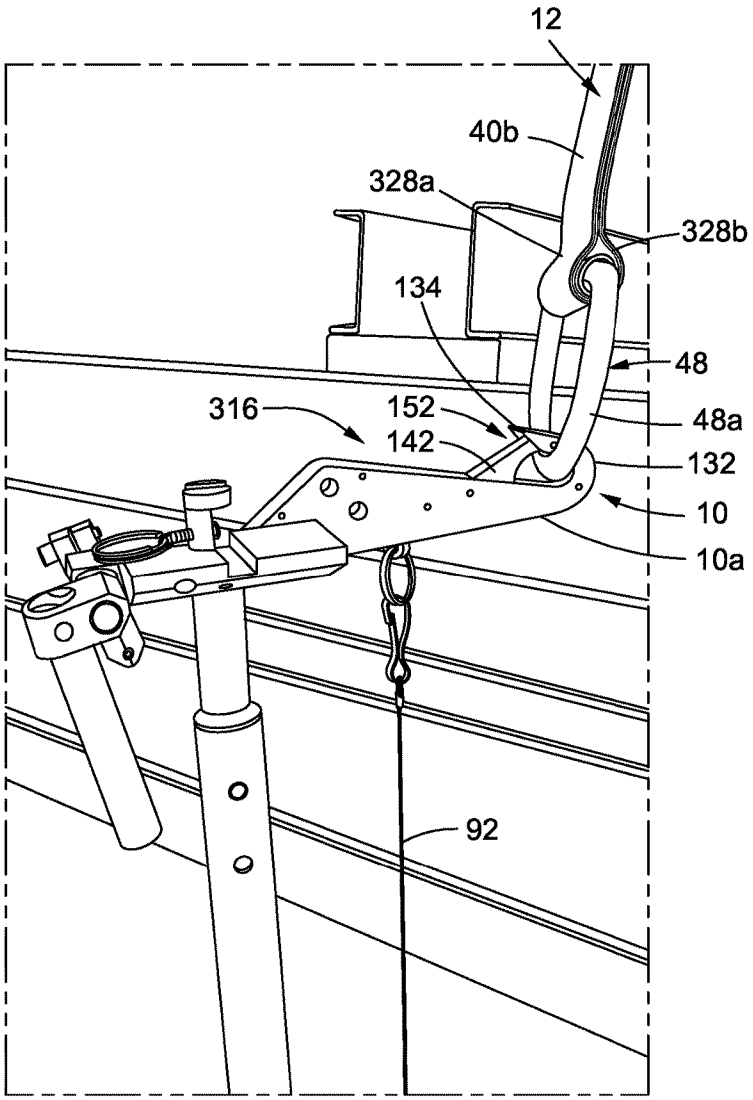
FIG. 8E is an illustration of a close-up right side perspective view of the system of FIG. 8A, showing the hook end of the safety hook assembly capturing the first D-ring of the anchoring member, after the anchoring member is used, to remove the anchoring member from the anchorage structure.
Figure 8D:
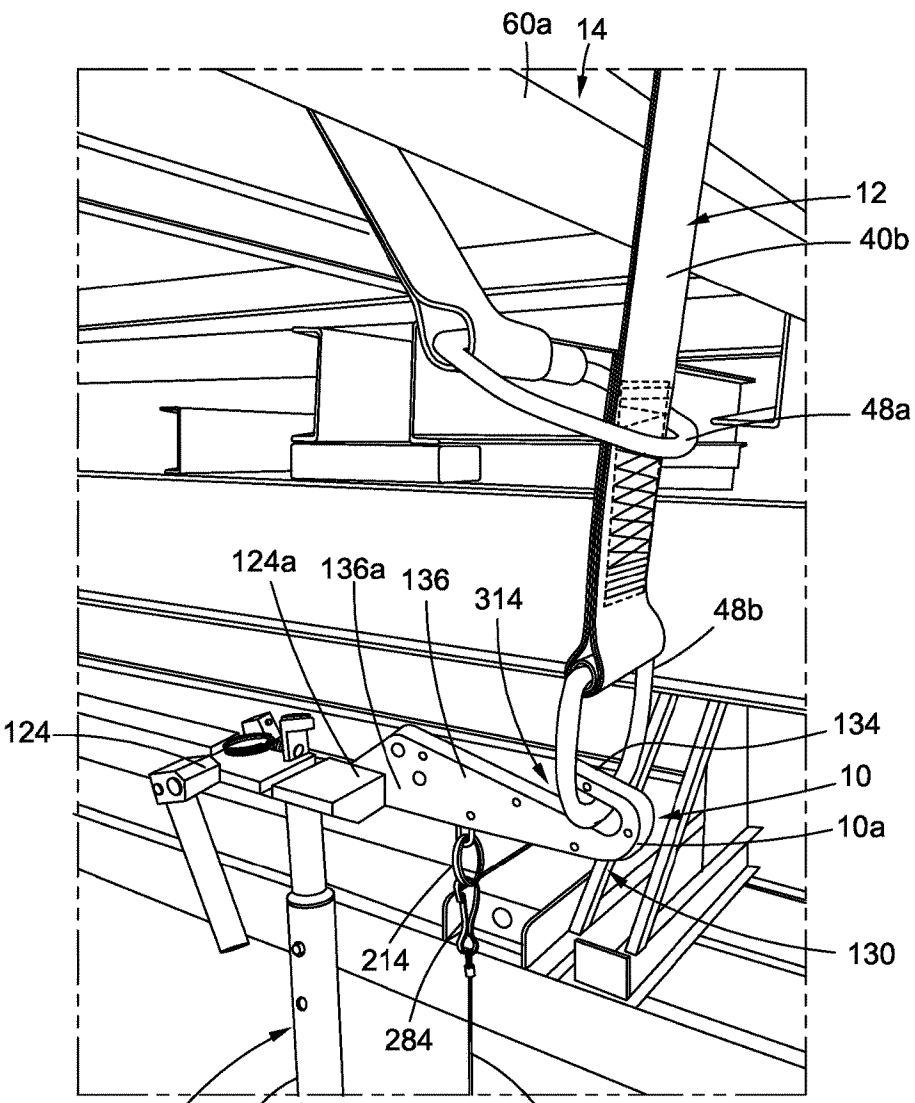
FIG. 8D is an illustration of a close-up top right side perspective view of the system of FIG. 8A, showing the hook end of the safety hook assembly pulling the second D-ring through the first D-ring, to secure and install the anchoring member around the anchorage structure.
Figure 8G:
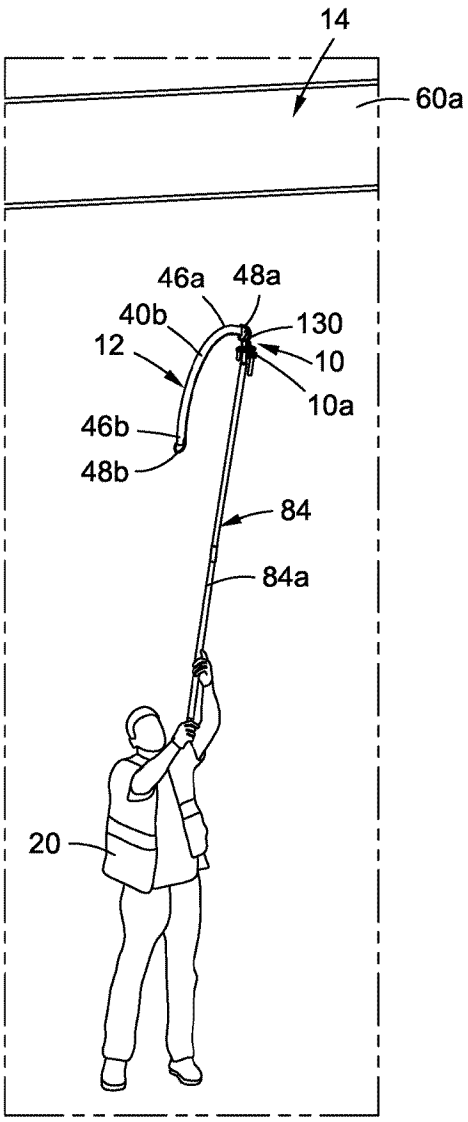
FIG. 8G is an illustration of a front perspective view of the operator using the system of FIG. 8A, to securely remove the anchoring member from the anchorage structure with the safety hook assembly in a closed position.
Figure 8F:
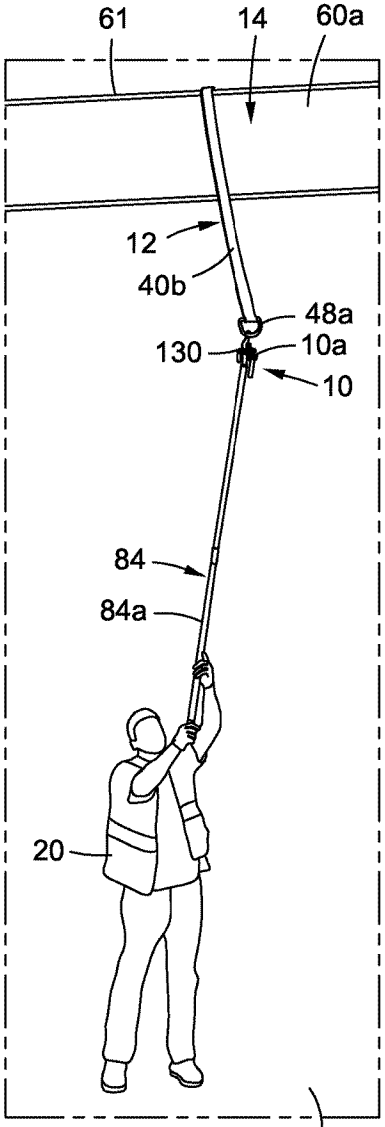
FIG. 8F is an illustration of a front perspective view of the operator using the system of FIG. 8A, to pull the anchoring member from the anchorage structure with the safety hook assembly in a closed position.

In a version of the disclosure, as shown in FIG. 1, there is provided the system 10, such as the remote anchoring system 10*a*, to install and remove an anchoring member 12 on an anchorage structure 14 in an overhead area 16, such as a remote location 18, a distance above an operator 20 or user 22 positioned on a floor 24 (see FIG. 6A) or on a ground area 26 (see FIG. 8F). The system 10, such as the remote anchoring system 10*a*, is used for fall protection 28 (see FIG. 1) of workers and others performing activities requiring elevated access to architectural or building structures above handrails of platforms or catwalks, where aerial work platforms cannot reach. As shown in FIG. 1, such activities include a manufacturing activity 30, a maintenance activity 32, such as a facility maintenance activity, a construction activity 34, or another industrial or occupational activity, where workers are working overhead and at elevated heights above the floor 24 or ground area 26. The anchoring member 12 provides an anchor point 36 (see FIG. 1), such as a remote overhead anchor point, and the anchorage structure 14 provides an attach point 38 (see FIG. 1), such as a remote overhead attach point, for the anchoring member 12 to attach to.

As shown in FIG. 1, the anchoring member 12 comprises a strap 40, including a beam strap 40*a*, a fall protection strap 40*b*, a cross-arm strap 40*c*, or another suitable strap. As further shown in FIG. 1, the anchoring member 12 comprises an anchoring connector element 42, including an anchoring connector ring 42*a*, or another suitable anchoring member. The anchoring member 12, such as the strap 40, comprises a first end 44*a* (see FIG. 1), such as a strap first end 46*a* (see FIG. 6C), and comprises a second end 44*b* (see FIG. 1), such as a strap second end 46*b* (see FIG. 6C). The strap 40, such as the beam strap 40*a*, the fall protection strap 40*b*, or the cross-arm strap 40*c*, is made of synthetic fiber textile having equivalent or superior characteristics to polyamide or polyester, and having static strength of at least 5000 pounds (22.2 kiloNewtons). The strap 40, such as the beam strap 40*a*, the fall protection strap 40*b*, or the cross-arm strap 40*c*, may also be made of another suitably strong and durable material. The strap 40, such as the beam strap 40*a*, the fall protection strap 40*b*, or the cross-arm strap 40*c*, preferably has an abrasion resistant synthetic fiber wear pad or another suitable wear pad.

In one version, the anchoring member 12, such as the strap 40, has D-rings 48 (see FIG. 1) attached to the anchoring member 12, such as the strap 40. Alternatively, the strap 40 may have O-rings. Preferably, the anchoring member 12, such as the strap 40, has two D-rings 48. For example, in one version, the first end 44*a*, such as the strap first end 46*a*, has a first D-ring 48*a* (see FIGS. 1, 7A), or a large D-ring, or alternatively, a large O-ring, attached to the first end 44*a*, such as the strap first end 46*a*, and the second end 44*b*, such as the strap second end 46*b*, has a second D-ring 48*b* (see FIG. 1), or a small D-ring, or alternatively, a small O-ring, attached to the second end 44*b*, such as the strap second end 46*b*. The first D-ring 48*a*, or large D-ring, is of a sufficient size to allow the second D-ring 48*b*, or small D-ring, to pass through the first D-ring 48*a*. The anchoring member 12, such as in the form of the strap 40, for example, the beam strap 40*a*, preferably has a length in a range of 2 (two) feet to 20 (twenty) feet, and more preferably, has a length in a range of 3 (three) feet to 6 (six) feet. The anchoring member 12, such as in the form of the strap 40, for example, the cross-arm strap 40*c*, preferably has a length in a range of 3 (three) feet to 8 (eight) feet. However, the anchoring member 12, such as the strap 40, for example, the cross-arm strap 40*c*, may have a length longer than 8 (eight) feet. The anchoring member 12, such as the strap 40, is installed by securing the anchoring member 12, such as the strap 40, around the anchorage structure 14.

As shown in FIG. 1, the system 10, such as the remote anchoring system 10*a*, provides for installation 50, including positioning 52, and securement 54, of the anchoring member 12 on the anchorage structure 14. As further shown in FIG. 1, the system 10, such as the remote anchoring system 10*a*, provides for release 56, and removal 58, of the anchoring member 12 from the anchorage structure 14.

As shown in FIG. 1, the anchorage structure 14 may comprise a beam 60, such as an overhead beam (OB) 60*a*, a limited clearance overhead beam (OB) 60*b*, an I-beam 60*c*, a steel beam 60*d*, or another strong and sturdy beam. As further shown in FIG. 1, the anchorage structure 14 may comprise an overhead scaffold 62, a truss chord 64, for example, an upper truss chord, a pipe 66, such as a metal pipe 66*a*, or another suitable anchorage structure. The anchorage structure 14 is generally a solid horizontal structural member that provides the attach point 38 for the anchoring member 12.

As shown in FIG. 1, the overhead area 16, or remote location 18, comprises a ceiling 68, a ceiling interface 70, a roof 72, a roof panel 74, for example, a corrugated roof panel, an elevated platform 76, a catwalk 78, or another suitable overhead area, or remote location, a remote distance from the operator 20 or user 22 of the system 10, such as the remote anchoring system 10*a*, where the operator 20 or user 22 is generally positioned on a floor 24 (see FIG. 6A) or on a ground area 26 (see FIG. 8F). The overhead area 16 may have a limited clearance area 80 (see FIGS. 1, 7B) with a narrow width 82 (see FIG. 1) between a top portion 14*a* (see FIG. 7B) of the anchorage structure 14 (see FIG. 7B), such as a top portion 61 (see FIG. 7B) of the limited clearance overhead beam 60*b* (see FIG. 7B), and a bottom of the overhead area 16 (see FIG. 7B), such as the roof panel 74 (see FIG. 7B), such that it has limited access or a limited or narrow clearance. The limited clearance area 80 may have a vertical distance in a range of 1 (one) inch to 2 (two) inches.

As shown in FIG. 1, the system 10, such as the remote anchoring system 10*a*, comprises a pole 84 (see also FIG. 4A) for providing access to the overhead area 16. The pole 84 may comprise an extension pole 84*a* (see FIG. 1), a telescoping pole 84*b* (see FIG. 1), or another suitably long pole to provide access to the overhead area 16. The pole 84, such as the extension pole 84*a*, or the telescoping pole 84*b*, has a pole first end 86*a* (see FIG. 4A), a pole second end 86*b* (see FIG. 4A), and a tubular body 88 (see FIG. 4A) that is adjustable to a length 89 (see FIG. 4A) that is desired. For example, the pole 84, such as the extension pole 84*a*, or the telescoping pole 84*b*, is preferably adjustable to a length 89 (see FIG. 4A) in a range of from 6 (six) feet to 16 (sixteen) feet. However, the pole 84, such as the extension pole 84*a*, or the telescoping pole 84*b*, may also be adjustable to another suitable length. The pole 84 may be made of a metal material, such as aluminum, and/or a material such as fiberglass. The pole 84 may also be made of another suitable material.

The pole first end 86*a* is accessible to, and provides access to, the overhead area 16, and the pole second end 86*b* is manually held, and remotely operated and handled, by the operator 20 or user 22. The pole 84 has a pull cord reel 90 (see FIG. 4C) with a pull cord 92 (see FIGS. 1, 4C) that extends from, and retracts to, the pull cord reel 90. The pull cord reel 90 is preferably attached to the pole 84 and manually controlled by the operator 20 or user 22. The pole 84 is discussed in further detail below with respect to FIGS. 4A-4D.

As shown in FIG. 1, the system 10, such as the remote anchoring system 10*a*, further comprises a positioning arm 94, or installation arm 96 (see FIG. 2A), configured for attachment to, and in use attached to, the pole 84, to position and install the anchoring member 12, such as the strap 40, over a top portion 14*a* (see FIG. 6D) of the anchorage structure 14, such as over a top portion 61 (see FIG. 6D) of the beam 60.

The positioning arm 94, or installation arm 96, comprises a first end 98*a* (see FIGS. 1, 2A), and a second end 98*b* (see FIGS. 1, 2A) offset from the first end 98*a*. As shown in FIG. 1, the positioning arm 94, or installation arm 96, further comprises an elongated (ELONG.) body 100. The positioning arm 94, or installation arm 96, has a low profile 102 (see FIGS. 1, 2D) and has the elongated body 100 comprising an outboard portion 104 (see FIGS. 1, 2A) and an inboard portion 106 (see FIGS. 1, 2A). As shown in FIG. 2E, the outboard portion 104 has a first end 105*a* and a second end 105*b*, and the inboard portion 106 has a first end 107*a* and a second end 107*b*. When the outboard portion 104 is attached to the inboard portion 106 and the positioning arm 94 is in an extended position 170 (see FIG. 2I), as shown in FIG. 2E, the second end 105*b* of the outboard portion 104 is attached to the first end 107*a* of the inboard portion 106, and there is an overlap between the second end 105*b* of the outboard portion 104 and the first end 107*a* of the inboard portion 106. As shown in FIG. 2E, the positioning arm 94 has a length 97. Preferably, the length 97, such as the overall length, of the positioning arm 94, either with the two-piece elongated body 100*a* (see FIG. 2I) in the extended position 170, or the one-piece elongated body 100*b* (see FIG. 2J), is in a range of 24 (twenty-four) inches to 42 (forty-two) inches. However, the length 97 may also be greater than 42 (forty-two) inches.

The positioning arm 94 is made of a metal material, such as aluminum, brass, steel, stainless steel, a combination thereof, or another suitable metal material. However, the positioning arm 94 may be made of another suitable material. Aluminum is particularly suitable for making the positioning arm, as aluminum is a lightweight and sturdy metal, as the positioning arm 94 is attached to the pole 84 above the head of the operator 20 or user 22.

Figure 7A:
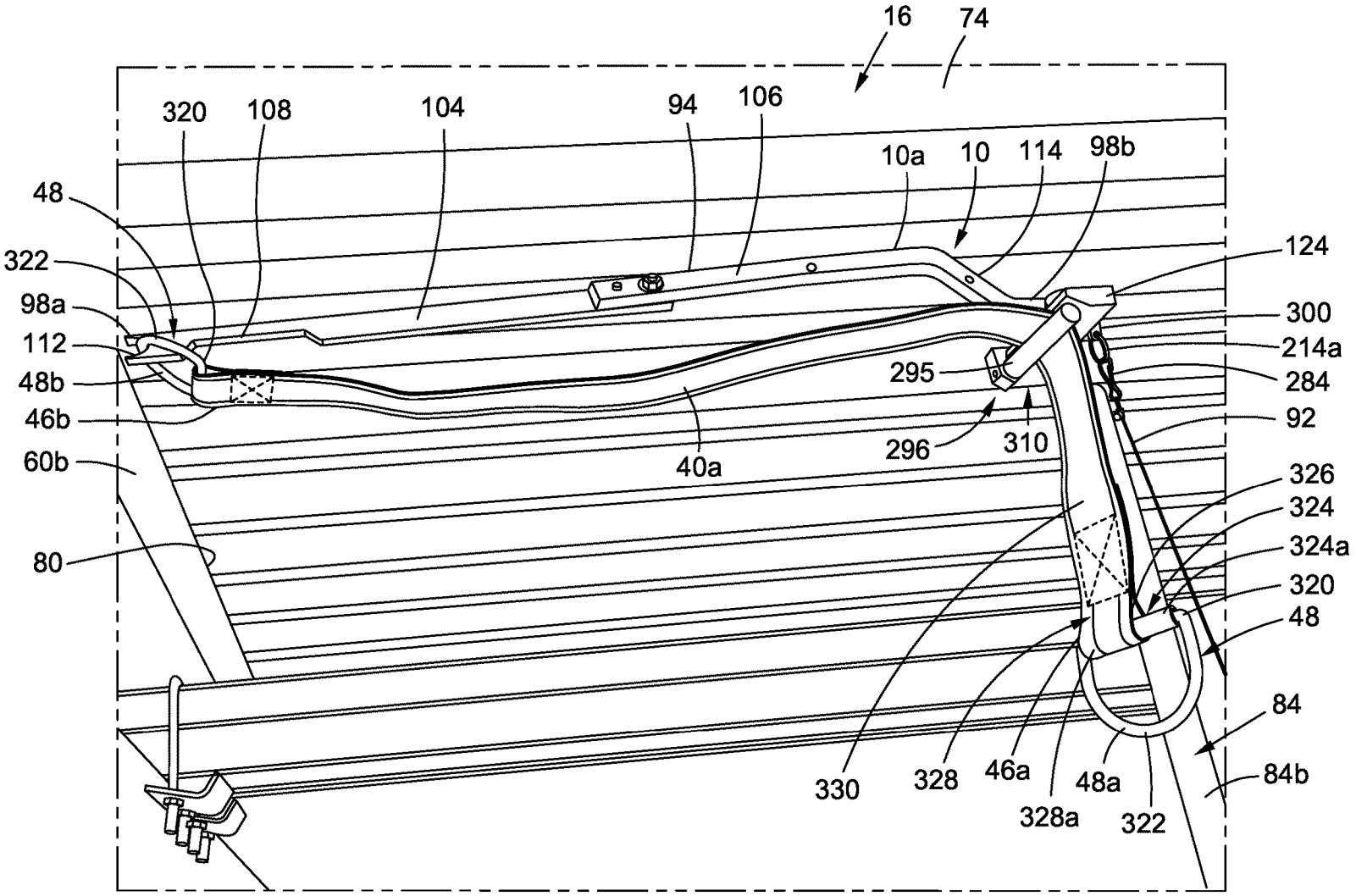
FIG. 7A is an illustration of a close-up left side perspective view of a version of a system of the disclosure, used to install and position, with a positioning arm, a strap on a beam in an overhead area having a limited clearance area.

The positioning arm 94, or installation arm 96, further comprises a recessed area 108 (see FIGS. 1, 2A), such as a rebated area 108*a* (see FIG. 2A), formed in the outboard portion 104 at, or in proximity to, or near, the first end 98*a*. The recessed area 108, such as the rebated area 108*a*, of the positioning arm 94 allows for an improved clearance 110 (see FIG. 1) of both the outboard portion 104 and a D-ring 48 attached to the anchoring member 12, such as the strap 40, to pass through the limited clearance area 80 in the overhead area 16. The recessed area 108, such as the rebated area 108*a*, at, or in proximity to, or near, the first end 98*a*, allows for greater clearance for the D-ring 48 to pass through the limited clearance area 80 or narrow space. The D-ring 48 passing through the limited clearance area 80 typically comprises the second D-ring 48*b*, or small D-ring, attached to a notched portion 112 (see FIG. 2A) at the first end 98*a*. However, the D-ring 48 passing through the limited clearance area 80 may also comprise the first D-ring 48*a*, or large D-ring, if the first end 44*a* of the anchoring member 12, such as the strap first end 46*a* of the strap 40, is coupled or attached to the notched portion 112 (see FIG. 2A) at the first end 98*a* of the positioning arm 94. The D-rings 48, also referred to as lashing rings, are tie-down metal rings shaped like the letter D and used primarily as a lashing point or tie-down point. As shown in FIG. 7A, the D-rings 48, such as the first D-ring 48*a* and the second D-ring 48*b*, each have a base portion 320 that is straight and is integral with a curved portion 322 that is curved. As further shown in FIG. 7A, a sleeve 324, such as a cylindrical plastic sleeve 324*a*, surrounds the exterior of the base portion 320 to protect an interior 326 of a webbing 328, such as a load-bearing webbing 328*a*, from abrasion with the D-ring 48. As shown in FIG. 7A, the beam strap 40*a* may further have a chafe pad 330, or wear pad, along the length of the beam strap 40*a*. The chafe pad 330, or wear pad, further protects the webbing 328, such as the load-bearing webbing 328*a*. As shown in FIG. 8E, the anchoring member 12, such as the fall protection strap 40*b*, may further comprise a double webbing 328*b*, where the double webbing 328*b* protects the inside of the load-bearing webbing 328*a* from abrasion with the D-ring 48, such as the first D-ring 48*a*. The thickest part of the anchoring member 12, such as the strap 40, for example, the beam strap 40*a*, is a stack-up, or a sandwich, formed by the base portion 320 (see FIG. 7A) of the D-ring 48, the sleeve 324 (see FIG. 7A) surrounding the base portion 320, the webbing 328 (see FIG. 7A) surrounding the sleeve 324, and the chafe pad 330 (see FIG. 7A), or wear pad, if the chafe pad 330 is present. The D-rings 48 are hardware each preferably made of a metal material, such as steel, stainless steel, plated steel, aluminum, or another suitably sturdy and strong metal material.

The positioning arm 94, or installation arm 96, further comprises a dogleg shaped portion 114 (see FIGS. 1, 2A) formed along an area 106*a* (see FIG. 2B) of the inboard portion 106 at, or in proximity to, or near, the second end 98*b* of the positioning arm 94. As used herein, "dogleg" means a bend in a shape of a hind leg of a dog, such as a first bend and then a subsequent bend back in an original direction. The positioning arm 94 has a non-linear profile 115 (see FIG. 2C). Further, the second end 98*b* of the positioning arm 94 is offset from the first end 98*a* of the positioning arm 94 at an offset angle 116 (see FIGS. 1, 2D), so that when the positioning arm 94 is in use with the pole 84 at the overhead area 16, a center (CENT.) of balance 118 (see FIGS. 1, 6C) of the positioning arm 94 is in proximity to an operator grip area 120 (see FIG. 6C) on the pole 84 (see FIG. 6C), to provide an improved ergonomic control 122 (see FIG. 1) of the pole 84 and the positioning arm 94. The offset angle 116 is preferably a 5° (five degree) angle 116*a* (see FIG. 2D) offset from a horizontal line 117 (see FIG. 2D). However, the offset angle 116 may comprise another suitable degree angle offset from a horizontal line.

With the disclosed system 10, such as the remote anchoring system 10*a*, the center of balance 118 of the positioning arm 94 is closer to the operator grip area 120 on the pole 84, thus requiring less effort by the operator 20 or user 22, and affording improved ergonomic control 122 of the pole 84 and the positioning arm 94. With known systems having an arm with a first end in a same plane as a second end and having a first end that is not offset from the second end, a center of balance is in front of an operator grip area near a bottom end of the pole, and may need greater effort to hold the arm and pole assembly upright. In particular, the offset angle 116, for example, a 5° (five degree) angle 116*a*, improves the center of balance 118, when the positioning arm 94 is in use, thus providing the improved ergonomic control 122.

The dogleg shaped portion 114 and the offset angle 116 allow for improved clearance 110 (see FIG. 1) at the pole first end 86*a* of the pole 84 and allow for passage of the anchoring member 12, such as the strap 40, for example, the beam strap 40*a*, through the overhead area 16, and in particular, the overhead area 16 having a limited clearance area 80. The dogleg shaped portion 114 and the offset angle 116 help to keep the pole first end 86*a* of the pole 84 down and help to improve the center of balance 118, when the operator 20 or user 22 is holding the pole second end 86*b*, or bottom of the pole 84, and the positioning arm 94 is attached at the pole first end 86*a*, or top of the pole 84, and above the head of the operator 20 or user 22.

The positioning arm 94, or installation arm 96, is discussed in further detail below with respect to FIGS. 2A-2J.

As shown in FIG. 1, the system 10, such as the remote anchoring system 10*a*, further comprises an attachment tool assembly 124 attached to the pole 84. The attachment tool assembly 124 has a pole attachment end 126 (see FIG. 5A) configured to attach, and in use, is attached, to an opening 128 (see FIG. 4A) in the pole second end 86*b* of the pole 84. The attachment tool assembly 124 is configured to attach the positioning arm 94 to the pole 84. The attachment tool assembly 124 is further configured to attach a safety hook assembly 130 (see FIG. 4E) to the pole 84. A known version of an attachment tool assembly 124 that may be used with the system 10 is discussed in further detail below with respect to FIGS. 5A-5B. However, other suitable attachment tool assemblies may also be used with the system 10 disclosed herein.

As shown in FIG. 1, the system 10, such as the remote anchoring system 10*a*, further comprises the safety hook assembly 130 configured for attachment to, and in use, attached to, the pole 84, such as the extension pole 84*a*, or the telescoping pole 84*b*, to secure the anchoring member 12, such as the strap 40, to the anchorage structure 14, such as the beam 60, and to release and remove the anchoring member 12, such as the strap 40, from, the anchorage structure 14, such as a beam 60. As shown in FIG. 1, the safety hook assembly 130 comprises a safety hook portion 132, a hook end 134 of the safety hook portion 132, a hook body 136, a hook cover 138 attached to the hook body 136, and a safety latch mechanism 140, such as a remotely operated safety latch mechanism 140*a*. The safety latch mechanism 140 comprises a safety latch 142 (see FIG. 1) engageable with the hook end 134. The safety latch 142 has an undercut portion 144 (see FIGS. 1, 3H) that forms a gap 146 (see FIGS. 1, 3H) with an interior surface portion 148 (see FIG. 3H) corresponding to the shape of the undercut portion 144 and formed in the hook body 136, to provide a stick-free actuation 150 (see FIG. 1) of the safety latch 142, when the safety latch 142 moves between a closed position 152 (see FIG. 3F) and an open position 154 (see FIG. 3G).

Figure 3A:
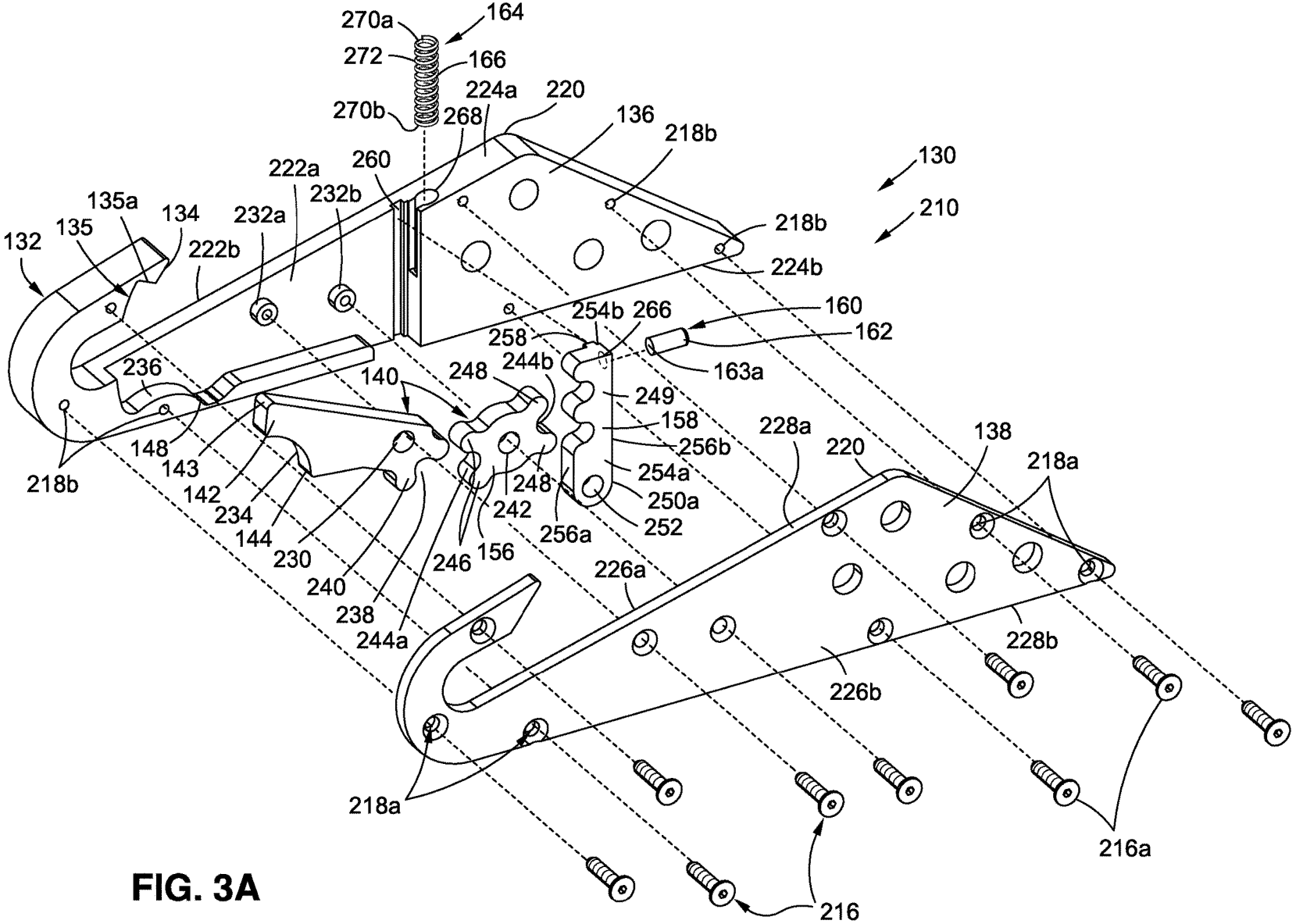
FIG. 3A is an illustration of an exploded top left side perspective view of an exemplary version of a safety hook assembly of the disclosure, where the safety hook assembly is unassembled.

As shown in FIG. 1, the safety latch mechanism 140 further comprises an idler gear 156, a rack slider 158, a spring plunger element 160, such as in the form of a dowel 162 (see FIG. 3A), and a spring element 164, such as in the form of a compression spring 166 (see FIG. 3A). The components of the safety hook assembly 130 are discussed in further detail below with respect to FIGS. 3A-3L.

Figure 3B:
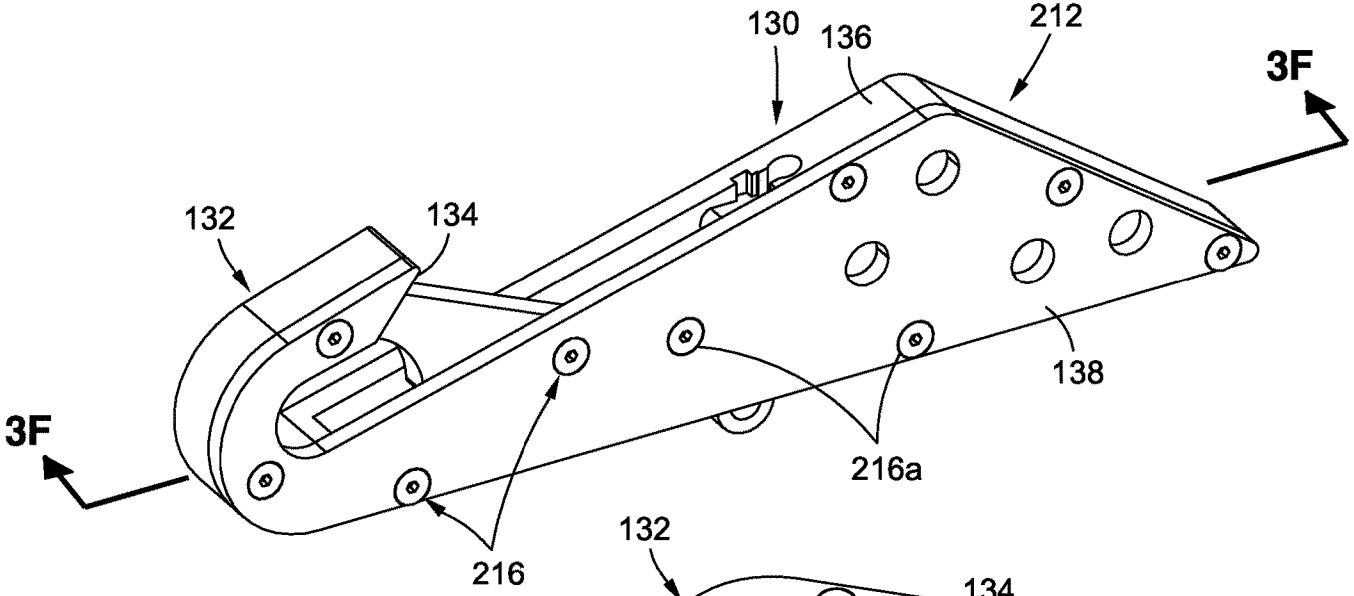
FIG. 3B is an illustration of a top left side perspective view of the safety hook assembly of FIG. 3A, where the safety hook assembly is assembled.
Figure 3C:
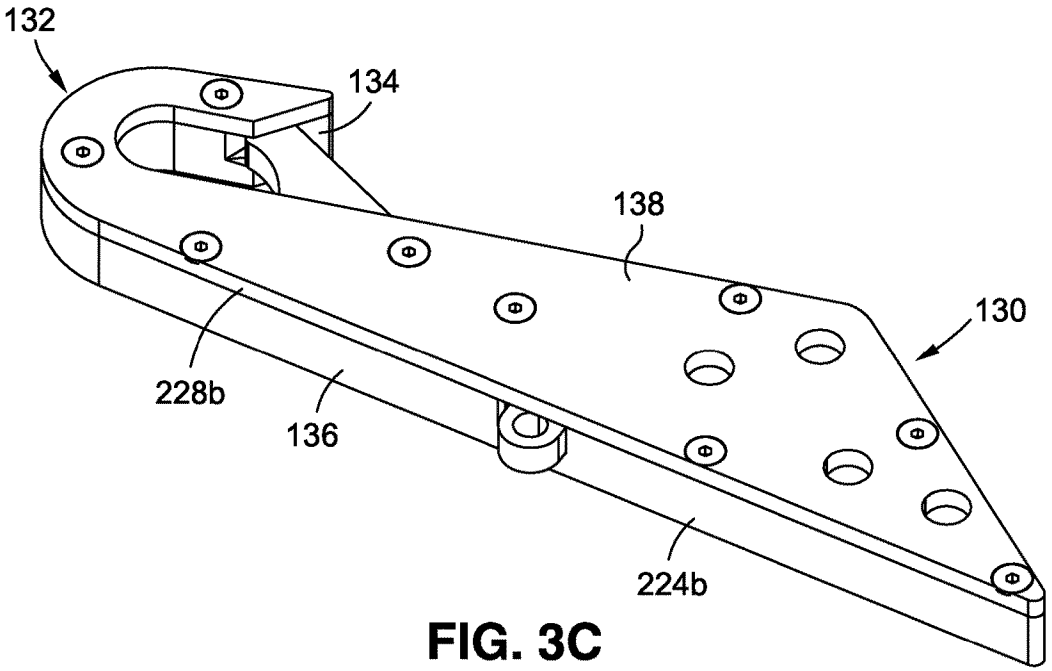
FIG. 3C is an illustration of a bottom left side perspective view of the safety hook assembly of FIG. 3B.
Figure 3D:
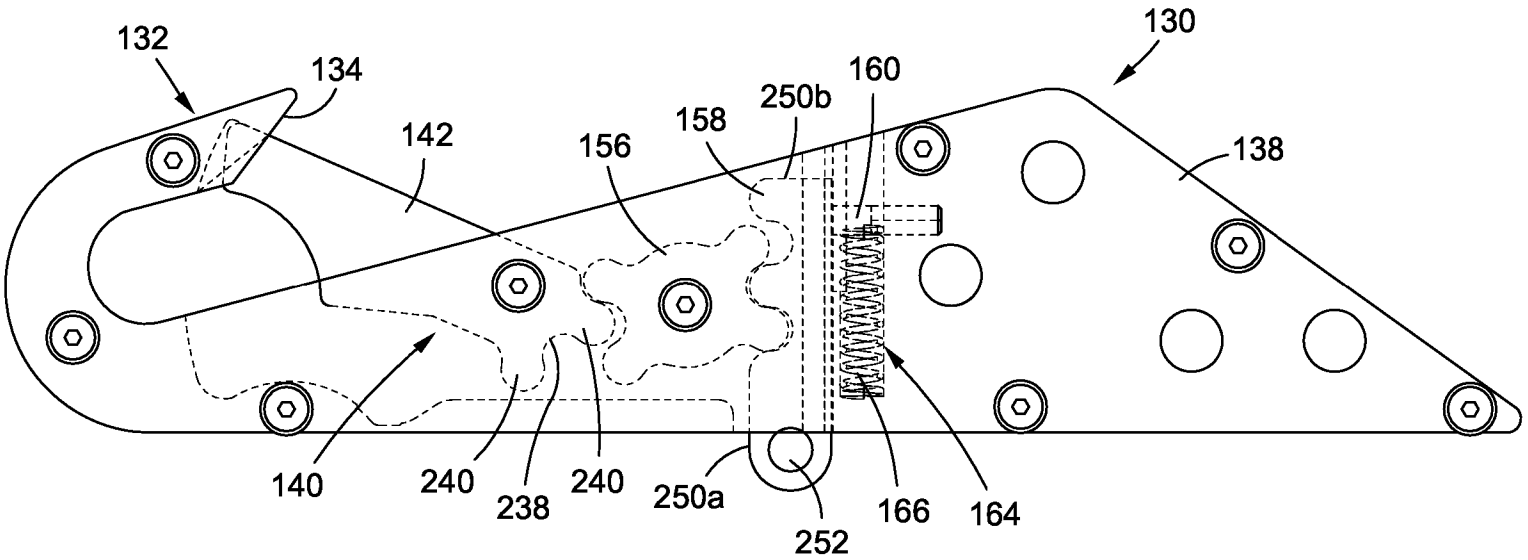
FIG. 3D is an illustration of a left side view of the safety hook assembly of FIG. 3B, showing interior components.
Figure 3E:
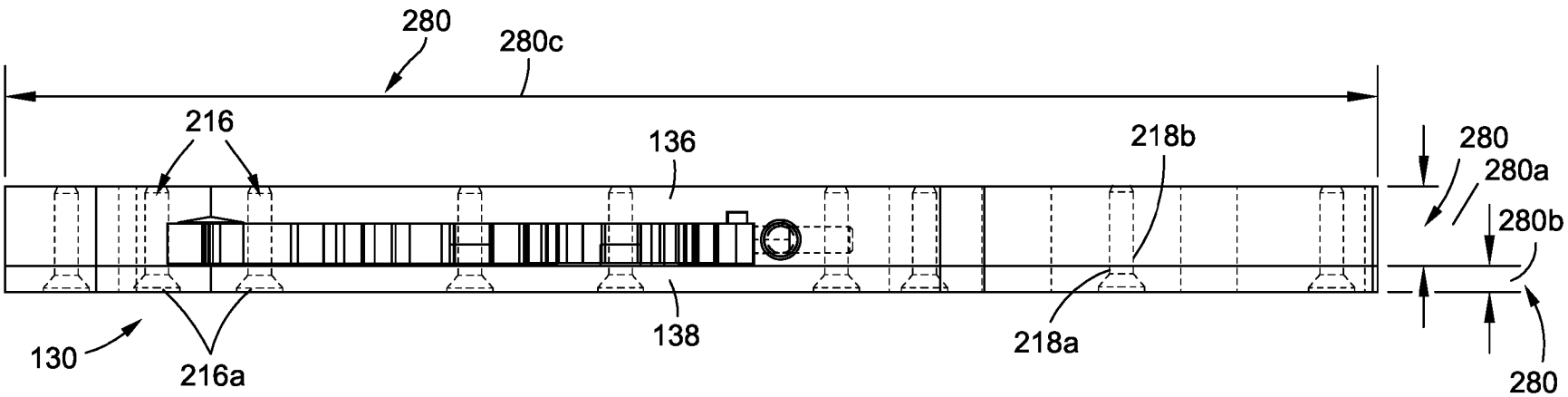
FIG. 3E is an illustration of a top view of the safety hook assembly of FIG. 3B, showing interior components.
Figure 3F:
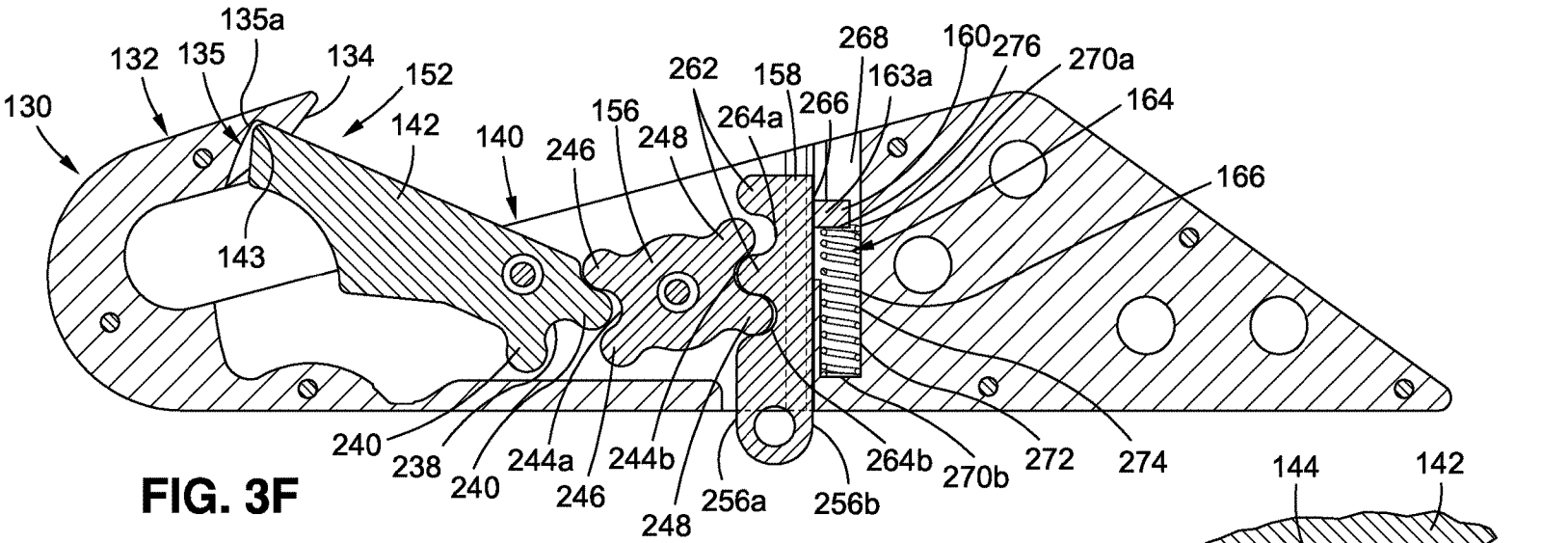
FIG. 3F is an illustration of a cross-section of the safety hook assembly of FIG. 3B, taken along lines 3F-3F, showing a safety latch in a closed position.

The safety latch mechanism 140 is remotely operated by the operator 20 or the user 22, via the pull cord 92 (see FIG. 1) attached to the safety latch mechanism 140, such that when the operator 20 or the user 22 pulls the pull cord 92, the safety latch 142 opens to the open position 154 (see FIG. 3G), and when the operator 20 or user 22 releases the pull cord 92, the safety latch 142 closes to the closed position 152 (see FIG. 3F). Releasing the pull cord 92 causes the spring element 164 to close the safety latch 142.

In another version of the disclosure, there is provided a remote anchoring system 10*a* (see FIG. 1) to install and remove a beam strap 40*a* (see FIG. 1) on a beam 60 (see FIG. 1) in an overhead area 16 (see FIG. 1). The remote anchoring system 10*a* comprises the extension pole 84*a* (see FIG. 1) having a pole first end 86*a* (see FIG. 1) accessible to the overhead area 16, and a pole second end 86*b* (see FIG. 1) manually operated by an operator 20 (see FIG. 1).

The remote anchoring system 10*a* system further comprises the positioning arm 94 (see FIG. 1), or installation arm 96 (see FIG. 2A), having a low profile 102 (see FIG. 1) and configured for attachment to the pole first end 86*a*, via an attachment tool assembly 124 (see FIG. 1), to position the beam strap 40*a* over a top portion 61 (see FIG. 6E) of the beam 60. The positioning arm 94 comprises a first end 98*a* (see FIG. 1) having a notched portion 112 (see FIG. 2A), and a second end 98*b* (see FIG. 1) offset from the first end 98*a* at an offset angle 116 (see FIG. 1). The positioning arm 94 further comprises the elongated body 100 (see FIG. 1) having the outboard portion 104 (see FIG. 1) attached to the inboard portion 106 (see FIG. 1), via the attachment assembly 180 (see FIG. 2E). The positioning arm 94 further comprises the recessed area 108 (see FIG. 1) formed in the outboard portion 104 at, or in proximity to, the first end 98*a*. The positioning arm 94 further comprises the dogleg shaped portion 114 (see FIG. 1) formed along an area 106*a* (see FIG. 2B) of the inboard portion 106 at, or in proximity to, the second end 98*b*.

The remote anchoring system 10*a* further comprises the safety hook assembly 130 (see FIG. 1) configured for attachment to the pole first end 86*a*, via the attachment tool assembly 124, to secure and install the beam strap 40*a* to the beam 60, and to remove the beam strap 40*a* from the beam 60. The safety hook assembly 130 comprises the hook body 136 (see FIG. 1), the hook cover 138 (see FIG. 1) attached to the hook body 136, via a plurality of fastener elements 216 (see FIG. 3A), and the safety hook portion 132 (see FIG. 1) with the hook end 134 (see FIG. 1). The safety hook assembly 130 further comprises the safety latch mechanism 140 (see FIG. 1) disposed between the hook body 136 and the hook cover 138. The safety latch mechanism 140 has the safety latch 142 (see FIG. 1) engageable with the hook end 134, and has the spring element 164 (see FIG. 1) in communication with the safety latch 142. The safety latch mechanism 140 further comprises the idler gear 156 (see FIG. 1) engageable with the safety latch 142, the rack slider 158 (see FIG. 1) engageable with the idler gear 156, and the spring plunger element 160 (see FIG. 1) engageable with the rack slider 158 and engageable with the spring element 164. The safety latch mechanism 140 is remotely operated by the operator 20, via the pull cord 92 (see FIG. 1) attached to the safety latch mechanism 140, such that when the operator 20 pulls the pull cord 92, the safety latch 142 opens, and when the operator 20 releases the pull cord 92, the spring element 164 causes the safety latch 142 to close.

Figure 2A:
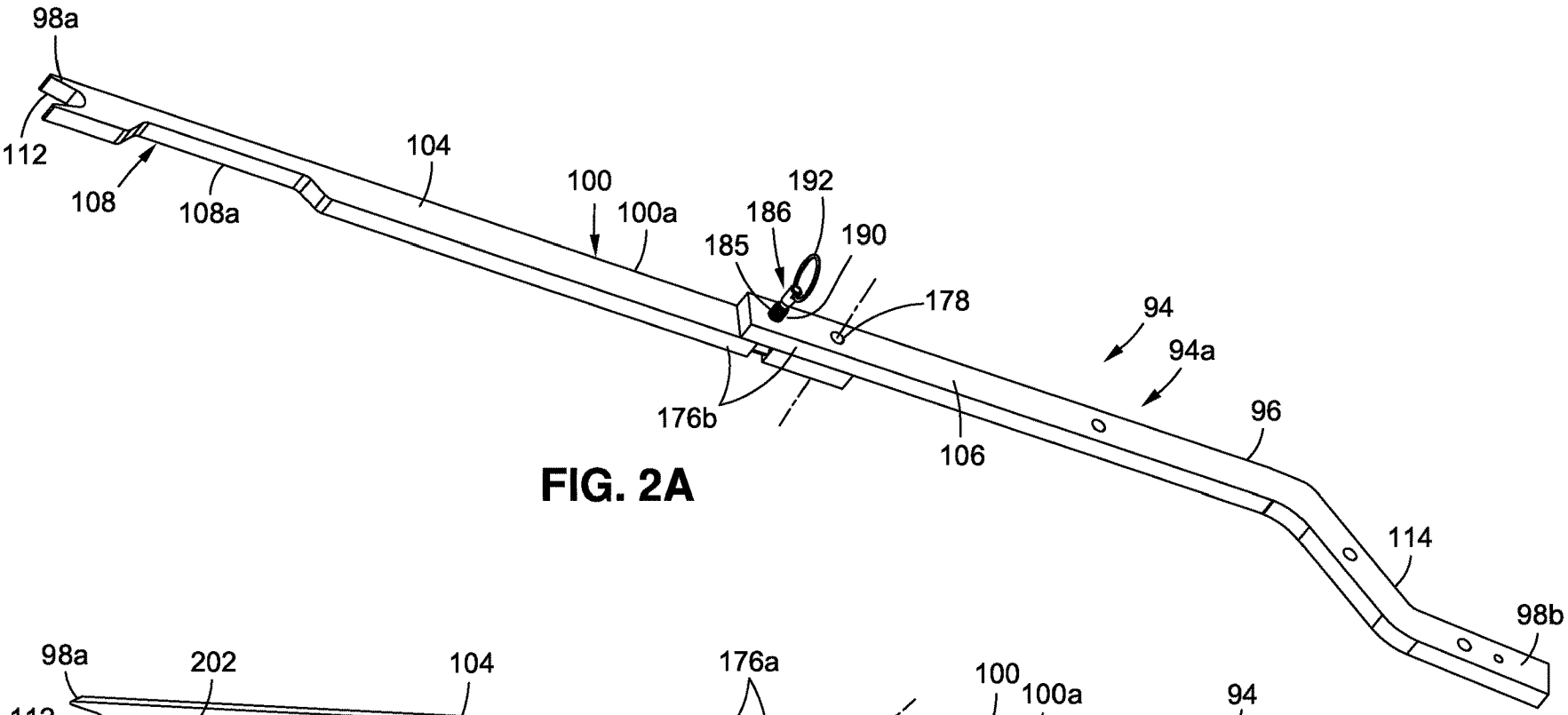
FIG. 2A is an illustration of a bottom left side perspective view of an exemplary version of a positioning arm used in a version of the system of the disclosure.
Figure 2B:
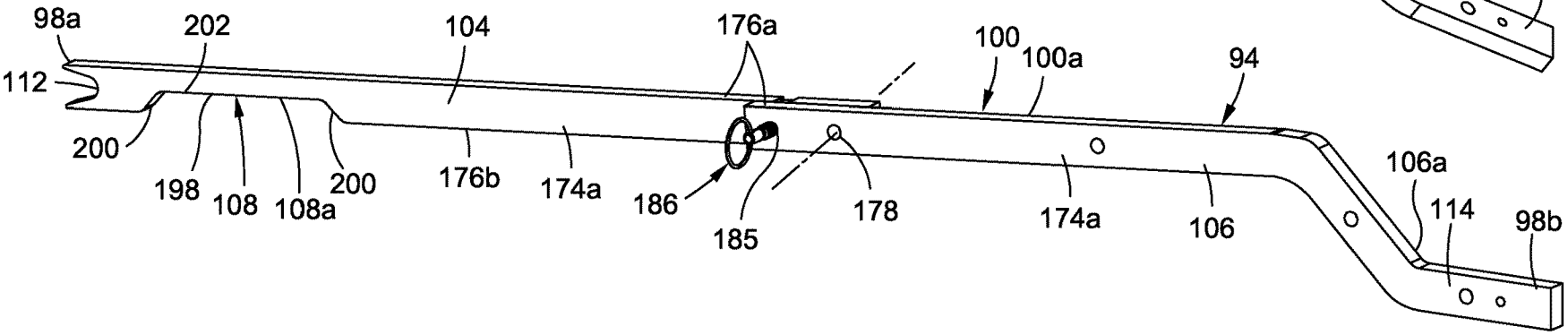
FIG. 2B is an illustration of a left side perspective view of the positioning arm of FIG. 2A.
Figure 2C:
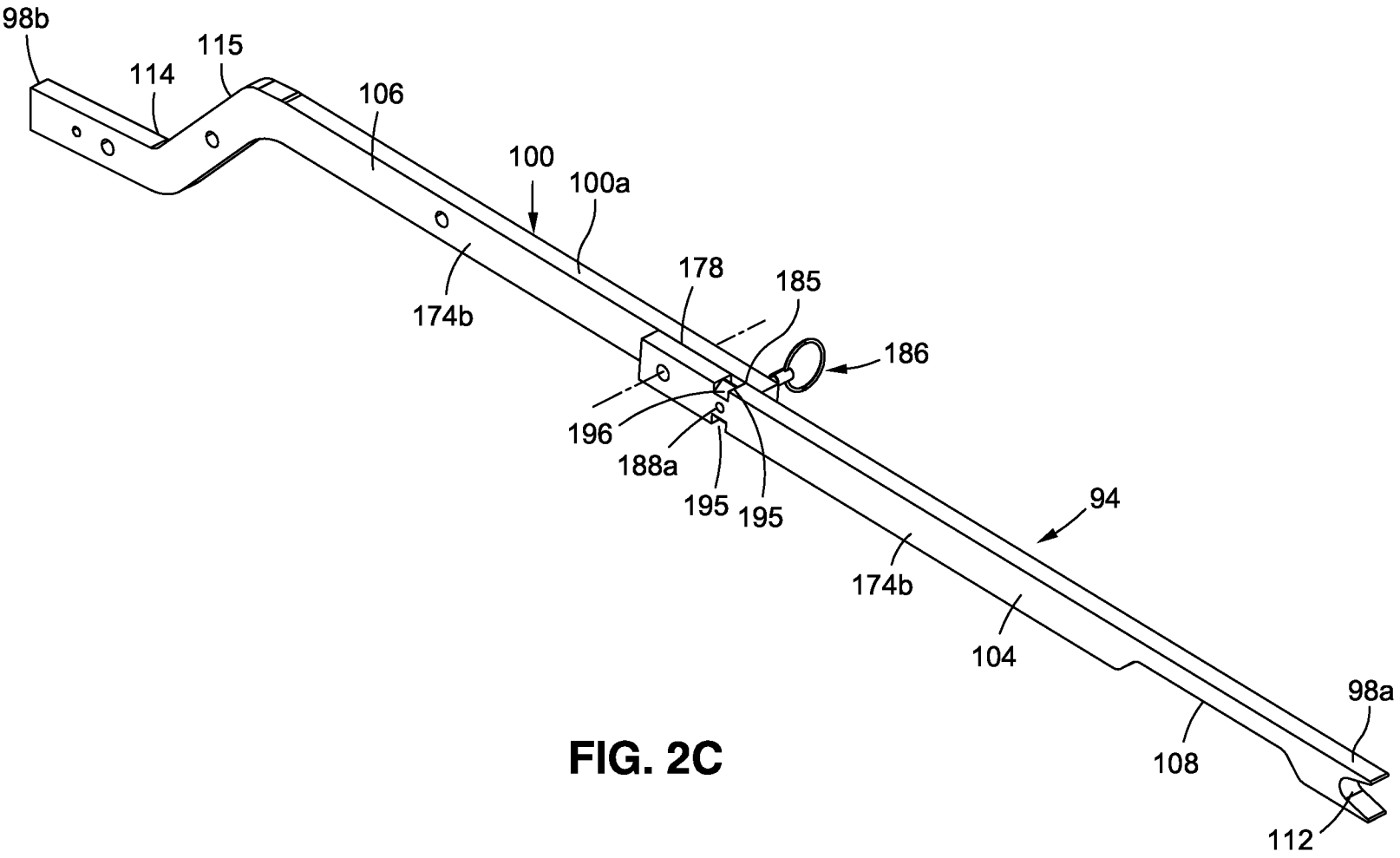
FIG. 2C is an illustration of a top right side perspective view of the positioning arm of FIG. 2A.
Figure 2D:
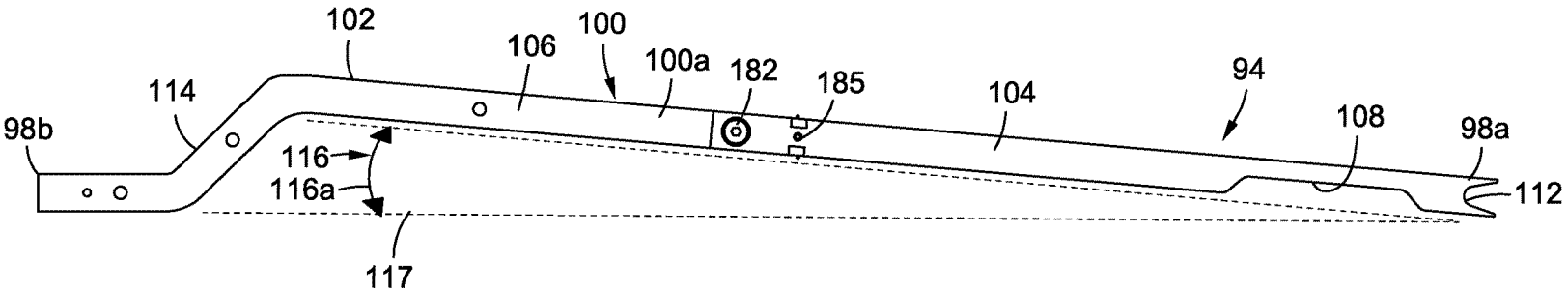
FIG. 2D is an illustration of a right side view of the positioning arm of FIG. 2A.
Figure 2E:
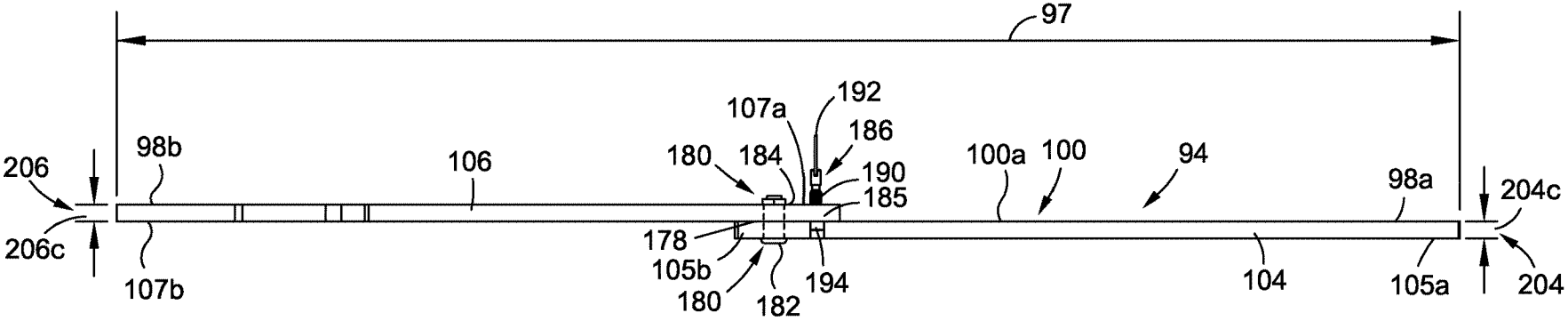
FIG. 2E is an illustration of a top view of the positioning arm of FIG. 2A.

Now referring to FIGS. 2A-2J, FIGS. 2A-2J show versions of the positioning arm 94 for use in a version of the system 10, such as the remote anchoring system 10*a*, of the disclosure. FIG. 2A is an illustration of a bottom left side perspective view of an exemplary version of the positioning arm 94, or installation arm 96, used in a version of the system 10 (see FIG. 1), such as the remote anchoring system 10*a* (see FIG. 1), of the disclosure. FIG. 2A shows one version of the positioning arm 94, such as in the form of positioning arm 94*a*. The positioning arm 94 has a low profile 102 (see FIG. 2D).

Figure 2F:
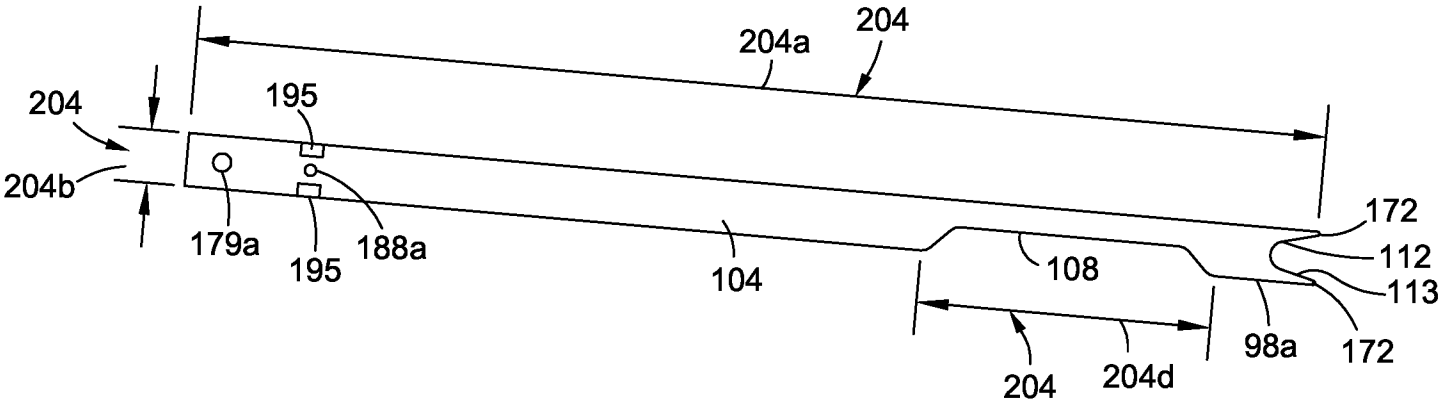
FIG. 2F is an illustration of a right side view of an outboard portion of the positioning arm of FIG. 2A.
Figure 2G:
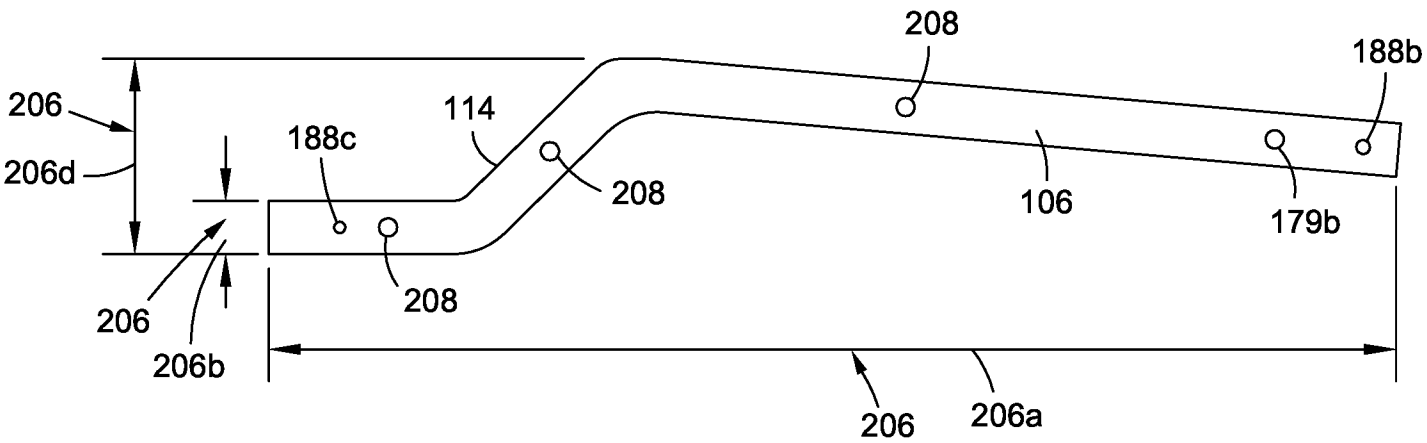
FIG. 2G is an illustration of a right side view of an inboard portion of the positioning arm of FIG. 2A.
Figure 2H:
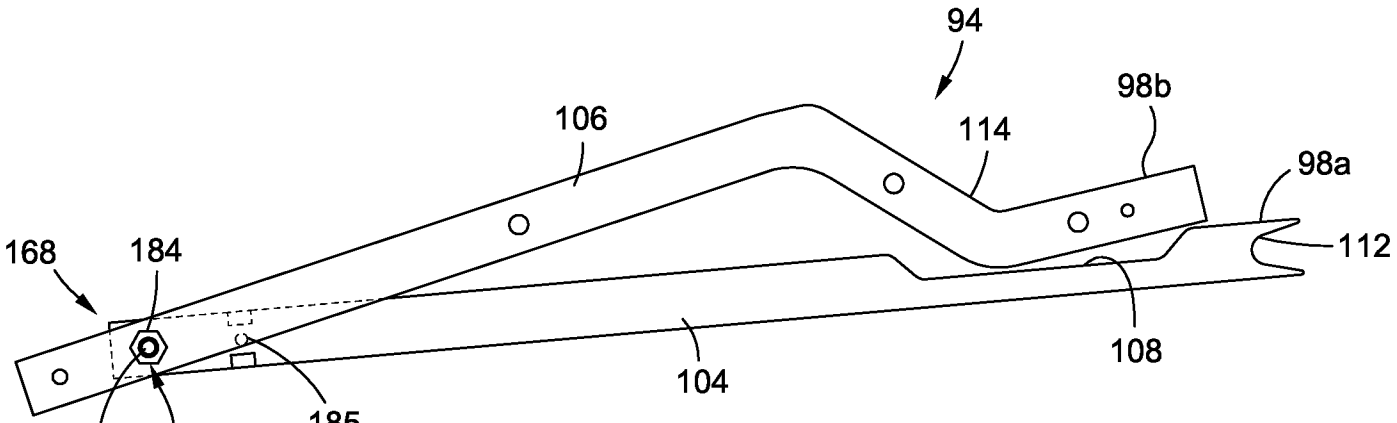
FIG. 2H is an illustration of a left side view of the positioning arm of FIG. 2A in a folded position.
Figure 2I:
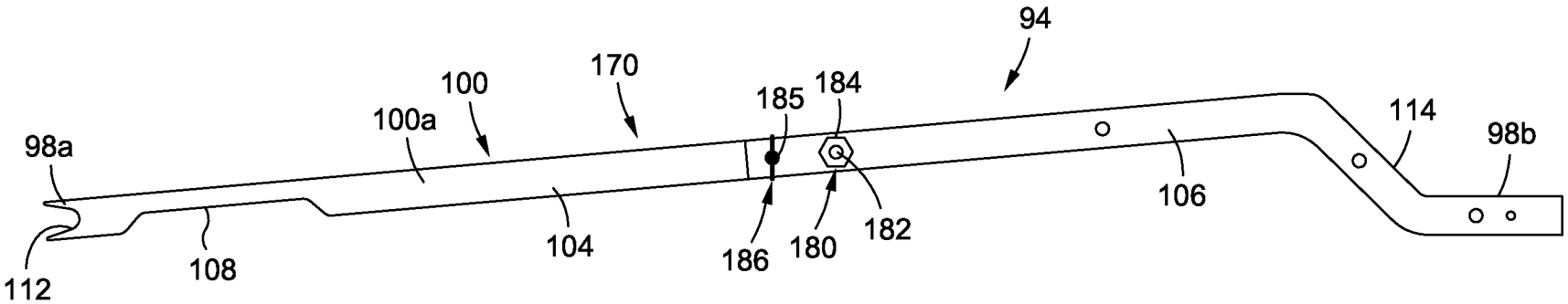
FIG. 2I is an illustration of a left side view of the positioning arm of FIG. 2A in an extended position.

FIG. 2B is an illustration of a left side perspective view of the positioning arm 94 of FIG. 2A. FIG. 2C is an illustration of a top right side perspective view of the positioning arm 94 of FIG. 2A. FIG. 2D is an illustration of a right side view of the positioning arm 94 of FIG. 2A. FIG. 2E is an illustration of a top view of the positioning arm 94 of FIG. 2A. FIG. 2F is an illustration of a right side view of the outboard portion 104 of the positioning arm 94 of FIG. 2A. FIG. 2G is an illustration of a right side view of the inboard portion 106 of the positioning arm 94 of FIG. 2A. FIG. 2H is an illustration of a left side view of the positioning arm 94 of FIG. 2A in a folded position 168. FIG. 2I is an illustration of a left side view of the positioning arm 94 of FIG. 2A in an extended position 170. FIGS. 2A-2E, 2I show the elongated body 100 of the positioning arm 94 in the form of a two-piece elongated body 100*a*.

Figure 2J:
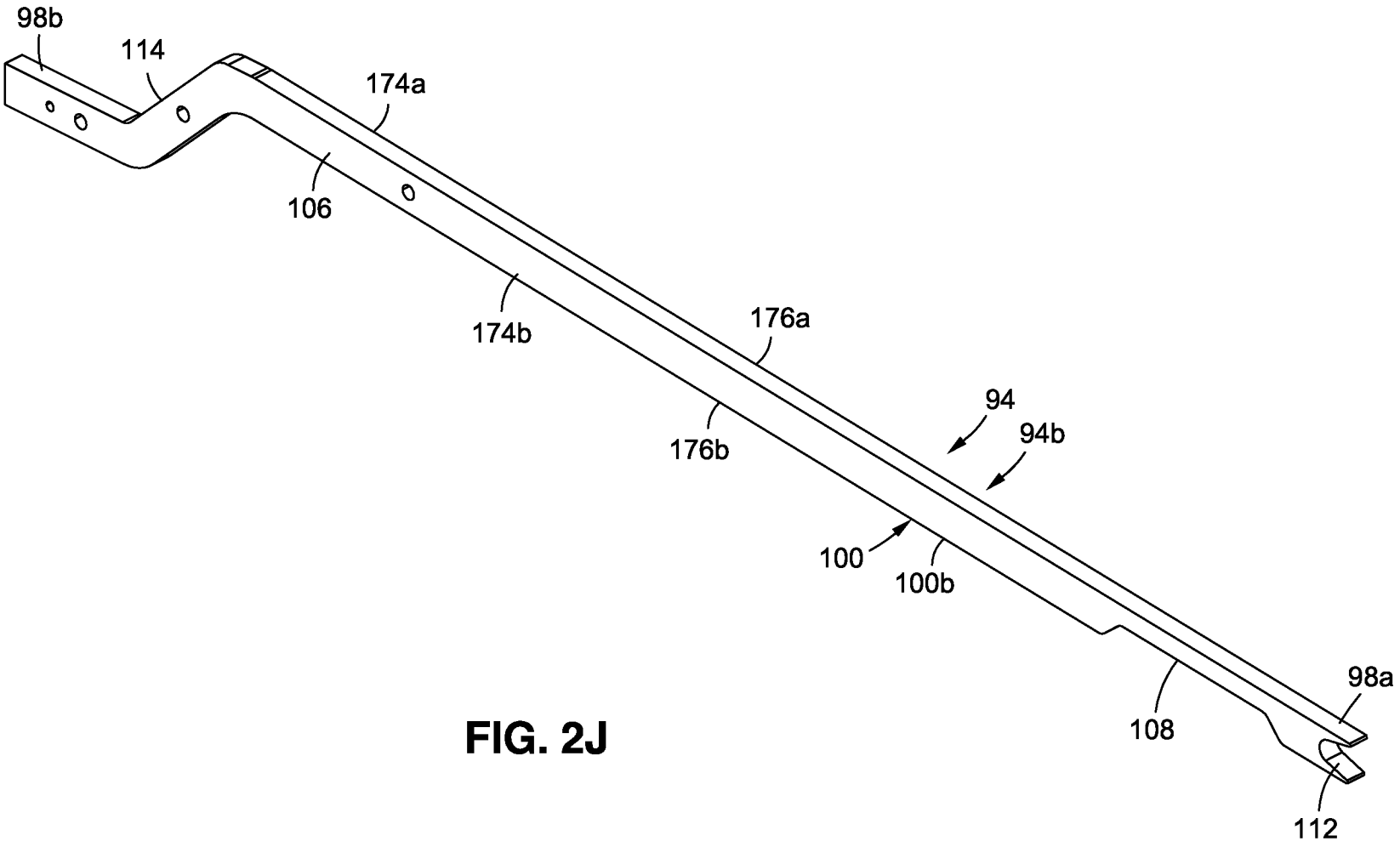
FIG. 2J is an illustration of a top right side perspective view of another version of a positioning arm used in a version of the system of the disclosure.

FIG. 2J is an illustration of a top right side perspective view of another version of a positioning arm 94, such as in the form of positioning arm 94*b*, used in a version of the system 10, such as the remote anchoring system 10*a*, of the disclosure. FIG. 2J shows the elongated body 100 of the positioning arm 94 in the form of a one-piece elongated body 100*b*.

FIGS. 2A-2E, 2H, 2I, 2J show the positioning arm 94 comprising the first end 98*a*, and the second end 98*b* offset from the first end 98*a*. As shown in FIGS. 2A-2D, 2F, 2H-2J, the first end 98*a* has the notched portion 112 configured to hold and retain a D-ring 48 (see FIG. 6D) of the anchoring member 12 (see FIG. 6D), such as a strap 40 (see FIG. 6D). As shown in FIG. 2F, the notched portion 112 has a U-shaped profile 113 formed between tips 172, or prongs, at the first end 98*a*. The notched portion 112 is of a sufficient depth and width to hold and retain the D-ring 48, for example, the second D-ring 48*b* (see FIG. 1), or small D-ring, or the first D-ring 48*a* (see FIG. 1), or large D-ring, during the positioning 52 (see FIG. 1) stage of the installation 50 (see FIG. 1).

The elongated body 100 of the positioning arm 94 comprises a first side 174*a* (see FIGS. 2B, 2J), a second side 174*b* (see FIGS. 2B, 2C, 2J), a top end 176*a* (see FIGS. 2B, 2J), and a bottom end 176*b* (see FIGS. 2A, 2J).

As shown in FIGS. 2A-2E, 2H, 2I, 2J, the elongated body 100 comprises the outboard portion 104 (see also FIG. 2F) and the inboard portion 106 (see also FIG. 2G). With the elongated body 100 comprising the two-piece elongated body 100*a*, the outboard portion 104 is attached to the inboard portion 106, at a first attachment point 178 (see FIGS. 2A-2C, 2E) with an attachment assembly 180 (see FIGS. 2E, 2H, 2I). The first attachment point 178 comprises a through hole 179*a* (see FIG. 2F) formed through the outboard portion 104 aligned with a through hole 179*b* (see FIG. 2G) formed through the inboard portion 106, when the outboard portion 104 is attached to the inboard portion 106. In one version, the attachment assembly 180 comprises a screw 182 (see FIGS. 2D, 2E, 2H, 2I), such as a machine screw, inserted through the first attachment point 178, and a hex nut 184 (see FIGS. 2E, 2H, 2I) attached to the screw 182. The attachment assembly 180 may also comprise another suitable fastener, bolt, or attachment means.

With the elongated body 100 comprising the two-piece elongated body 100*a*, the outboard portion 104 pivots about the first attachment point 178, and pivots about the attachment assembly 180, such as about the screw 182 and the hex nut 184, with respect to the inboard portion 106. The outboard portion 104 pivots with respect to the inboard portion 106 as the positioning arm 94 moves between the folded position 168 (see FIG. 2H) and the extended position 170 (see FIG. 2I).

With the elongated body 100 comprising the two-piece elongated body 100*a*, the outboard portion 104 is further attached to the inboard portion 106 at a second attachment point 185 (see FIGS. 2A-2E, 2H, 2I) with a retractable spring plunger 186 (see FIGS. 2A-2C, 2E, 2H, 2I), when the positioning arm 94 is in the extended position 170, such as the fully extended position. The retractable spring plunger 186 may comprise a corrosion-resistant retractable spring plunger. The second attachment point 185 comprises a through hole 188*a* (see FIG. 2F) formed through the outboard portion 104 aligned with a through hole 188*b* (see FIG. 2G) formed through the inboard portion 106, when the positioning arm 94 is in the extended position 170.

In one version, the retractable spring plunger 186 comprises a spring plunger 190 (see FIGS. 2A, 2E) with a pull ring end 192 (see FIGS. 2A, 2E) and a tip end 194 (see FIG. 2E) configured for insertion, and inserted, through the second attachment point 185. The through hole 188*a* (see FIG. 2F) of the outboard portion 104 is aligned with the through hole 188*b* (see FIG. 2G) of the inboard portion 106 and with the tip end 194 of the spring plunger 190 on the inboard portion 106, and the spring plunger 190 is released using the pull ring end 192, so that the tip end 194 of the spring plunger 190 moves into the through hole 188*a* (see FIG. 2F) of the outboard portion 104 to further attach the outboard portion 104 to the inboard portion 106, when the positioning arm 94 is in the extended position 170 (see FIG. 2I), such as the fully extended position. The spring plunger 190 locks when the positioning arm 94 is fully extended in the extended position 170 to lock the outboard portion 104 to the inboard portion 106. Another suitable attachment means may also be used to attach the outboard portion 104 to the inboard portion 106 at the second attachment point 185. As shown in FIGS. 2C, 2F, the outboard portion 104 has notches 195 formed on each side of the through hole 188*a*. The notches 195 formed in the outboard portion 104 have interior ramped surfaces 196 (see FIG. 2C) formed within the notches 195 that are designed to accommodate engagement of the retractable spring plunger 186 into the through hole 188*a*, as the positioning arm 94 pivots back and forth between the folded position 168 and the extended position 170.

The positioning arm 94, or installation arm 96, further comprises the recessed area 108 (see FIGS. 2A-2D, 2F, 2H-2J), such as the rebated area 108*a* (see FIGS. 2A-2B), formed in the outboard portion 104 at, or in proximity to, or near, the first end 98*a*. The recessed area 108, such as the rebated area 108*a*, of the positioning arm 94 allows for an improved clearance 110 (see FIG. 1) of both the outboard portion 104 and a D-ring 48 attached to the anchoring member 12, such as the strap 40, to pass through the limited clearance area 80 (see FIG. 1) in the overhead area 16. As shown in FIG. 2B, in an exemplary version, the recessed area 108, such as the rebated area 108*a*, has a trapezoidal shape 198 with angled sides 200 depending upwardly from the bottom end 176*b* of the elongated body 100 to an interior recessed end 202. In other versions, the recessed area may have another suitable shape.

The positioning arm 94, or installation arm 96, further comprises the dogleg shaped portion 114 (see FIGS. 2A-2D, 2G-2J) formed along an area 106*a* (see FIG. 2B) of the inboard portion 106 (see FIG. 2B) at, or in proximity to, or near, the second end 98*b* of the positioning arm 94. The second end 98*b* of the positioning arm 94 is offset from the first end 98*a* of the positioning arm 94 at an offset angle 116 (see FIG. 2D) from a horizontal line 117 (see FIG. 2D). In one version, the offset angle 116 comprises a 5° (five degree) angle 116*a* (see FIG. 2D) from the horizontal line 117. However, the offset angle 116 may comprise another suitable degree angle offset from a horizontal line.

FIG. 2F shows various dimensions 204 of the outboard portion 104 of the positioning arm (see FIG. 2A). As shown in FIG. 2F, the outboard portion 104 has a length 204*a* and a height 204*b*. As shown in FIG. 2E, the outboard portion 104 has a width 204*c*. As shown in FIG. 2F, the recessed area 108 has a length 204*d*. The length 204*a* of the outboard portion 104 is preferably in a range of 14 (fourteen) inches to 24 (twenty-four) inches, and more preferably, the length 204*a* is 16 (sixteen) inches. However, the length 204*a* may be another suitable length. The height 204*b* of the outboard portion 104 is preferably in a range of 0.5 (one-half) inch to 1.0 (one) inch, and more preferably, the height 204*b* is 0.75 (three-quarter) inch. However, the height 204*b* may be another suitable height. The width 204*c* of the outboard portion 104 is preferably in a range of 0.25 (one-quarter) inch to 0.50 (one-half) inch, and more preferably, the width 204*c* is 0.375 inch. However, the width 204*c* may be another suitable width. The length 204*d* of the recessed area 108 is preferably in a range of 3 (three) inches to 5 (five) inches, and more preferably, the length 204*d* is 4 (four) inches. However, the length 204*d* may be another suitable length.

FIG. 2G shows various dimensions 206 of the inboard portion 106 of the positioning arm (see FIG. 2A). As shown in FIG. 2G, the inboard portion 106 has a length 206*a* and a height 206*b*. As shown in FIG. 2E, the inboard portion 106 has a width 206*c*. As shown in FIG. 2G, the dogleg shaped portion 114 has a height 206*d*. The length 206*a* of the inboard portion 106 is preferably in a range of 14 (fourteen) inches to 24 (twenty-four) inches, and more preferably, the length 206*a* is 16 (sixteen) inches. However, the length 206*a* may be another suitable length. The height 206*b* of the inboard portion 106 is preferably in a range of 0.5 (one-half) inch to 1.0 (one) inch, and more preferably, the height 206*b* is 0.75 (three-quarter) inch. However, the height 206*b* may be another suitable height. The width 206*c* of the inboard portion 106 is preferably in a range of 0.25 (one-quarter) inch to 0.5 (one-half) inch, and more preferably, the width 206*c* is 0.375 inch. However, the width 206*c* may be another suitable width. The height 206*d* of the dogleg shaped portion 114 is preferably in a range of 2 (two) inches to 4 (four) inches, and more preferably, the height 206*d* is 2.75 (two and three-quarter) inches. However, the height 206*d* may be another suitable length. As further shown in FIG. 2G, the inboard portion 106 comprises openings 208 that may be used to receive fasteners or attachment elements. As further shown in FIG. 2G, the inboard portion 106 comprises a through hole 188*c* configured to receive a tip end 194*a* (see FIG. 5B) of a spring plunger 190*a* (see FIG. 5B) of a retractable spring plunger 186*a* (see FIG. 5B) of the attachment tool assembly 124 (see FIG. 5B), when the inboard portion 106 of the positioning arm 94 is attached to the attachment tool assembly 124 for use in installment 50 (see FIG. 1) and positioning 52 (see FIG. 2) of the anchoring member 12 (see FIG. 6D), such as the strap 40 (see FIG. 6D).

Now referring to FIGS. 3A-3L, FIGS. 3A-3L show versions of the safety hook assembly 130 used in a version of the system 10 (see FIG. 1), such as the remote anchoring system 10*a* (see FIG. 1), of the disclosure. The safety hook assembly 130 is configured for attachment to, and in use, attached to, the pole 84 (see FIG. 4D), such as the extension pole 84*a* (see FIG. 4D), or the telescoping pole 84*b* (see FIG. 1), to secure the anchoring member 12 (see FIG. 1), such as the strap 40 (see FIG. 1), to the anchorage structure 14 (see FIG. 1), such as the beam 60 (see FIG. 1), and to release and remove the anchoring member 12, such as the strap 40, from, the anchorage structure 14, such as the beam 60.

FIG. 3A is an illustration of an exploded top left side perspective view of an exemplary version of a safety hook assembly 130 of the disclosure, where the safety hook assembly 130 is unassembled in an unassembled position 210. FIG. 3B is an illustration of a top left side perspective view of the safety hook assembly 130 of FIG. 3A, where the safety hook assembly 130 is assembled in an assembled position 212. FIG. 3C is an illustration of a bottom left side perspective view of the safety hook assembly 130 of FIG. 3B. FIG. 3D is an illustration of a left side view of the safety hook assembly 130 of FIG. 3B, showing interior components. FIG. 3E is an illustration of a top view of the safety hook assembly 130 of FIG. 3B, showing interior components.

Figure 3H:
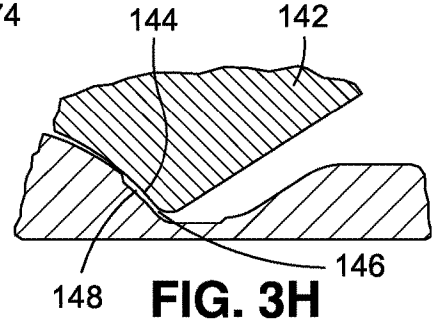
FIG. 3H is an illustration of an enlarged view of the circle portion 3H of FIG. 3G.
Figure 3G:
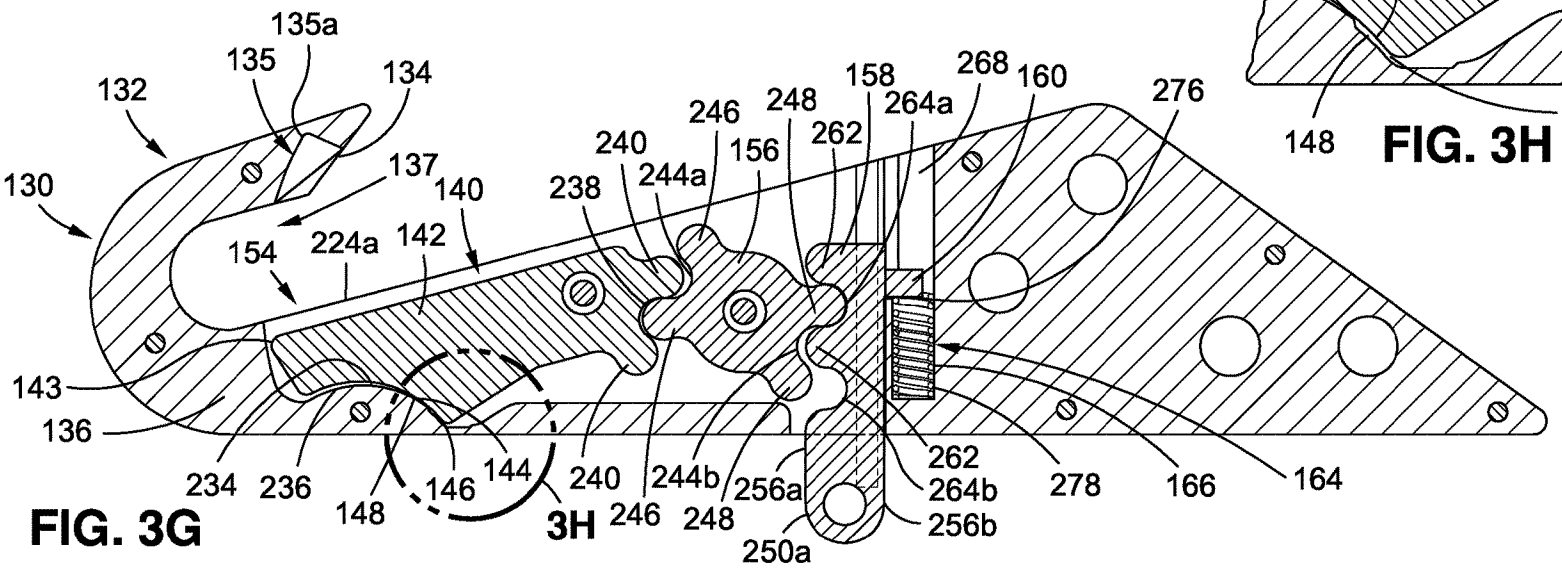
FIG. 3G is an illustration of a cross-section of the safety hook assembly of FIG. 3F, showing the safety latch in an open position.
Figure 3I:
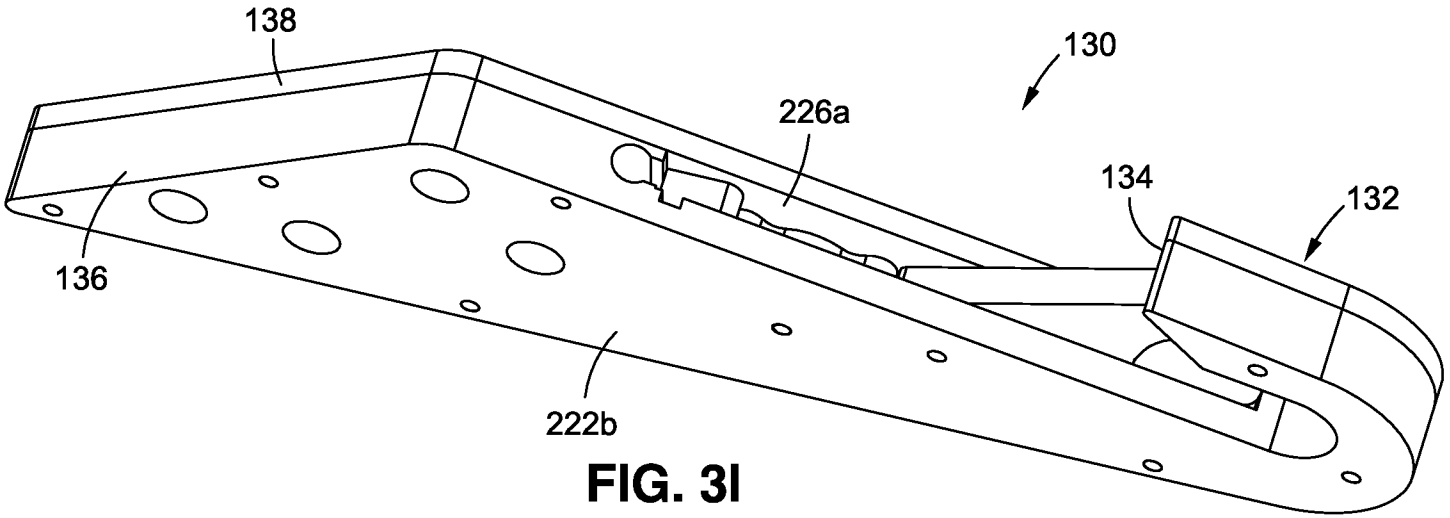
FIG. 3I is an illustration of a top right side perspective view of the safety hook assembly of FIG. 3B.
Figure 3J:
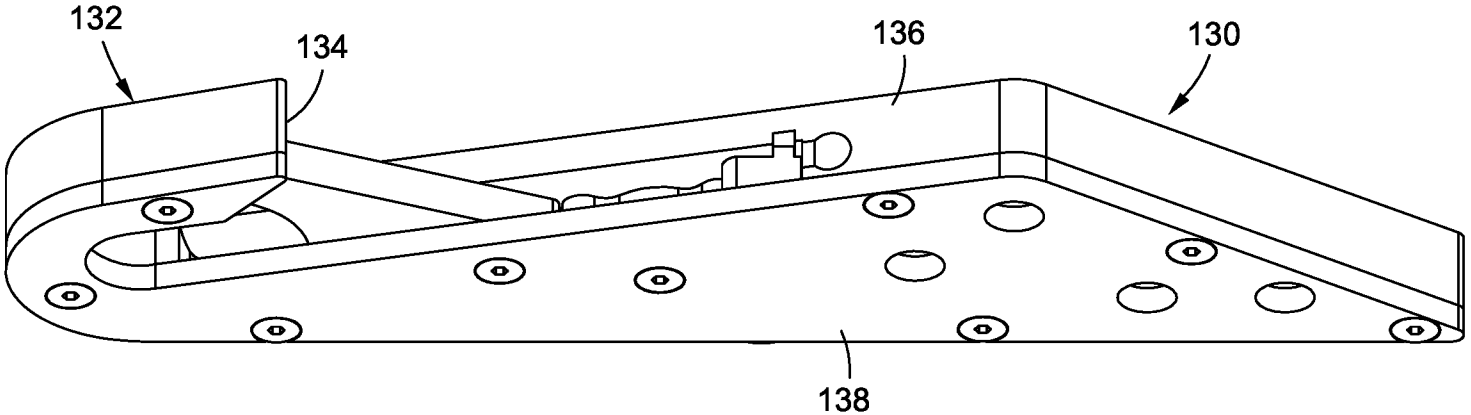
FIG. 3J is an illustration of a top left side perspective view of the safety hook assembly of FIG. 3B.
Figure 3K:
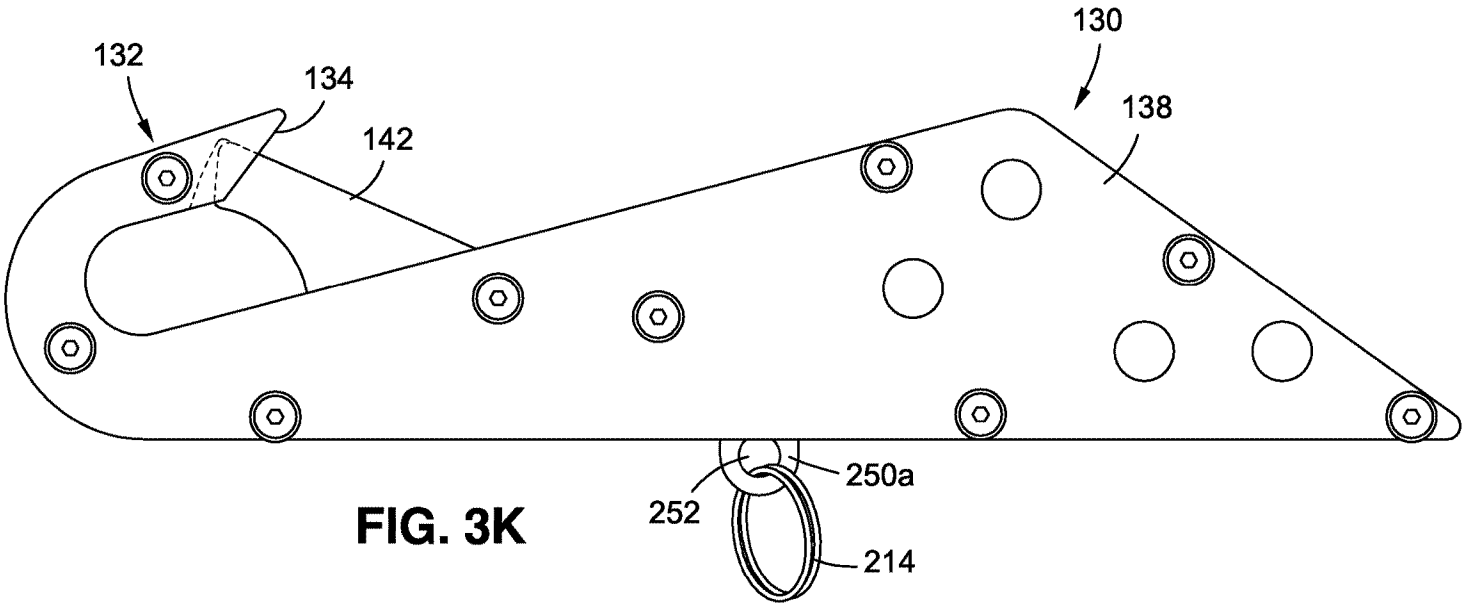
FIG. 3K is an illustration of a left side view of the safety hook assembly of FIG. 3B, showing a ring attachment attached to the safety hook assembly.
Figure 3L:
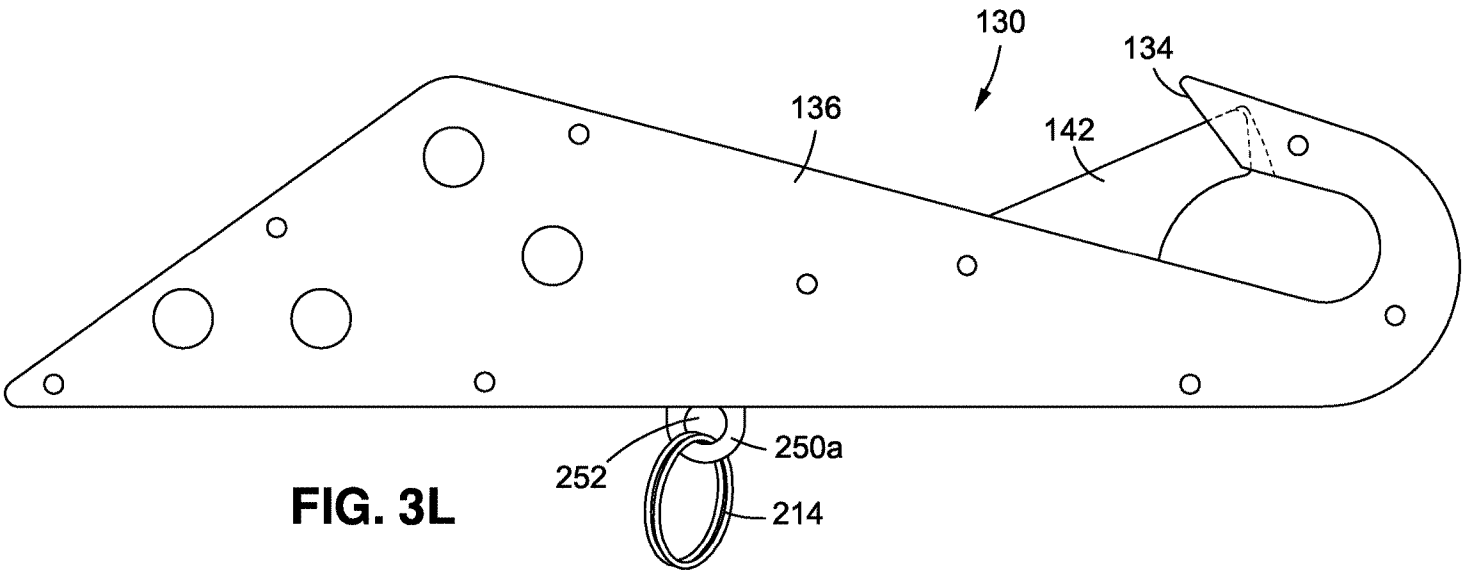
FIG. 3L is an illustration of a right side view of the safety hook assembly of FIG. 3K.

FIG. 3F is an illustration of a cross-section of the safety hook assembly 130 of FIG. 3B, taken along lines 3F-3F, showing a safety latch 142 in a closed position 152. FIG. 3G is an illustration of a cross-section of the safety hook assembly 130 of FIG. 3F, showing the safety latch 142 in an open position 154. FIG. 3H is an illustration of an enlarged view of the circle portion 3H of FIG. 3G. FIG. 3I is an illustration of a top right side perspective view of the safety hook assembly 130 of FIG. 3B. FIG. 3J is an illustration of a top left side perspective view of the safety hook assembly 130 of FIG. 3B. FIG. 3K is an illustration of a left side view of the safety hook assembly 130 of FIG. 3B, showing a ring attachment 214 attached to the safety hook assembly 130. FIG. 3L is an illustration of a right side view of the safety hook assembly 130 of FIG. 3K with the ring attachment 214 attached to the safety hook assembly 130.

As shown in FIGS. 3A-3E, 3I-3L, the safety hook assembly 130 comprises the safety hook portion 132, the hook end 134 of the safety hook portion 132, the hook body 136, and the hook cover 138. In one version, the hook cover 138 is attached to the hook body 136, via a plurality of fastener elements 216 (see FIGS. 3A, 3B, 3E), such as cap screws 216*a* (see FIGS. 3A, 3B, 3E). In other versions, the hook cover 138 may be attached to the hook body 136 with other suitable fastener elements or attachment mechanisms. The fastener elements 216, such as the cap screws 216*a*, are configured for insertion through, and are first inserted through, corresponding fastener holes 218*a* (see FIGS. 3A, 3E) formed through the hook cover 138, and are then configured for insertion through, and are then inserted through, corresponding fastener holes 218*b* (see FIGS. 3A, 3E) formed through the hook body 136.

As shown in FIG. 3A, the hook body 136 and the hook cover 138 each have a triangular shape 220 that corresponds to each other. However, the hook body and hook cover may have another suitable shape. As shown in FIG. 3A, the hook body 136 has an inner side 222*a*, an outer side 222*b* (see also FIG. 3I), a top end 224*a*, and a bottom end 224*b* (see also FIG. 3C). As further shown in FIG. 3A, the hook cover 138 has an inner side 226*a* (see also FIG. 3I), an outer side 226*b*, a top end 228*a*, and a bottom end 228*b* (see also FIG. 3C).

The hook body 136 is preferably made of a metal material, such as aluminum, brass, steel, stainless steel, a combination thereof, or another suitable metal material. The hook cover 138 is preferably made of a metal material, such as brass, aluminum, steel, stainless steel, a combination thereof, or another suitable metal material.

As shown in FIGS. 3A, 3D, 3F, and 3H, the safety hook assembly 130 further comprises a safety latch mechanism 140. The safety latch mechanism 140 comprises a safety latch 142 (see FIGS. 3A, 3D, 3F, and 3H) engageable with the hook end 134 (see FIGS. 3A, 3D, 3F, and 3H). As shown in FIG. 3A, the safety latch 142 comprises a hole 230 through which a fastener element 216, such as a cap screw 216*a*, is configured to be inserted, and is inserted. The hole 230 of the safety latch 142 is also engageable with a pivot pin 232*a* projecting from the inner side 222*a* of the hook body 136. The safety latch 142 pivots about the pivot pin 232*a* during the opening and closing of the safety latch 142 with respect to the hook end 134. The safety latch 142 has a bottom end 234 (see FIG. 3A) that is configured to be seated, and is seated, on an interior shelf portion 236 (see FIG. 3A) in the hook body 136. The safety latch 142 further has an undercut portion 144 (see FIGS. 3A, 3G, 3H) that forms a gap 146 (see FIGS. 3G, 3H) with an interior surface portion 148 (see FIGS. 3A, 3G, 3H) corresponding to the shape of the undercut portion 144 and formed along the interior shelf portion 236 in the hook body 136, to provide a stick-free actuation 150 (see FIG. 1) of the safety latch 142, when the safety latch 142 moves between the closed position 152 (see FIG. 3F) and the open position 154 (see FIG. 3G). As shown in FIGS. 3A, 3D, 3F, and 3H, the safety latch 142 further comprises a groove 238 formed between teeth 240. As shown in FIGS. 3A, 3F, and 3G, the safety latch 142 further comprises an angled tip 143 that engages a safety latch stop portion 135, such as in the form of an angled notch 135*a*, on the hook end 134 of the safety hook portion 132, when the safety latch 142 is in the closed position 152 (see FIG. 3F). In the closed position 152, the angled tip 143 of the safety latch 142 engages or abuts against the safety latch stop portion 135, such as the angled notch 135*a*, to close an opening 137 (see FIG. 3G) formed between the hook end 134 and the top end 224*a* (see FIG. 3G) of the hook body 136 (see FIG. 3G). When the safety latch 142 is in the open position 154 (see FIG. 3G), the angled tip 143 of the safety latch 142 is disengaged from the safety latch stop portion 135, such as the angled notch 135*a*, and is seated in the hook body 136, with the bottom end 234 (see FIGS. 3A, 3G) of the safety latch 142 seated against the interior shelf portion 236 (see FIGS. 3A, 3G) of the hook body 136.

The safety latch mechanism 140 further comprises an idler gear 156 (see FIGS. 3A, 3D, 3F, and 3H) engageable with the safety latch 142. As shown in FIG. 3A, the idler gear 156 comprises a hole 242 through which a fastener element 216, such as a cap screw 216*a*, is configured to be inserted, and is inserted. The hole 242 of the idler gear 156 is also engageable with a pivot pin 232*b* (see FIG. 3A) projecting from the inner side 222*a* of the hook body 136. The idler gear 156 pivots about the pivot pin 234*b* during the opening and closing of the safety latch 142 with respect to the hook end 134, when the idler gear 156 engages with the safety latch 142. As shown in FIG. 3A, the idler gear 156 has a first groove 244*a* formed between teeth 246 and a second groove 244*b* formed between teeth 248. The first groove 244*a* and teeth 246 are positioned opposite the second groove 244*b* and teeth 248. As shown in FIG. 3F, when the safety latch 142 is in the closed position 152, the teeth 246 and the first groove 244*a* of the idler gear 156 engage and intermesh with one tooth 240 of the safety latch 142. As shown in FIG. 3G, when the safety latch 142 is in the open position 154, the teeth 246 and the first groove 244*a* of the idler gear 156 engage and intermesh with the teeth 240 and the groove 238 of the safety latch 142.

The safety latch mechanism 140 further comprises a rack slider 158 (see FIGS. 3A, 3D, 3F, and 3H) engageable with the idler gear 156. The rack slider 158 comprises a body 249 (see FIG. 3A) with a lower end 250*a* (see FIGS. 3A, 3D, 3K, 3L) and an upper end 250*b* (see FIG. 3D). The lower end 250*a* has an opening 252 (see FIGS. 3A, 3D, 3K, 3L) through which the ring attachment 214 (see FIGS. 3K, 3L) is attached. The ring attachment 214 is configured for attachment to, and attaches to, the pull cord 92 (see FIG. 4C).

As shown in FIG. 3A, the body 249 of the rack slider 158 further comprises a front 254*a*, a back 254*b*, a first side 256*a*, and a second side 256*b*. The rack slider 158 has a rail 258 (see FIG. 3A) projecting from the back 254*b* of the rack slider 158. The rail 258 is configured to fit, and fits, within a channel 260 (see FIG. 3A) formed in the inner side 222*a* of the hook body 136. The shape of the rail 258 corresponds to the shape of the channel 260. The rail 258 is configured to move up and down along the channel 260, when the lower end 250*a* of the rack slider 158 is pulled downwardly with the pull cord 92. As shown in FIGS. 3F, 3G, the first side 256*a* of the rack slider 158 has teeth 262, and has a first groove 264*a* and a second groove 264*b* between the teeth 262. As shown in FIG. 3F, when the safety latch 142 is in the closed position 152, the teeth 248 and second groove 244*b* of the idler gear 156 engage and intermesh with a tooth 262 and the second groove 264*b* of the rack slider 158. As shown in FIG. 3G, when the safety latch 142 is in the open position 154, the teeth 246 and the second groove 244*b* of the idler gear 156 engage and intermesh with the teeth 262 and the first groove 264*a* of the rack slider 158.

The safety latch 142, the idler gear 156, and the rack slider 158 are each preferably made of a metal material, such as brass, aluminum, steel, stainless steel, a combination thereof, or another suitable metal material. More preferably, the safety latch 142, the idler gear 156, and the rack slider 158 are each made of brass.

As shown in FIG. 3A, the safety latch mechanism 140 further comprises a spring plunger element 160, such as in the form of a dowel 162. As further shown in FIG. 3A, the rack slider 158 has an opening 266 in the second side 256*b* configured to receive a first end 163*a* of the spring plunger element 160, such as in the form of the dowel 162. As shown in FIG. 3F, the first end 163*a* of the spring plunger element 160 is inserted into the opening 266 in the second side 256*b* of the rack slider 158.

The safety latch mechanism 140 further comprises a spring element 164 (see FIGS. 3A, 3D, 3F, 2G), such as in the form of a compression spring 166 (see FIGS. 3A, 3F, 3G), configured for housing in, and housed in, a spring channel 268 (see FIGS. 3A, 3F, 3G) formed in the inner side 222*a* of the hook body 136. As shown in FIGS. 3A, 3F, the spring element 164, such as the compression spring 166, has a top end 270*a*, a bottom end 270*b*, and a spring body 272 formed between the top end 270*a* and the bottom end 270*b*. The spring element 164, such as the compression spring 166, is preferably made of a metal material, such as stainless steel, steel, or another suitable metal material. As shown in FIG. 3F, when the safety latch 142 is in the closed position 152, the spring element 164, such as the compression spring 166, is in an uncompressed state 274. As shown in FIG. 3F, a bottom end 276 of the spring plunger element 160, such as the dowel 162, is in contact with the top end 270*a* of the spring element 164.

As shown in FIG. 3G, when the safety latch 142 is in the open position 154, the lower end 250*a* of the rack slider 158 is pulled downwardly with the pull cord 92 (see FIG. 9C), and the bottom end 276 of the spring plunger element 160 compresses against the spring element 164, such as the compression spring 166, to cause the spring element 164 to move to a compressed state 278. When the pull cord 92 is released, the spring element 164 moves back to the uncompressed state 274 (see FIG. 3F), which causes the rack slider 158 to engage with the idler gear 156, and the idler gear 156 to engage with the safety latch 142, to cause the safety latch 142 to open to the open position 154. Thus, the spring element 164 is in communication with, and indirectly engaged with, the safety latch 142. The safety latch mechanism 140 is remotely operated by the operator 20 or the user 22, via the pull cord 92 (see FIG. 1) attached to the safety latch mechanism 140, such that when the operator 20 or the user 22 pulls the pull cord 92, the safety latch 142 opens to the open position 154, and when the operator 20 or user 22 releases the pull cord 92, the safety latch 142 closes to the closed position 152. Releasing the pull cord 92 causes the spring element 164 to close the safety latch 142.

FIG. 3E shows various dimensions 280 of the safety hook assembly 130. As shown in FIG. 3E, the hook body 136 has a width 280*a*, the hook cover 138 has a width 280*b*, and the safety hook assembly 130 has a length 280*c*. The width 280*a* of the hook body 136 is preferably in a range of 0.25 (one-quarter) inch to 0.75 (three-quarter) inch, and more preferably, the width 280*a* is 0.5 (one-half) inch. However, the width 280*a* may be another suitable width. The width 280*b* of the hook cover 138 is preferably in a range of 0.10 inch to 0.30 inch, and more preferably, the width 280*b* is 0.125 inch. However, the width 280*b* may be another suitable width. The length 280*c* of the safety hook assembly 130 is preferably in a range of 5 (five) inches to 8 (eight) inches, and more preferably, the length 280*c* is 6.5 (six and one-half) inches. However, the length 280*c* may be another suitable length.

Figure 4A:
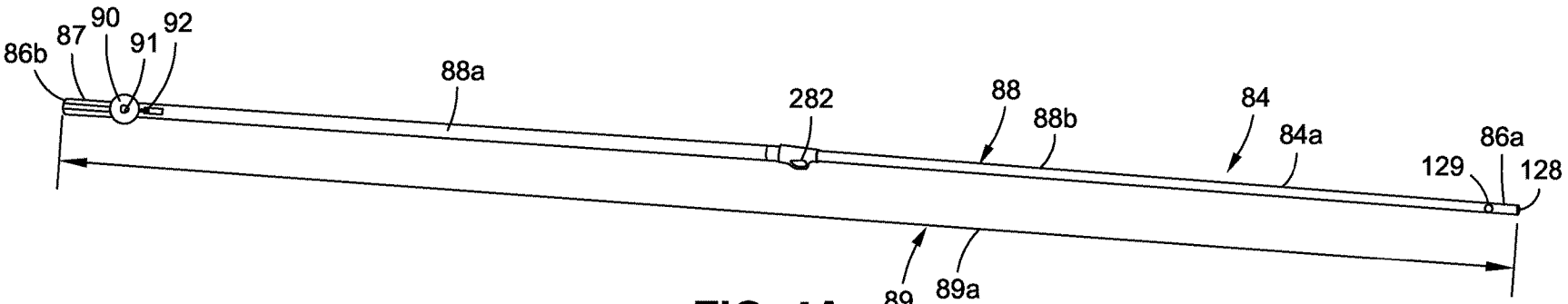
FIG. 4A is an illustration of a front view of a pole used with a version of a system of the disclosure.

Now referring to FIGS. 4A-4E, FIGS. 4A-4E show versions of the pole 84, such as the extension pole 84*a*, used in a version of the system 10 (see FIGS. 1, 4B, 4D, 4E), such as the remote anchoring system 10*a* (see FIGS. 1, 4B, 4D, 4E), of the disclosure. FIG. 4A is an illustration of a front view of the pole 84, such as the extension pole 84*a*, used with a version of the system 10 (see FIGS. 1, 4B, 4D), such as the remote anchoring system 10*a* (see FIGS. 1, 4A, 4B), of the disclosure. As shown in FIG. 4A, the pole 84, such as the extension pole 84*a*, has a pole first end 86*a*, a pole second end 86*b* with a handle grip 87, and a tubular body 88 adjustable to a length 89, such as an extended length 89*a*, that is desirable. As shown in FIG. 4A, the tubular body 88 comprises a stationary portion 88*a* and an extendable portion 88*b*. The pole 84, such as the extension pole 84*a*, has an opening 128 (see FIG. 4A) at the pole first end 86*a* configured to receive a pole attachment end 126 (see FIG. 4B) of the attachment tool assembly 124 (see FIG. 4B) or another suitable attachment. As shown in FIG. 4A, the extendable portion 88*b* has a hole 129 configured to receive a snap button 290 (see FIGS. 4B, 5A) of the attachment tool assembly 124 (see FIGS. 4B, 5A). As shown in FIG. 4A, the pole 84, such as the extension pole 84*a*, further has a length control element 282 for extending and retracting the tubular body 88 to the length 89 that is desired. As further shown in FIG. 4A, a pull cord reel 90 is attached near the pole second end 86*b*, so that an operator 20 (see FIG. 1) or user 22 (see FIG. 1) can control a pull cord 92 configured to extend from, and retract to, the pull cord reel 90. The pull cord reel 90 includes a control button 91 (see FIG. 4A) to control extension and retraction of the pull cord 92.

Figure 4B:
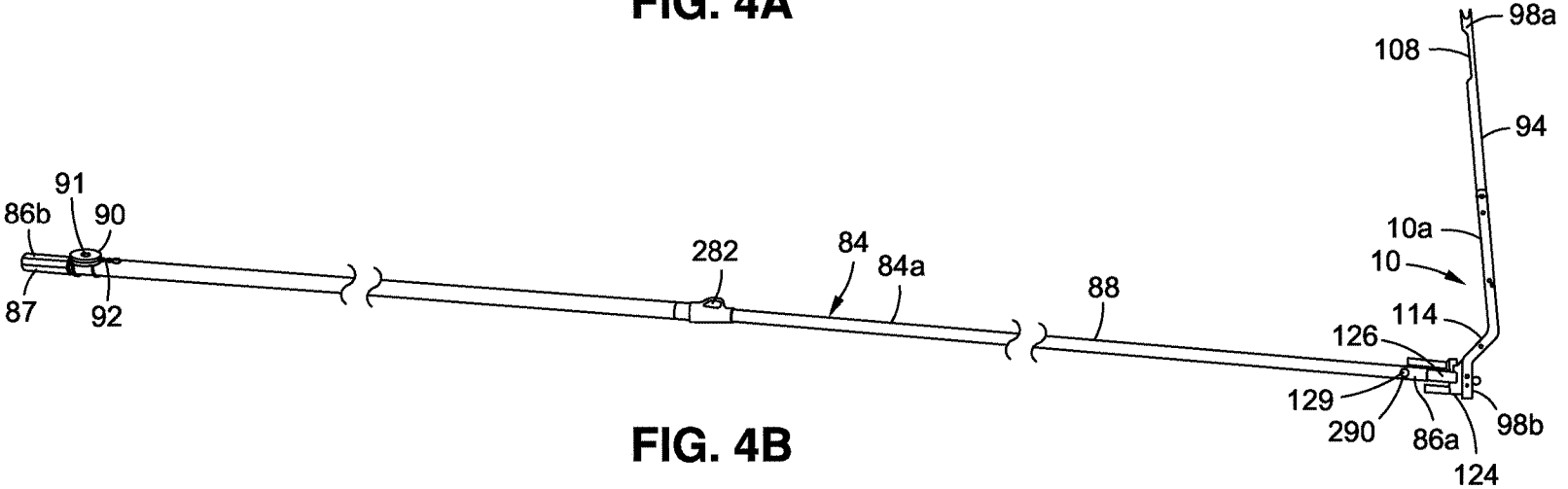
FIG. 4B is an illustration of a side view of the pole of FIG. 4A having a version of a positioning arm attached to the pole, via an attachment tool assembly.

FIG. 4B is an illustration of a side view of the pole 84, such as the extension pole 84*a*, of FIG. 4A, having a version of the positioning arm 94 attached to the pole first end 86*a*, via the attachment tool assembly 124. FIG. 4B shows the pole first end 86*a*, the pole second end 86*b* with the handle grip 87, the tubular body 88, the length control element 282, the pull cord reel 90 with the control button 91, and the pull cord 92. As shown in FIG. 4B, the second end 98*b* of the positioning arm 94 near the dogleg shaped portion 114 is attached to the attachment tool assembly 124, and the pole attachment end 126 of the attachment tool assembly 124 is attached to the pole first end 86*a*. FIG. 4B further shows the recessed area 108 near the first end 98*a* of the positioning arm 94.

Figure 4C:
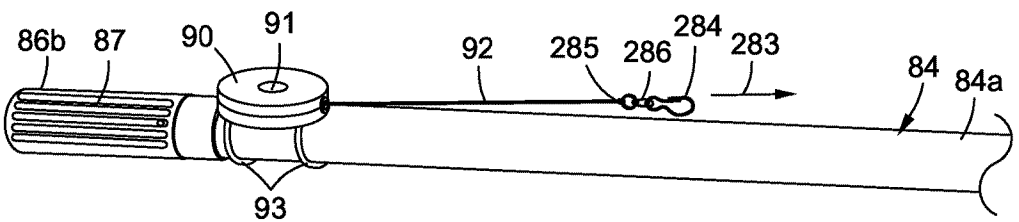
FIG. 4C is an illustration of an enlarged side perspective view of a version of a pull cord reel attached to the pole, and showing a pull cord extended from the pull cord reel.

FIG. 4C is an illustration of an enlarged side perspective view of a version of the pull cord reel 90 attached to the pole 84, such as the extension pole 84*a*, and showing the pull cord 92 partially extended from the pull cord reel 90 in a direction 283. As shown in FIG. 4C, the pull cord 92 has a clip 284 at a free end 285 of the pull cord 92. The clip 284 is attached to the free end 285 of the pull cord 92, via a clip attachment element 286 (see FIG. 4C). As further shown in FIG. 4C, the pull cord reel 90 has the control button 91 and is attached to the tubular body 88 with one or more attachment elements 93, such as zip ties, nuts and bolts, or other suitable attachment elements. FIG. 4C further shows the pole second end 86*b* with the handle grip 87.

Figure 4E:
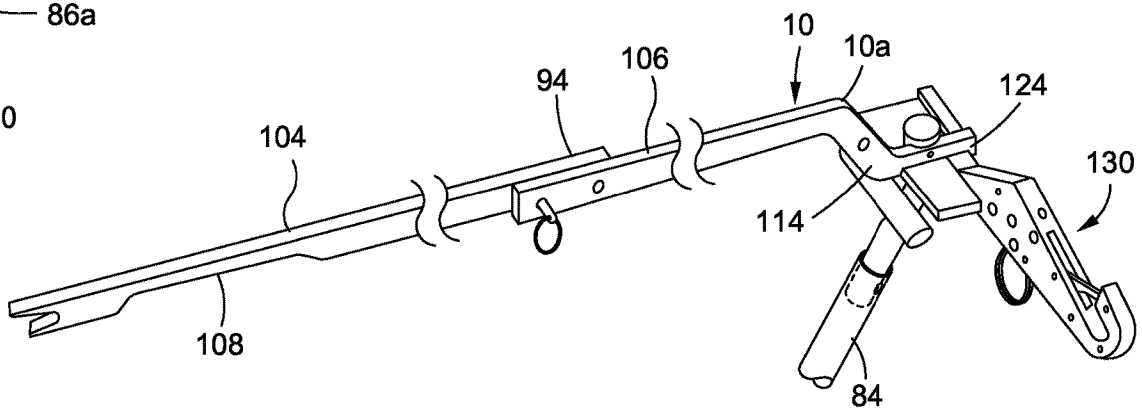
FIG. 4E is an illustration of a top perspective view of the pole of FIG. 4A having both a version of a positioning arm and a version of a safety hook assembly attached to the pole, via an attachment tool assembly.
Figure 4D:
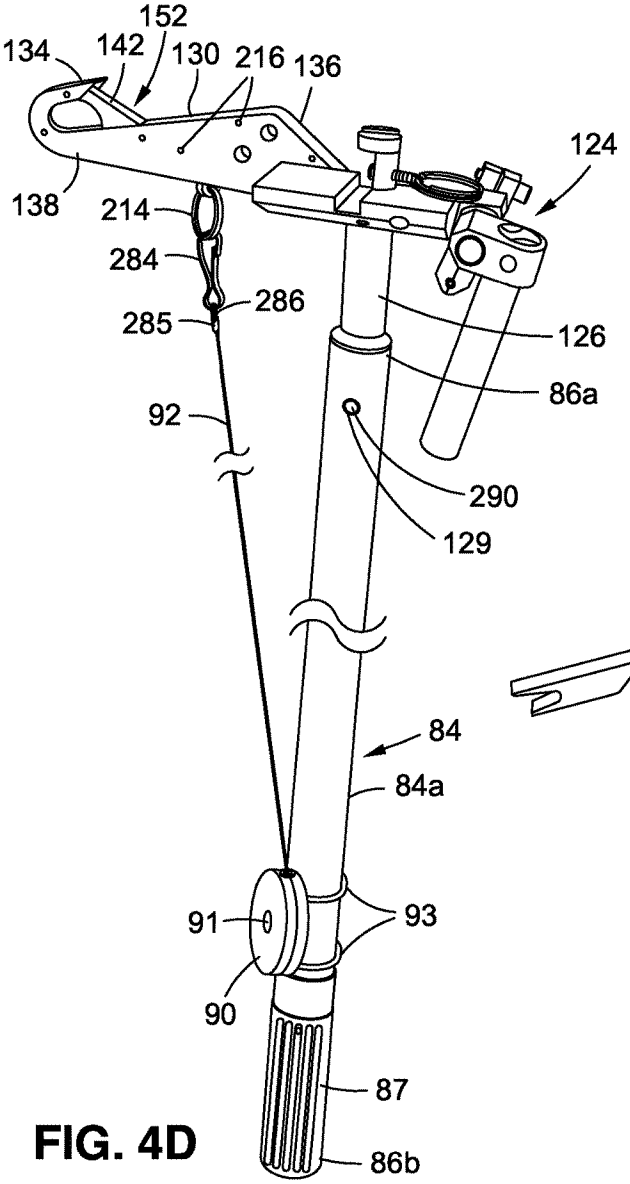
FIG. 4D is an illustration of a side perspective view of the pole of FIG. 4A having a version of a safety hook assembly attached to the pole, via an attachment tool assembly.

FIG. 4D is an illustration of a side perspective view of the pole 84, such as the extension pole 84*a*, of FIG. 4A, having a version of the safety hook assembly 130 attached to the pole first end 86*a* of the pole 84, such as the extension pole 84*a*, via the attachment tool assembly 124. FIG. 4D shows the pole first end 86*a*, the pole second end 86*b* with the handle grip 87, the tubular body 88, the pull cord reel 90 with the control button 91 and the attachment elements 93, and the pull cord 92 extended from the pull cord reel 90 to the ring attachment 214 of the safety hook assembly 130. As shown in FIG. 4D, the pull cord 92 has the clip 284 at the free end 285 of the pull cord 92. The clip 284 is attached to the free end 285 of the pull cord 92, via the clip attachment element 286 (see FIG. 4D). FIG. 4D further shows the safety latch 142 in the closed position 152 with the hook end 134. FIG. 4D further shows the hook cover 138 attached to the hook body 136 with a plurality of fastener elements 216.

FIG. 4E is an illustration of a top perspective view of the pole 84, such as the extension pole 84*a* (see FIG. 4A) of FIG. 4A, having both a version of the positioning arm 94 and a version of the safety hook assembly 130 both attached to the pole 84, via the attachment tool assembly 124. FIG. 4E shows the positioning arm 94 with the outboard portion 104 having the recessed area 108, and the inboard portion 106 having the dogleg shaped portion 114. In this version of the system 10, such as the remote anchoring system 10*a*, as shown in FIG. 4E, the positioning arm 94 is attached to one portion of the attachment tool assembly 124, and the safety hook assembly 130 is attached to another portion of the attachment tool assembly 124. In this version, the safety hook assembly 130 and the positioning arm 94 are installed on the attachment tool assembly 124 perpendicular with respect to each other, such as 90 degrees with respect to each other. The safety hook assembly 130 and the positioning arm 94 may also be attached to another suitable attachment mechanism configured for attachment to the pole 84.

Figure 5B:
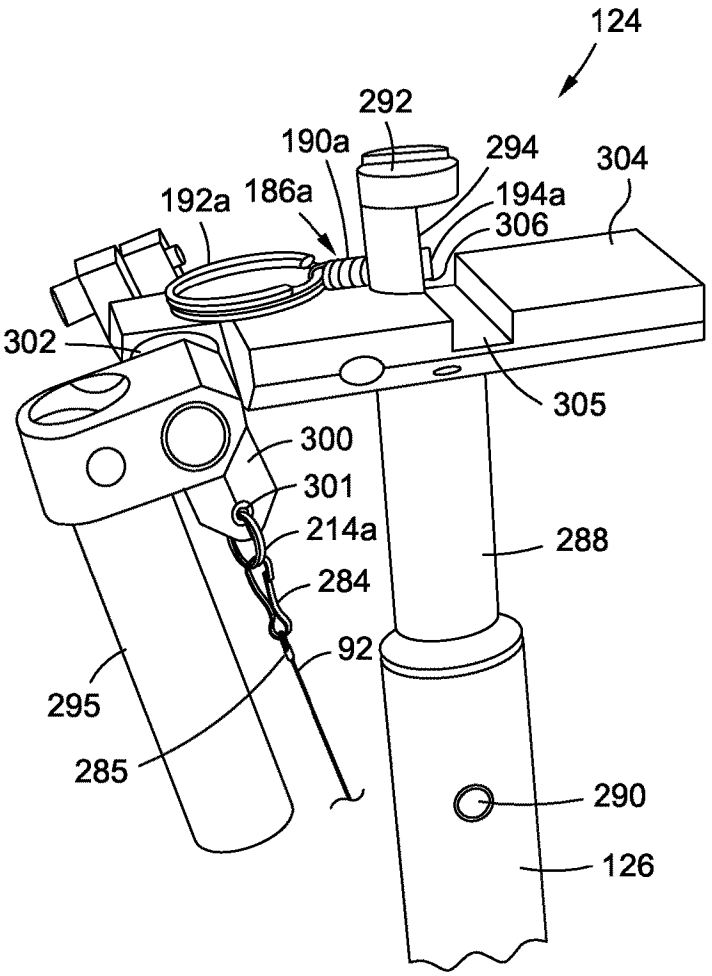
FIG. 5B (PRIOR ART)
FIG. 5B is an illustration of a right side perspective view of the attachment tool assembly of FIG. 5A.
Figure 5A:
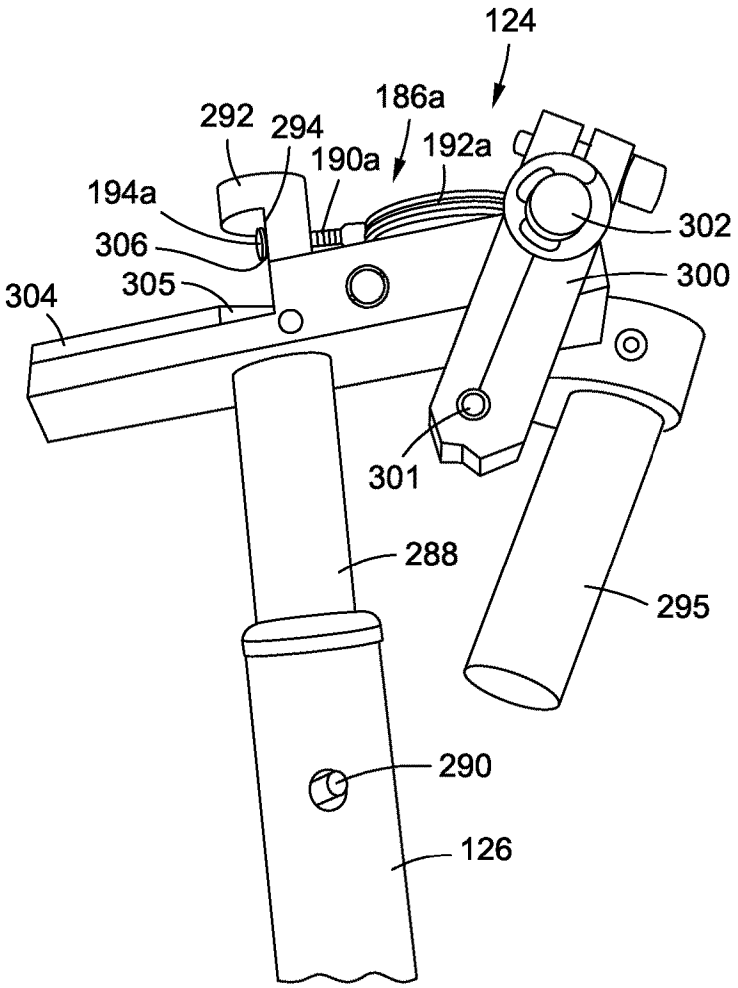
FIG. 5A (PRIOR ART)
FIG. 5A is an illustration of a left side perspective view of a known exemplary version of an attachment tool assembly that may be used with a version of a system of the disclosure.

Now referring to FIGS. 5A-5B, FIG. 5A is an illustration of a left side perspective view of a known exemplary version of an attachment tool assembly 124 that may be used with a version of the system 10 (see FIG. 1), such as the remote anchoring system 10*a* (see FIG. 1), of the disclosure, and FIG. 5B is an illustration of a right side perspective view of the attachment tool assembly 124 of FIG. 5A, and further shows the addition of the pull cord 92. As shown in FIGS. 5A-5B, the attachment tool assembly 124 comprises the pole attachment end 126 configured for attachment to the pole first end 86*a* (see FIG. 4A) of the pole 84 (see FIG. 4A), such as the extension pole 84*a* (see FIG. 4A). The pole attachment end 126 comprises a support shaft 288 with a snap button 290 on each side of the support shaft 288 and a top portion 292 of the support shaft 288 with a cut-out area 294. When the pole attachment end 126 is inserted into the opening 128 in the pole first end 86*a* of the pole 84, the snap buttons 290 snap, or lock, into the hole 129 (see FIG. 4A) on each side of the extendable portion 88*b* of the pole 84, such as the extension pole 84*a*, to securely attach the attachment tool assembly 124 to the pole first end 86*a* of the pole 84.

Figure 6C:
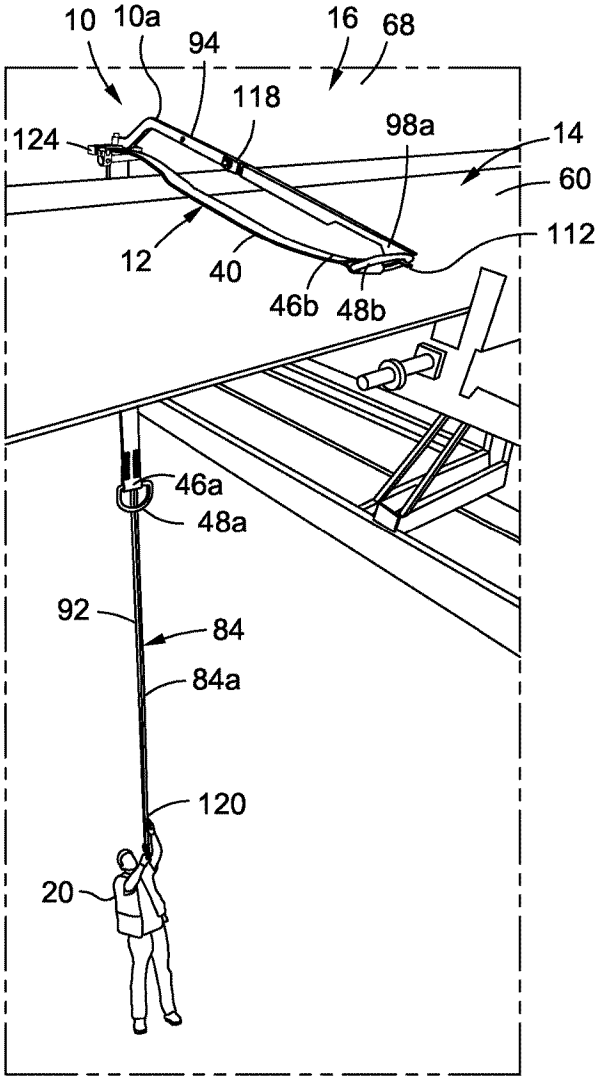
FIG. 6C is an illustration of a front perspective view of the operator using the system of FIG. 6A, to position the anchoring member over the anchorage structure, and showing the anchoring member in a secured position.
Figure 6B:
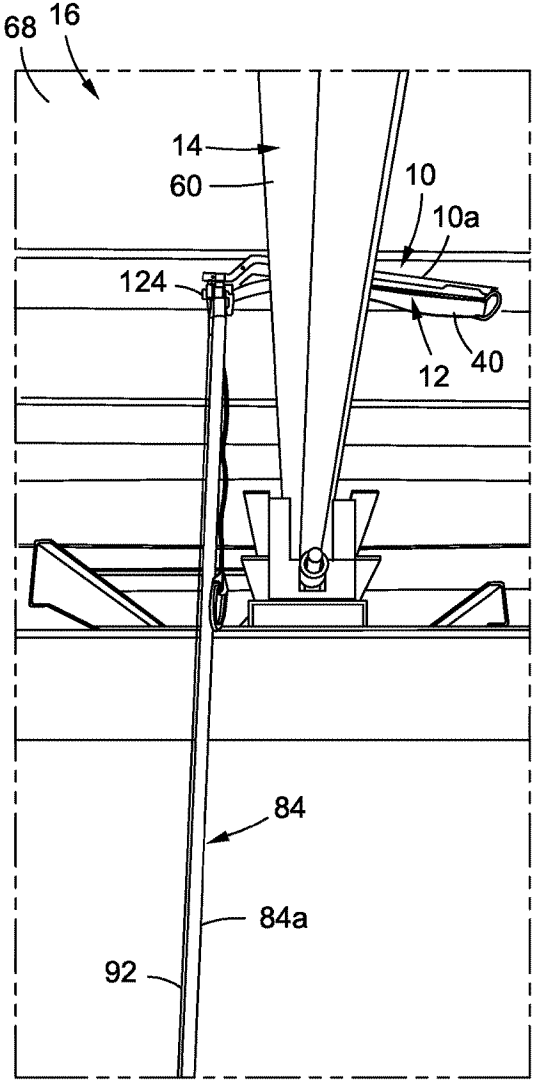
FIG. 6B is an illustration of a close-up right side perspective view of the system of FIG. 6A, used to install and position the anchoring member on the anchorage structure.
Figure 6A:
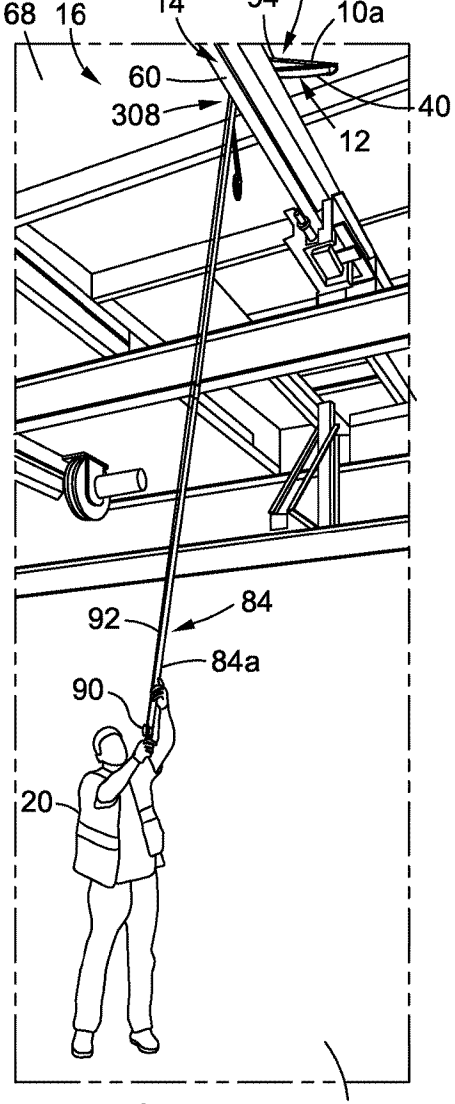
FIG. 6A is an illustration of a right side perspective view of an operator using an exemplary version of a system of the disclosure, to install and position, with a positioning arm, an anchoring member on an anchorage structure in an overhead area.
Figure 6E:
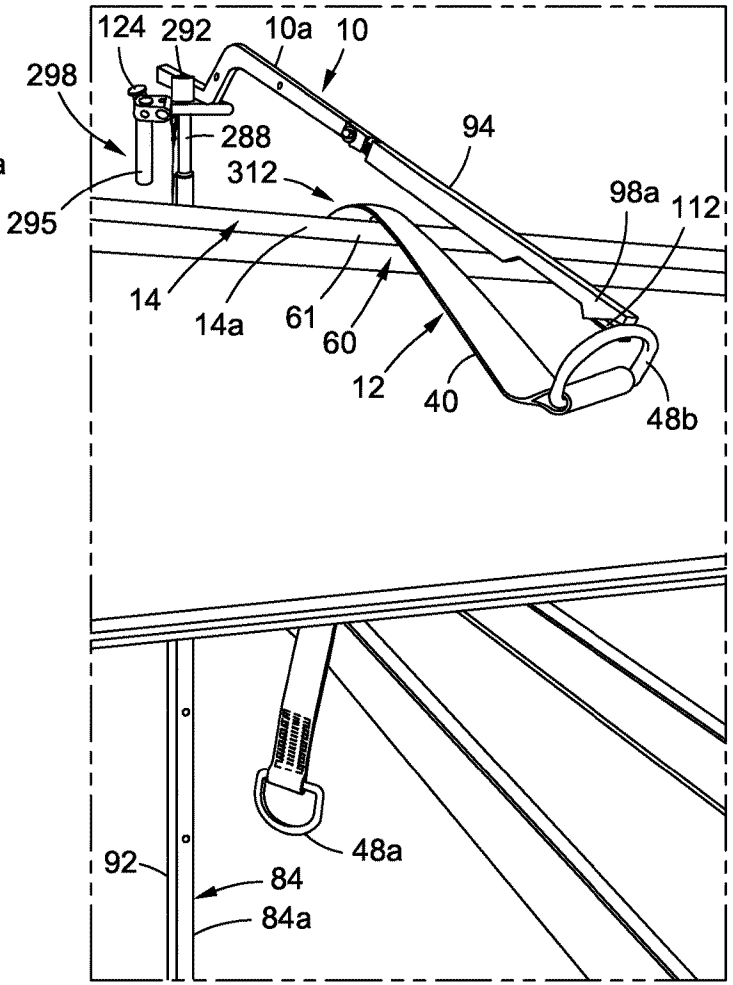
FIG. 6E is an illustration of a close-up front perspective view of the system of FIG. 6A, showing the anchoring member in a released position over the anchorage structure.
Figure 6D:
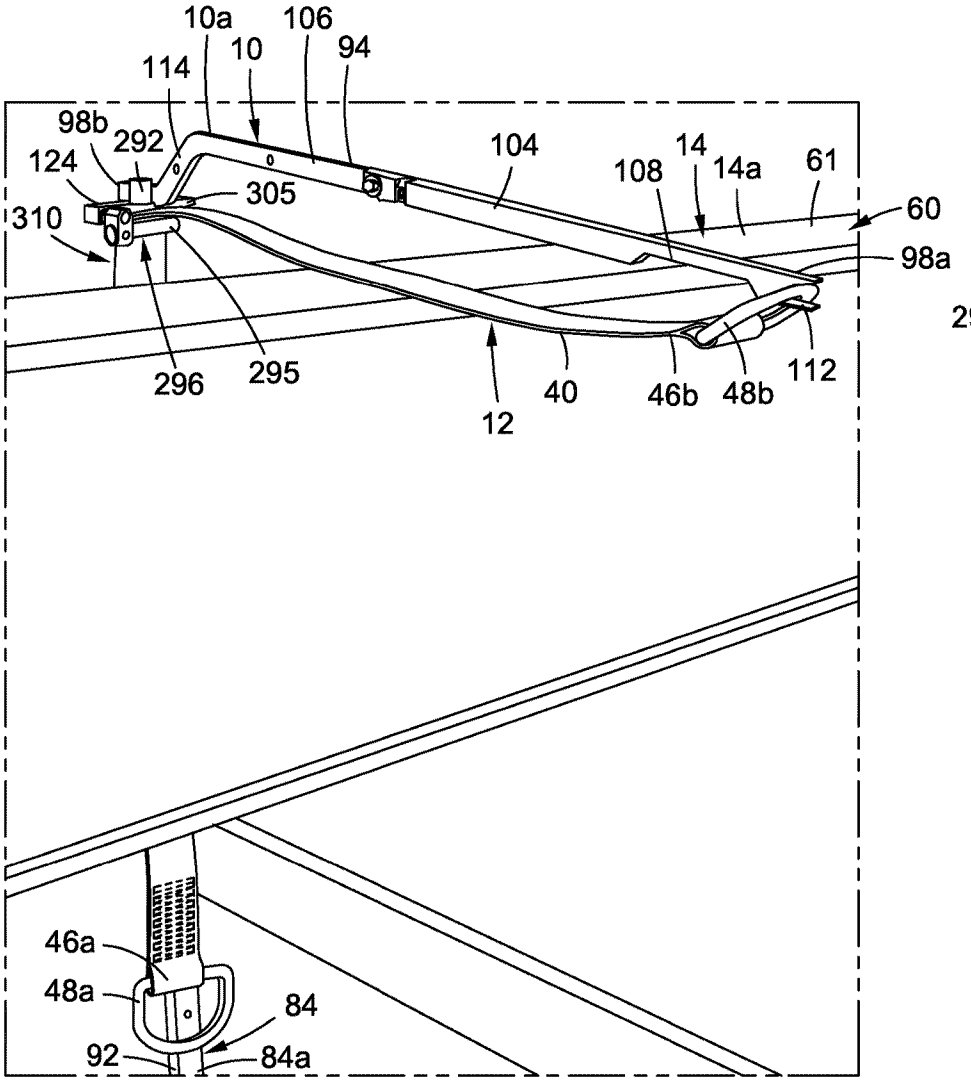
FIG. 6D is an illustration of a close-up front perspective view of the system of FIG. 6A, showing the anchoring member in a secured position and positioned over the anchorage structure.

As shown in FIGS. 5A-5B, the attachment tool assembly 124 comprises a strap rod 295 that is configured to rotate, or pivot, up and down to hold and release the anchoring member 12 (see FIGS. 6D, 6E), such as the strap 40 (see FIGS. 6D, 6E). As shown in FIGS. 5A-5B, the attachment tool assembly 124 further comprises a lever arm 300 having a pin 301. The pull cord 92 (see FIG. 5B) is extended from the pull cord reel 90 (see FIG. 4C) and the clip 284 (see FIG. 5B) at the free end 285 (see FIG. 5B) of the pull cord 92 is attached to the pin 301 of the lever arm 300, via a ring attachment 214*a* (see FIG. 5B). The lever arm 300 and the strap rod 295 are coupled to a shaft 302 so that they pivot together with rotation of the shaft 302 (see FIGS. 5A-5B). The pull cord 92 is pulled by the operator 20 (see FIG. 6C) to control the lever arm 300 and the strap rod 295.

As further shown in FIGS. 5A-5B, the attachment tool assembly 124 further comprises a platform 304 with a slot 305 configured to receive and hold the second end 98*b* (see FIG. 6D) of the positioning arm 94 (see FIG. 6D), when the positioning arm 94 is attached to the attachment tool assembly 124 (see FIG. 6D). As shown in FIGS. 5A-5B, the attachment tool assembly 124 further comprises a retractable spring plunger 186*a* with a spring plunger 190*a*, a pull ring end 192*a*, and a tip end 194*a*. The tip end 194*a* is inserted through an opening 306 in the top portion 292 of the support shaft 288, and the tip end 194*a* is configured for insertion through the through hole 188*c* (see FIG. 2G) of the inboard portion 106 (see FIG. 2G) of the positioning arm 94. When the positioning arm 94 (see FIG. 6D) is attached to the attachment tool assembly 124 (see FIG. 6D) and the pole 84 (see FIG. 6D), the second end 98*b* (see FIG. 6D) of the positioning arm 94 is inserted through, or slid into, the slot 305 (see FIG. 6D), and the through hole 188*c* (see FIG. 2G) is aligned with the opening 306 in the top portion 292 of the support shaft 288 and aligned with the tip end 194*a* of the spring plunger 190*a*. When the spring plunger 190*a* is released, the spring plunger 190*a* locks into place into the through hole 188*c* on the positioning arm 94.

Now referring to FIGS. 6A-6F, FIGS. 6A-6F show exemplary versions of a system 10, such as a remote anchoring system 10*a*, in use. FIG. 6A is an illustration of a right side perspective view of an operator 20 standing on a floor 24 and using an exemplary version of a system 10, such as the remote anchoring system 10*a*, of the disclosure, to install and position, with the positioning arm 94, the anchoring member 12, such as the strap 40, on the anchorage structure 14, such as the beam 60, in the overhead area 16, such as the ceiling 68. FIG. 6A shows the positioning arm 94 attached to the pole 84, such as the extension pole 84*a*. As shown in FIG. 6A, the pole 84, such as the extension pole 84*a*, is in a fully extended position 308. As further shown in FIG. 6A, the pull cord 92 is extending from the pull cord reel 90 along the fully extended length of the pole 84. Prior to the pole 84, such as the extension pole 84*a*, with the attached positioning arm 94, being raised, or lifted up, by the operator 20 (see FIG. 6A) to the overhead area 16, the second D-ring 48*b* of the anchoring member 12, such as the strap 40, is inserted or placed into the notched portion 112 (see FIG. 6C) at the first end 98*a* (see FIG. 6C) of the positioning arm 94, and the body of the anchoring member 12, such as the strap 40, is run along the bottom of the positioning arm 94 and down the pole 84, so that the first D-ring 48*a* (see FIG. 6C) hangs free. Prior to the pole 84, such as the extension pole 84*a*, with the attached positioning arm 94, being raised, or lifted up, by the operator 20, the strap rod 295 (see FIG. 6D) of the attachment tool assembly 124 (see FIG. 6D) is rotated up over a portion of the anchoring member 12, such as the strap 40, attached to the positioning arm 94, until the strap rod 295 locks in place to secure the anchoring member 12, such as the strap 40, against the attachment tool assembly 124 and against the pole 84.

FIG. 6B is an illustration of a close-up right side perspective view of the system 10, such as the remote anchoring system 10*a*, of FIG. 6A, used to install and position the anchoring member 12, such as the strap 40, on the anchorage structure 14, such as the beam 60, in the overhead area 16, such as the ceiling 68. FIG. 6B shows the positioning arm 94 attached to the pole 84, such as the extension pole 84*a*, via the attachment tool assembly 124, and FIG. 6B shows the pull cord 92.

FIG. 6C is an illustration of a front perspective view of the operator 20 using the system 10, such as the remote anchoring system 10*a*, of FIG. 6A, to position the anchoring member 12, such as the strap 40, over and on the anchorage structure 14, such as the beam 60, in the overhead area 16, such as the ceiling 68. FIG. 6C shows the positioning arm 94 attached to the pole 84, such as the extension pole 84*a*, via the attachment tool assembly 124, and FIG. 6C shows the pull cord 92. FIG. 6C shows the notched portion 112 at the first end 98*a* of the positioning arm 94 retaining the second D-ring 48*b*, or small D-ring, at the strap second end 46*b* of the strap 40, and shows the first D-ring 48*a*, or large D-ring, attached at the strap first end 46*a* of the strap 40 and hanging along the pole 84. As shown in FIG. 6C, with the disclosed system 10, such as the remote anchoring system 10*a*, the center of balance 118 of the positioning arm 94 is closer to the operator grip area 120 on the pole 84, thus requiring less effort by the operator 20, and affording improved ergonomic control 122 (see FIG. 1) of the pole 84 and the positioning arm 94.

FIG. 6D is an illustration of a close-up front perspective view of the system 10, such as the remote anchoring system 10*a*, of FIG. 6A, showing the anchoring member 12, such as the strap 40, in a secured position 310 and positioned over a top portion 14*a* of the anchorage structure 14, for example, a top portion 61 of the beam 60. FIG. 6D shows the anchoring member 12, such as the strap 40, being held with the strap rod 295 of the attachment tool assembly 124, and the strap rod 295 is in the closed position 296. As shown in FIG. 6D, when the strap rod 295 is rotated up and into the closed position 296, or locked position, the strap rod 295 holds the anchoring member 12, such as the strap 40, in place along the positioning arm 94 and the pole 84. FIG. 6D further shows the positioning arm 94 attached to the pole 84, such as the extension pole 84*a*, via the attachment tool assembly 124, and FIG. 6D shows the pull cord 92. In particular, FIG. 6D shows the second end 98*b* of the positioning arm 94 inserted through the slot 305 and through the top portion 292 (see also FIG. 6E) of the support shaft 288 (see FIG. 6E). FIG. 6D further shows the first end 98*a*, the outboard portion 104 with the recessed area 108, and the inboard portion 106 with the dogleg shaped portion 114 of the positioning arm 94. FIG. 6D shows the notched portion 112 at the first end 98*a* of the positioning arm 94 retaining the second D-ring 48*b*, or small D-ring, at the strap second end 46*b* of the strap 40, and shows the first D-ring 48*a*, or large D-ring, attached at the strap first end 46*a* of the strap 40 and hanging along the pole 84.

FIG. 6E is an illustration of a close-up front perspective view of the system 10, such as the remote anchoring system 10*a*, of FIG. 6A, showing the anchoring member 12, such as the strap 40, in a released position 312 from the strap rod 295 and draped over the top portion 14*a* of the anchorage structure 14, for example, the top portion 61 of the beam 60. FIG. 6E shows the anchoring member 12, such as the strap 40, released from the strap rod 295 of the attachment tool assembly 124, and the strap rod 295 is in the open position 298. When the pull cord 92 (see FIG. 6E) is pulled by the operator 20 (see FIG. 6C), the lever arm 300 (see FIG. 5A) actuates the strap rod 295 (see FIG. 6E) to move from the closed position 296 (see FIG. 6D), or locked position, to the open position 298 (see FIG. 6E), or unlocked position, to release the strap rod 295 and to release the anchoring member 12, such as the strap 40, to allow the anchoring member 12, such as the strap 40, to drape over the anchorage structure 14. FIG. 6E further shows the positioning arm 94 attached to the pole 84, such as the extension pole 84*a*, via the attachment tool assembly 124, and FIG. 6E shows the pull cord 92. FIG. 6E further shows the notched portion 112 at the first end 98*a* of the positioning arm 94 retaining the second D-ring 48*b*, or small D-ring, and shows the first D-ring 48*a*, or large D-ring, hanging free over the anchorage structure 14, such as the beam 60. After the strap rod 295 is opened to release one side of the anchoring member 12, such as the strap 40, against the anchorage structure 14, such as the beam 60, the operator 20 may lift the pole 84 to remotely move or operate the first end 98*a* of the positioning arm 94, to release the second D-ring 48*b* from the notched portion 112, so that the side of the anchoring member 12, such as the strap 40, with the second D-ring 48*b* also drapes over the anchorage structure 14, such as the beam 60.

Figure 6F:
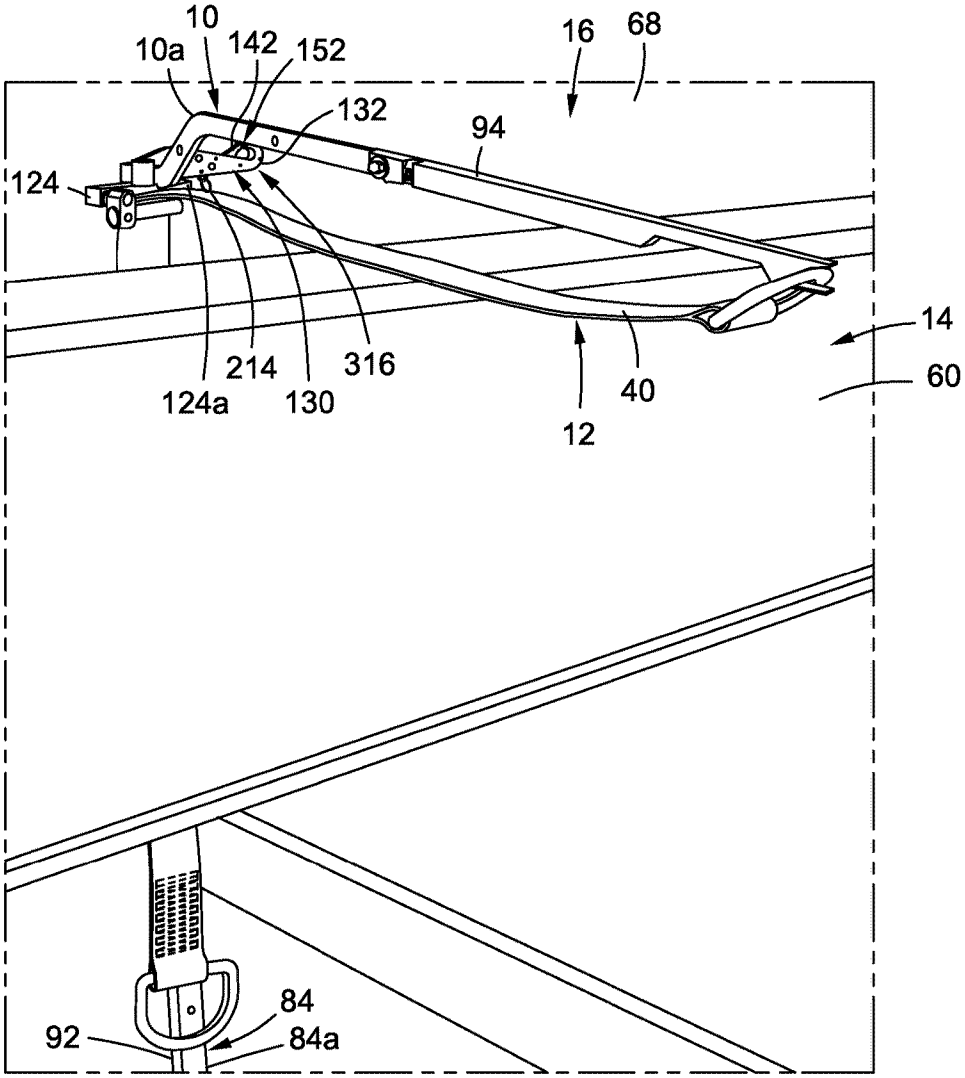
FIG. 6F is an illustration of a close-up front perspective view of another version of the system of FIG. 6A, showing a safety hook assembly also attached to the pole during installation and positioning of an anchoring member on an anchorage structure.

FIG. 6F is an illustration of a close-up front perspective view of another version of the system 10, such as the remote anchoring system 10*a*, of FIG. 6A, showing the addition of the safety hook assembly 130 also attached to the pole 84, such as the extension pole 84*a*, via the attachment tool assembly 124, during installation 50 (see FIG. 1) and positioning 52 (see FIG. 1) of the anchoring member 12, such as the strap 40, on the anchorage structure 14, such as the beam 60, in the overhead area 16, such as the ceiling 68. In this version, both the safety hook assembly 130 and the positioning arm 94 are attached, via the attachment tool assembly 124, to the pole 84. In other versions, only the positioning arm 94 is attached to the pole 84, via the attachment tool assembly 124, or only the safety hook assembly 130 is attached to the pole 84, via the attachment tool assembly, and each of the positioning arm 94 or safety hook assembly 130 is installed or removed, as needed. As shown in FIG. 6F, in one version, the safety hook assembly 130 is attached to a portion 124*a* of the attachment tool assembly 124. As further shown in FIG. 6F, the safety hook assembly 130 is in a closed position 316, and the safety latch 142 is in the closed position 152. FIG. 6F further shows the safety hook portion 132 of the safety hook assembly 130. While the positioning arm 94 is in use, the safety hook assembly 130 is preferably not in use. The safety hook assembly 130 is used when the anchoring member 12 is to be secured to the anchorage structure 14, or the anchoring member 12 is to be removed from the anchorage structure 14.

Figure 7B:
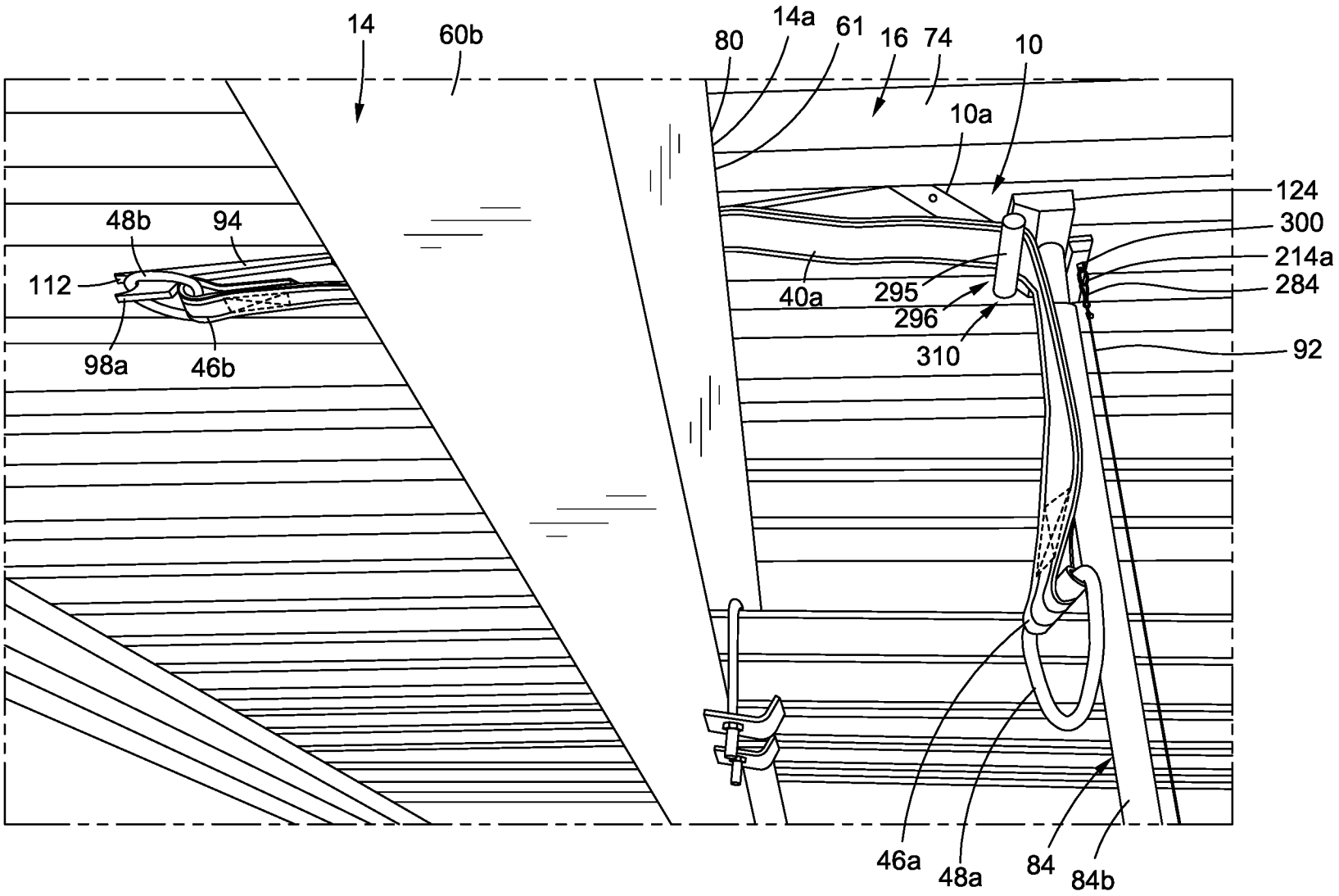
FIG. 7B is an illustration of a close-up left side perspective view of the system of FIG. 7A, showing the positioning arm clearing the limited clearance area, to install and position the strap over the beam.

Now referring to FIGS. 7A-7B, FIG. 7A is an illustration of a close-up left side perspective view of a version of a system 10, such as the remote anchoring system 10*a*, of the disclosure, used to install and position, with a positioning arm 94, a beam strap 40*a* on a limited clearance overhead beam 60*b* in an overhead area 16, such as a roof panel 74, for example, a corrugated roof panel, having a limited clearance area 80, and FIG. 7B is an illustration of a close-up left side perspective view of the system 10, such as the remote anchoring system 10*a*, of FIG. 7A, showing the positioning arm 94 clearing the limited clearance area 80, to install and position the beam strap 40*a* over the top portion 14*a* of the anchorage structure 14, such as over the top portion 61 of the limited clearance overhead beam 60*b*. As shown in FIG. 7B, the limited clearance area 80 is between the top portion 14*a* of the anchorage structure 14, such as over the top portion 61 of the limited clearance overhead beam 60*b*, and the overhead area 16, such as the roof panel 74, where there is a narrow width 82 (se FIG. 1).

FIGS. 7A-7B show the beam strap 40*a* in the secured position 310 and being held with the strap rod 295 of the attachment tool assembly 124, and the strap rod 295 is in the closed position 296. As shown in FIGS. 7A-7B, the strap rod 295 holds beam strap 40*a*, in place along the length of the positioning arm 94, and the along part of the pole 84, such as the telescoping pole 84*b*. FIG. 7A shows the first end 98*a*, the outboard portion 104 with the recessed area 108, the second end 98*b*, and the inboard portion 106 with the dogleg shaped portion 114, of the positioning arm 94. FIGS. 7A-7B further show the notched portion 112 at the first end 98*a* of the positioning arm 94 retaining the second D-ring 48*b*, or small D-ring, at the strap second end 46*b* of the beam strap 40*a*, and shows the first D-ring 48*a*, or large D-ring, attached at the strap first end 46*a* of the beam strap 40*a* and hanging free along the pole 84. Prior to the pole 84, such as the extension pole 84*a*, with the attached positioning arm 94, being raised, or lifted up, by the operator 20 (see FIG. 6A) to the overhead area 16, the second D-ring 48*b* of the anchoring member 12, such as the beam strap 40*a*, is inserted or placed into the notched portion 112 (see FIG. 7A) at the first end 98*a* (see FIG. 7A) of the positioning arm 94, and the body of the anchoring member 12, such as the strap 40, is run along the bottom of the positioning arm 94 and down the pole 84, so that the first D-ring 48*a* (see FIG. 7A) hangs free. Prior to the pole 84, such as the extension pole 84*a*, with the attached positioning arm 94, being raised, or lifted up, by the operator 20, the strap rod 295 (see FIG. 7A) of the attachment tool assembly 124 (see FIG. 7A) is rotated up over a portion of the anchoring member 12, such as the beam strap 40*a*, attached to the positioning arm 94, until the strap rod 295 locks in place to secure the anchoring member 12, such as the beam strap 40*a*, against the attachment tool assembly 124 and against the pole 84. FIGS. 7A-7B further show the clip 284 of the pull cord 92 attached to the lever arm 300, via the ring attachment 214*a*. The pull cord 92 is pulled by the operator 20 (see FIG. 6C) to control the lever arm 300 and the strap rod 295.

Now referring to FIGS. 8A-8G, FIGS. 8A-8G show exemplary versions of a system 10, such as a remote anchoring system 10*a*, in use to secure and remove, with the safety hook assembly 130, an anchoring member 12, such as a fall protection strap 40*b*, on an anchorage structure 14, such as an overhead beam 60*a*, in an overhead area 16, such as a ceiling interface 70. FIGS. 8A-8D show the fall protection strap 40*b* being secured to the overhead beam 60*a*. FIGS. 8E-8G show the fall protection strap 40*b* being removed from the overhead beam 60*a*.

FIG. 8A is an illustration of a right side perspective view of an operator 20 standing on a ground area 26, and using an exemplary version of the system 10, such as the remote anchoring system 10*a*, of the disclosure, to secure, with the safety hook assembly 130, the anchoring member 12, such as the fall protection strap 40*b*, on the anchorage structure 14, such as the overhead beam 60*a*, in the overhead area 16, such as the ceiling interface 70. FIG. 8A shows the operator 20 gripping the pole 84, such as the extension pole 84*a*, and controlling the pull cord 92 extended from the pull cord reel 90 to the safety hook assembly 130. The operator 20 is using the system 10 to perform installation 50 (see FIG. 1), including securement 54 (see FIG. 1), of the fall protection strap 40*b* to the overhead beam 60*a*. The fall protection strap 40*b* has D-rings 48, including the first D-ring 48*a*, or large D-ring, and the second D-ring 48*b*, or small D-ring.

FIG. 8B is an illustration of a close-up right side perspective view of the system 10, such as the remote anchoring system 10*a*, of FIG. 8A, showing the safety hook assembly 130 in an open position 314, and the safety hook portion 132 with the hook end 134 inserted through the D-ring 48, such as the first D-ring 48*a*, or large D-ring, of the anchoring member 12, such as the fall protection strap 40*b*. Prior to insertion of the hook end 134 through the first D-ring 48*a*, the operator 20 pulls the pull cord 92 to manually open the safety latch 142 (see FIG. 8E), so that the safety latch 142 is in the open position 154 (see FIG. 3G). FIG. 8B shows the safety hook assembly 130 attached to the pole 84, such as the extension pole 84*a*, via the attachment tool assembly 124. FIG. 8B further shows the clip 284 of the pull cord 92 attached to the safety hook assembly 130, via the ring attachment 214.

FIG. 8C is an illustration of a close-up right side perspective view of the system 10, such as the remote anchoring system 10*a*, of FIG. 8A, showing the hook end 134 of the safety hook assembly 130 capturing the second D-ring 48*b*, or small D-ring, of the anchoring member 12, such as the fall protection strap 40*b*. FIG. 8C shows the first D-ring 48*a*, or large D-ring, looped through the safety hook assembly 130, and shows the fall protection strap 40*b* positioned against the anchorage structure 14, such as the overhead beam 60*a*. FIG. 8C shows the safety hook assembly 130 attached to the pole 84, such as the extension pole 84*a*, via the attachment tool assembly 124. FIG. 8B further shows the clip 284 of the pull cord 92 attached to the safety hook assembly 130, via the ring attachment 214.

FIG. 8D is an illustration of a close-up top right side perspective view of the system 10, such as the remote anchoring system 10*a*, of FIG. 8A, showing the safety hook assembly 130 in the open position 314 and the hook end 134 of the safety hook assembly 130 pulling the second D-ring 48*b*, or small D-ring, through the first D-ring 48*a*, or large D-ring, until the anchoring member 12, such as the fall protection strap 40*b*, is tight against, and around, the anchorage structure 14, such as the overhead beam 60*a*, in order to secure, set, and install the anchoring member 12, such as the fall protection strap 40*b*, on the overhead beam 60*a*. FIG. 8D shows the safety hook assembly 130 attached to the pole 84, such as the extension pole 84*a*, via the attachment tool assembly 124. In particular, as shown in FIG. 8D, a portion 136*a* of the hook body 136 of the safety hook assembly 130 is attached to a portion 124*a* of the attachment tool assembly 124. FIG. 8D further shows the clip 284 of the pull cord 92 attached to the safety hook assembly 130, via the ring attachment 214.

Once the anchoring member 12, such as the fall protection strap 40*b*, is secured to the anchorage structure 14, such as the overhead beam 60*a*, fall protection equipment, such as harnesses, lanyards, or other fall protection equipment, may be attached to the anchoring member 12, such as the fall protection strap 40*b*, and used. After the anchoring member 12, such as the fall protection strap 40*b*, is used, the anchoring member 12, such as the fall protection strap 40*b*, may be removed from the anchorage structure 14, such as the overhead beam 60*a*.

FIGS. 8E-8G show the fall protection strap 40*b* being removed from the overhead beam 60*a*. FIG. 8E is an illustration of a close-up right side perspective view of the system 10, such as the remote anchoring system 10*a*, of FIG. 8A, showing the hook end 134 of the safety hook assembly 130 capturing the first D-ring 48*a*, or large D-ring, of the anchoring member 12, such as the fall protection strap 40*b*, to remove the anchoring member 12, such as the fall protection strap 40*b*, from the anchorage structure 14 (see FIG. 8F), such as the overhead beam 60*a* (see FIG. 8F). As shown in FIG. 8E, the safety hook assembly 130 is in the closed position 316, and the safety latch 142 is in the closed position 152, to lock the safety hook portion 132 around the first D-ring 48*a*, prior to removal from the overhead beam 60*a*. Prior to capturing the first D-ring 48*a* with the hook end 134 of the safety hook assembly 130, the operator 20 (see FIG. 8A) releases the pull cord 92 (see FIGS. 8D, 8E) to close the safety latch 142 (see FIG. 8E), and to hold the first D-ring 48*a* securely.

FIG. 8F is an illustration of a front perspective view of the operator 20 standing on the ground area 26, and using the system 10, such as the remote anchoring system 10*a*, of FIG. 8A, to pull the anchoring member 12, such as the fall protection strap 40*b*, that is secured to the safety hook assembly 130, from the anchorage structure 14, such as the overhead beam 60*a*, with the safety hook assembly 130 in the closed position 316 (see FIG. 8E), and the safety latch 142 in the closed position 152 (see FIG. 8E). As shown in FIG. 8F, the operator 20 grips the pole 84, such as the extension pole 84*a*, and moves the pole 84 to pull the fall protection strap 40*b* over a top portion 61 of the overhead beam 60*a*.

FIG. 8G is an illustration of a front perspective view of the operator 20 using the system 10, such as the remote anchoring system 10*a*, of FIG. 8A, to securely remove the anchoring member 12, such as the fall protection strap 40*b*, off of the anchorage structure 14, such as the overhead beam 60*a*, with the safety hook assembly 130 still in the closed position 316 (see FIG. 8E), and the safety latch 142 still in the closed position 152 (see FIG. 8E), to secure the first D-ring 48*a* at the strap first end 46*a*. As shown in FIG. 8G, the operator 20 grips the pole 84, such as the extension pole 84*a*, and moves the pole 84 to pull the fall protection strap 40*b* completely off of the overhead beam 60*a*, so that the strap second end 46*b* with the second D-ring 48*b* hangs free.

Figure 9A:
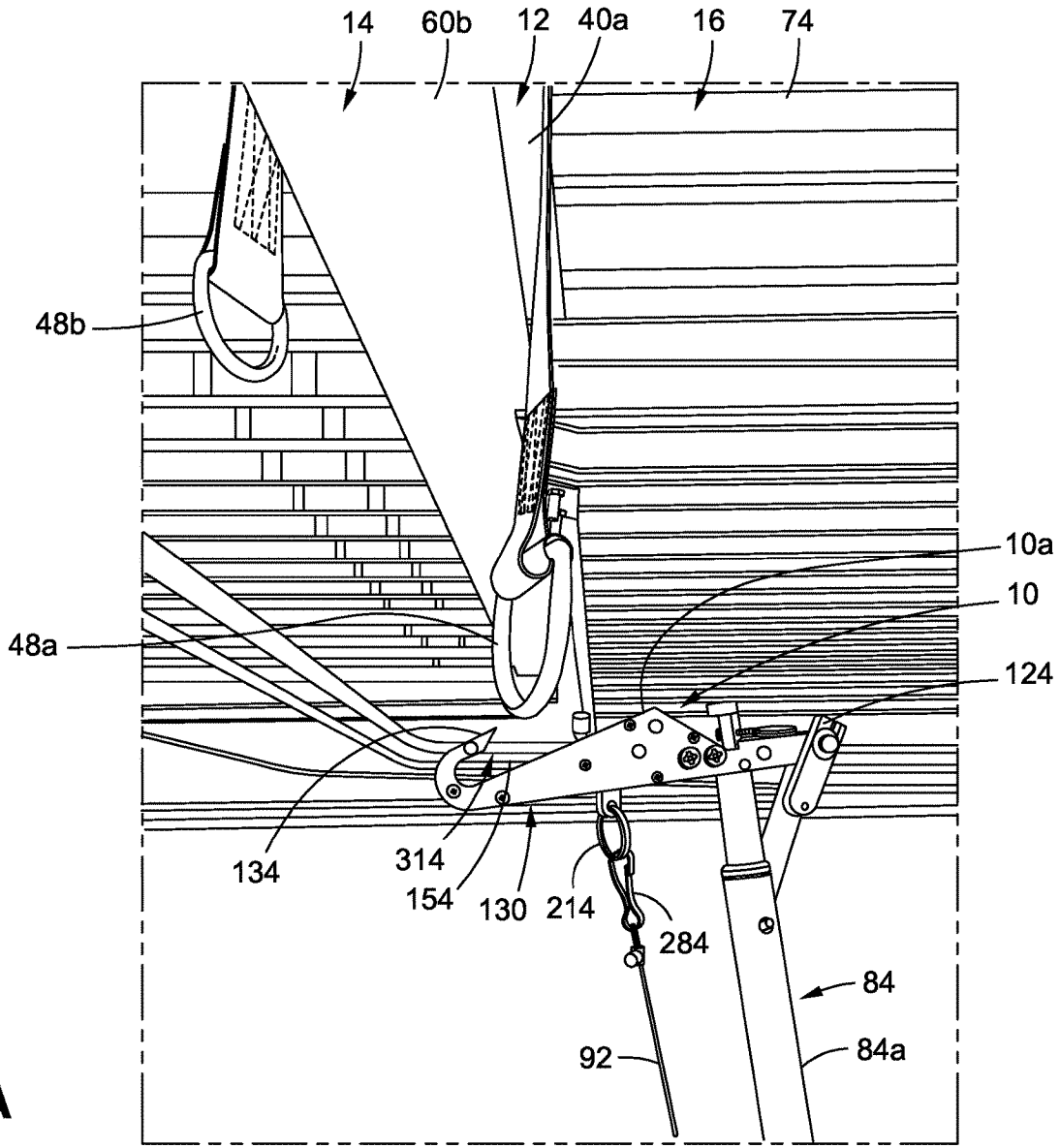
FIG. 9A is an illustration of a close-up left side perspective view of a version of a system of the disclosure, used to secure, with a safety hook assembly, a strap on a beam in an overhead area having a limited clearance area.
Figure 9B:
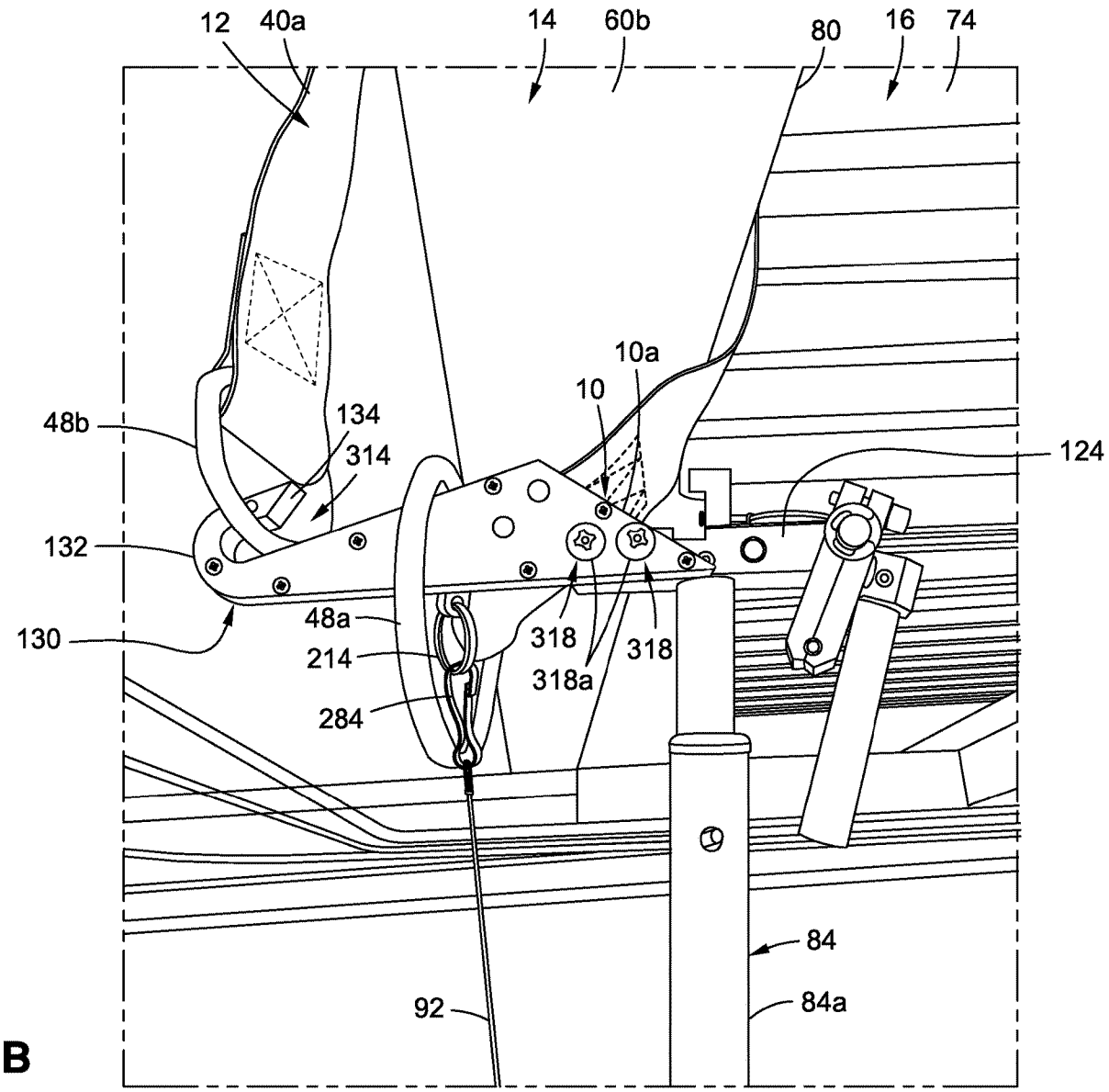
FIG. 9B is an illustration of a close-up left side perspective view of the system of FIG. 9A, showing a hook end of the safety hook assembly inserted through a first D-ring of the strap and capturing a second D-ring of the strap to pull through the first D-ring, to secure and install the strap around the beam.
Figure 9C:
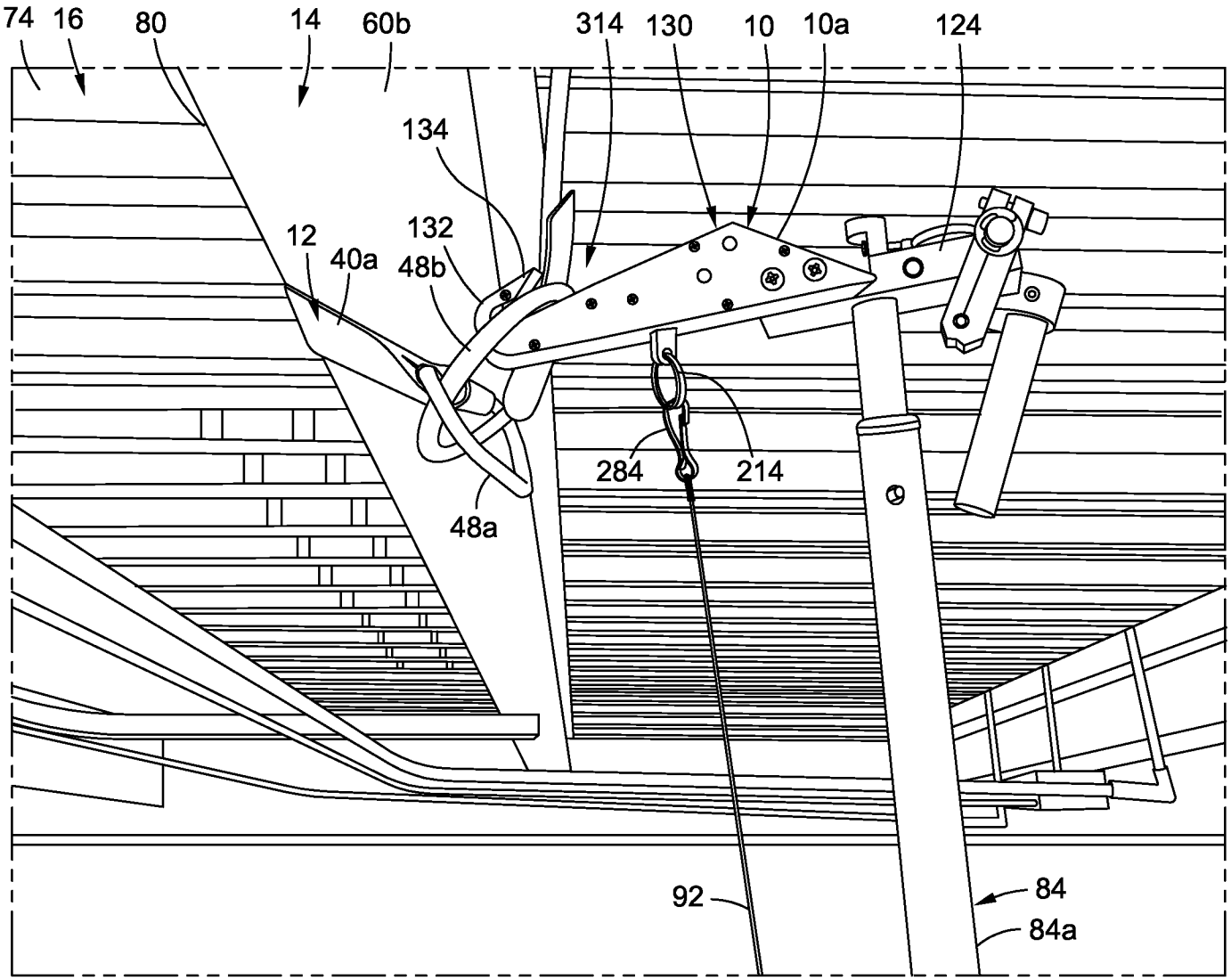
FIG. 9C is an illustration of a close-up left side perspective view of the system of FIG. 9A, showing the hook end of the safety hook assembly capturing the first D-ring of the strap, after the strap is used, to remove the strap from the beam.
Figure 9D:
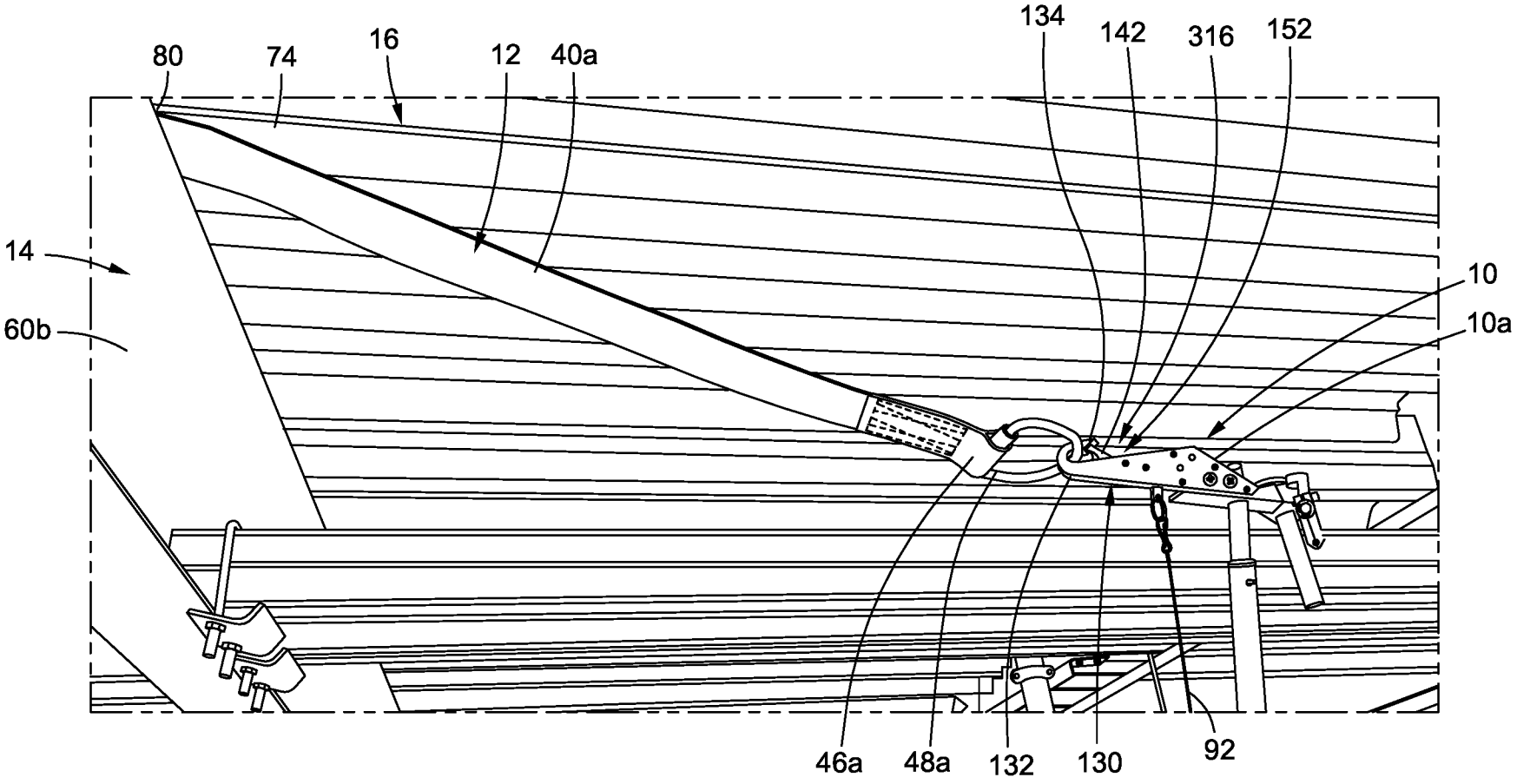
FIG. 9D is an illustration of a close-up left side perspective view of the system of FIG. 9A, showing the safety hook assembly in a closed position and pulling the strap from the beam, to remove the strap from the beam.

Now referring to FIGS. 9A-9D, FIGS. 9A-9D show exemplary versions of a system 10, such as a remote anchoring system 10*a*, in use to secure and remove, with the safety hook assembly 130, an anchoring member 12, such as a beam strap 40*a*, to and from an anchorage structure 14, such as a limited clearance overhead beam 60*b*, in an overhead area 16, such as a roof panel 74, for example, a corrugated roof panel, having a limited clearance area 80. FIGS. 9A-9C show the beam strap 40*a* being secured to the limited clearance overhead beam 60*b*. FIG. 9D shows the beam strap 40*a* being removed from the limited clearance overhead beam 60*b*.

FIG. 9A is an illustration of a close-up left side perspective view of a version of the system 10, such as the remote anchoring system 10*a*, of the disclosure, used to secure, with the safety hook assembly 130, the anchoring member 12, such as the beam strap 40*a*, to the anchorage structure 14, such as the limited clearance overhead beam 60*b*, in the overhead area 16, such as the roof panel 74, and having the limited clearance area 80 (see FIGS. 9B, 9C). FIG. 9A shows the safety hook assembly 130 in the open position 314 and shows the first D-ring 48*a* and the second D-ring 48*b* of the beam strap 40*a*. Prior to insertion of the hook end 134 through the first D-ring 48*a*, an operator 20 (see FIG. 8A) pulls the pull cord 92 to manually open the safety latch 142 (see FIG. 9D), so that the safety latch 142 is in the open position 154 (see FIGS. 3G, 9A). FIG. 9A shows the safety hook assembly 130 attached to the pole 84, such as the extension pole 84*a*, via the attachment tool assembly 124. FIG. 9A further shows the clip 284 of the pull cord 92 attached to the safety hook assembly 130, via the ring attachment 214.

FIG. 9B is an illustration of a close-up left side perspective view of the system 10, such as the remote anchoring system 10*a*, of FIG. 9A, showing the safety hook portion 132 with the hook end 134 of the safety hook assembly 130 inserted through the first D-ring 48*a*, or large D-ring, of the anchoring member 12, such as the beam strap 40*a*, and capturing the second D-ring 48*b*, or small D-ring, of the beam strap 40*a*, to pull the second D-ring 48*b* through the first D-ring 48*a*, to secure and install the beam strap 40*a* around the anchorage structure 14, such as the limited clearance overhead beam 60*b*, in the overhead area 16, such as the roof panel 74, having the limited clearance area 80. As shown in FIG. 9B, the safety hook assembly 130 is in the open position 314 to capture the second D-ring 48*b* in order to pull the second D-ring through the first D-ring. FIG. 9B shows the safety hook assembly 130 attached to the pole 84, such as the extension pole 84*a*, via the attachment tool assembly 124. FIG. 9B further shows the clip 284 of the pull cord 92 attached to the safety hook assembly 130, via the ring attachment 214. FIG. 9B further shows the safety hook assembly 130 attached to the attachment tool assembly 124 with two attachment elements 318, such as in the form of bolts 318*a*. However, other suitable attachment elements or fastening means may be used to attach the safety hook assembly 130 to the attachment tool assembly 124.

FIG. 9C is an illustration of a close-up left side perspective view of the system 10, such as the remote anchoring system 10*a*, of FIG. 9A, showing the safety hook assembly 130 in the open position 314 and showing the hook end 134 of the safety hook assembly 130 pulling the second D-ring 48*b*, or small D-ring, through the first D-ring 48*a*, or large D-ring, until the anchoring member 12, such as the beam strap 40*a*, is tight against, and around, the anchorage structure 14, such as the limited clearance overhead beam 60*b*, having the limited clearance area 80, positioned in the overhead area 16, such as the roof panel 74. FIG. 9C shows the safety hook assembly 130 attached to the pole 84, such as the extension pole 84*a*, via the attachment tool assembly 124. FIG. 9C further shows the clip 284 of the pull cord 92 attached to the safety hook assembly 130, via the ring attachment 214. FIG. 9C further shows the safety hook portion 132 with the hook end 134, and the safety hook assembly 130 in the open position 314.

Once the anchoring member 12, such as the beam strap 40*a*, is secured to the anchorage structure 14, such as the limited clearance overhead beam 60*b*, fall protection equipment fall protection equipment, such as harnesses, lanyards, or other fall protection equipment, may be attached to the anchoring member 12, such as the beam strap 40*a*, and used. After the anchoring member 12, such as the beam strap 40*a*, is used, the anchoring member 12, such as the beam strap 40*a*, may be removed from the anchorage structure 14, such as the limited clearance overhead beam 60*b*.

FIG. 9D is an illustration of a close-up left side perspective view of the system 10, such as the remote anchoring system 10*a*, of FIG. 9A, showing the safety hook assembly 130 in the closed position 316 and the safety latch 142 in the closed position 152 around the first D-ring 48*a*, or large D-ring, at the first end 46*a* of the anchoring member 12, such as the beam strap 40*a*, and pulling the beam strap 40*a* from the anchorage structure 14, such as the limited clearance overhead beam 60*b*, to remove the beam strap 40*a* from the limited clearance overhead beam 60*b* having the limited clearance area 80. As shown in FIG. 9D, the safety hook assembly 130 is in the closed position 316, and the safety latch 142 is in the closed position 152, to lock, or secure, the safety hook portion 132 around the first D-ring 48*a*, prior to removal from the limited clearance overhead beam 60*b*. Prior to capturing the first D-ring 48*a* with the hook end 134 of the safety hook assembly 130, the operator 20 (see FIG. 8A) releases the pull cord 92 to close the safety latch 142, and to hold the first D-ring 48*a* securely for removal. FIG.

9D further shows the overhead area 16, such as the roof panel 74, having the limited clearance area 80.

Figure 10:
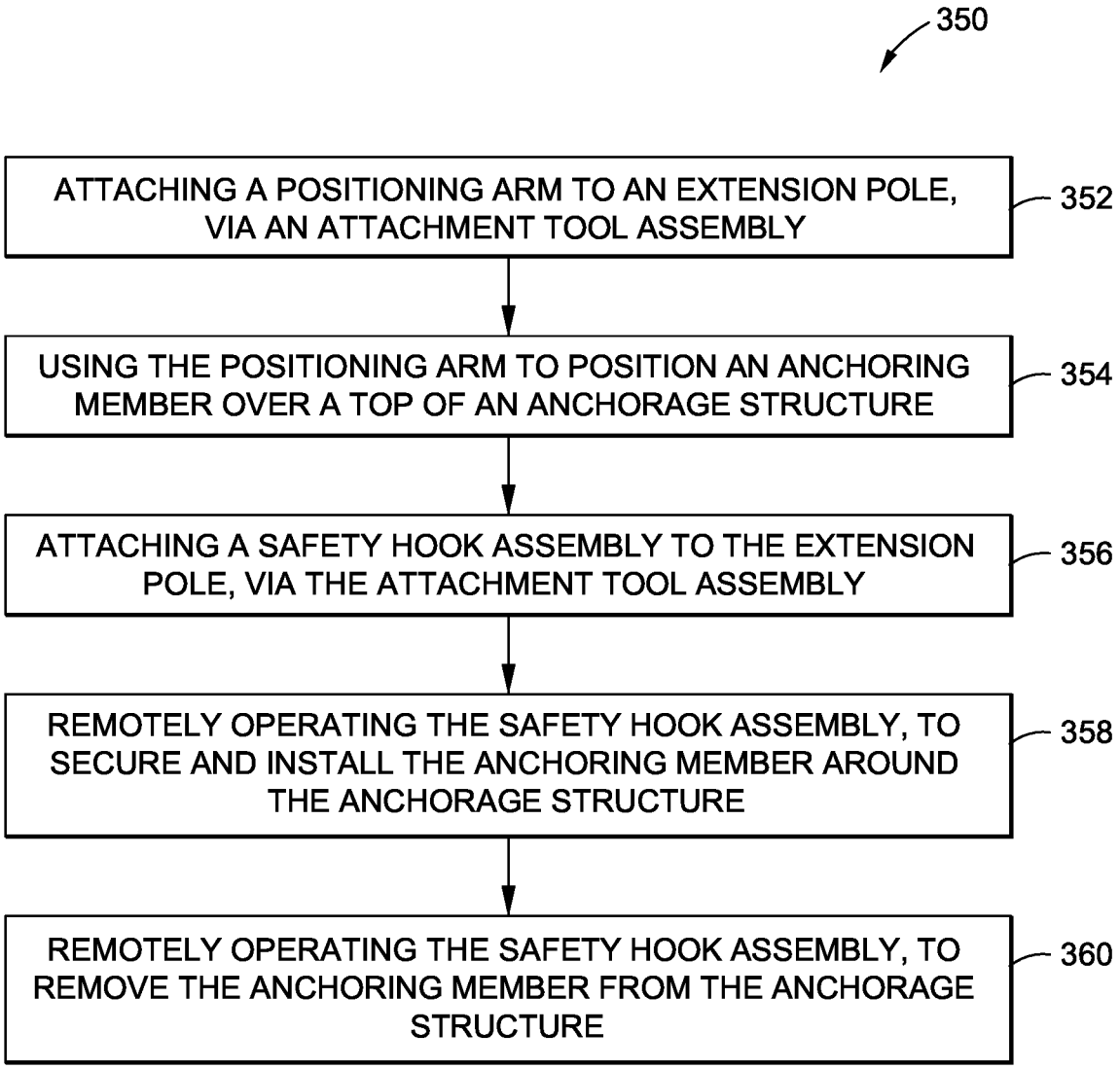
FIG. 10 is an illustration of a flow diagram of an exemplary version of a method of the disclosure.

Now referring to FIG. 10, FIG. 10 is an illustration of a flow diagram of an exemplary version of a method 350 of the disclosure. In another version of the disclosure, there is provided the method 350 to install and remove an anchoring member 12 (see FIG. 1) on an anchorage structure 14 (see FIG. 1) in an overhead area 16 (see FIG. 1).

The blocks in FIG. 10 represent operations and/or portions thereof, or elements, and lines connecting the various blocks do not imply any particular order or dependency of the operations or portions thereof, or elements. FIG. 10 and the disclosure of the steps of the method 350 set forth herein should not be interpreted as necessarily determining a sequence in which the steps are to be performed. Rather, although one illustrative order is indicated, it is to be understood that the sequence of the steps may be modified when appropriate. Accordingly, certain operations may be performed in a different order or simultaneously.

As discussed in detail above, and shown in FIG. 1, the anchoring member 12 comprises a strap 40, including a beam strap 40*a*, a fall protection strap 40*b*, a cross-arm strap 40*c*, or another suitable strap. As further shown in FIG. 1, the anchoring member 12 comprises an anchoring connector element 42, including an anchoring connector ring 42*a*, or another suitable anchoring member that provides an anchor point 36 (see FIG. 1).

As discussed in detail above, and shown in FIG. 1, the anchorage structure 14 may comprise a beam 60, such as an overhead beam 60*a*, a limited clearance overhead beam 60*b*, an I-beam 60*c*, a steel beam 60*d*, or another strong and sturdy beam. As further shown in FIG. 1, the anchorage structure 14 may comprise an overhead scaffold 62, a truss chord 64, for example, an upper truss chord, a pipe 66, such as a metal pipe 66*a*, or another suitable anchorage structure that provides the attach point 38 for the anchoring member 12.

As discussed in detail above, and as shown in FIG. 1, the overhead area 16 or remote location 18 comprises a ceiling 68, a ceiling interface 70, a roof 72, a roof panel 74, for example, a corrugated roof panel, an elevated platform 76, a catwalk 78, or another suitable overhead area or remote location from the operator 20 or user 22 of the system 10, such as the remote anchoring system 10*a*. The overhead area 16 may have a limited clearance area 80 (see FIG. 1) with a narrow width 82 (see FIG. 1), where it is difficult to access or may have a limited or narrow clearance.

As shown in FIG. 10, the method 350 comprises the step of attaching 352 a positioning arm 94 (see FIG. 2A) to a pole 84 (see FIG. 4A), such as an extension pole 84*a* (see FIG. 4A) or a telescoping pole 84*b* (see FIG. 1), via an attachment tool assembly 124 (see FIG. 5A). The positioning arm 94 comprises a first end 98*a* (see FIG. 2A), and a second end 98*b* (see FIG. 2A) offset from the first end 98*a* at an offset angle 116 (see FIG. 2D). The positioning arm 94 further comprises an elongated body 100 (see FIG. 2A) having an outboard portion 104 (see FIG. 2A) and an inboard portion 106 (see FIG. 2A). In one version, the elongated body 100 is a two-piece elongated body 100*a* (see FIG. 2A), and the outboard portion 104 and the inboard portion 106 are attached together with an attachment assembly 180 (see FIG. 2E). In another version, the elongated body is a one-piece elongated body 100*b* (see FIG. 2J) with the outboard portion 104 and the inboard portion 106. The positioning arm 94 further comprises a recessed area 108 (see FIG. 2A) formed in the outboard portion 104 at the first end 98*a*. The positioning arm 94 further comprises a dogleg shaped portion 114 (see FIG. 2B) formed along an area 106*a* (see FIG. 2B) of the inboard portion 106 (see FIG. 2B) at the second end 98*b* (see FIG. 2B).

As shown in FIG. 10, the method 350 further comprises the step of using 354 the positioning arm 94 to position the anchoring member 12, such as the strap 40, for example, the beam strap 40*a*, over a top portion 14*a* of the anchorage structure 14. The step of using 354 the positioning arm 94 to position the anchoring member 12 over the top portion 14*a* of the anchorage structure 14 further comprises, using the recessed area 108 of the positioning arm 94 to position the anchoring member 12 comprising a strap 40, and using the recessed area 108 to pass through a limited clearance area 80 (see FIG. 1) in the overhead area 16, to allow for an improved clearance 110 (see FIG. 1) of both the outboard portion 104 and a D-ring 48, such as a second D-ring 48*b*, or small D-ring, attached to a strap second end 46*b* of the strap 40. The positioning arm 94, or installation arm 96 (see FIG. 2A), is initially used to position the anchoring member 12, such as the strap 40, for example, the beam strap 40*a*, over an anchorage structure 14, such as the beam 60.

As shown in FIG. 10, the method 350 further comprises the step of attaching 356 a safety hook assembly 130 to the pole 84, such as the extension pole 84*a*, via the attachment tool assembly 124. As shown in FIG. 1, the safety hook assembly 130 comprises a hook body 136, a hook cover 138 attached to the hook body 136, via a plurality of fastener elements 216 (see FIG. 3A), such as cap screws 216*a* (see FIG. 3A), a safety hook portion 132 with a hook end 134, and a safety latch mechanism 140 disposed between the hook body 136 and the hook cover 138. As shown in FIG. 1, the safety latch mechanism 140 has a safety latch 142 engageable with the hook end 134, and has a spring element 164 in communication with the safety latch 142.

As shown in FIG. 10, the method 350 further comprises the step of remotely operating 358 the safety hook assembly 130, to secure and install the anchoring member 12, such as the strap 40, for example, the beam strap 40*a*, around the anchorage structure 14. The step of remotely operating 358 the safety hook assembly 130 to secure and install the anchoring member 12 around the anchorage structure 14 further comprises, remotely operating the safety hook assembly 130 to secure and install the anchoring member 12 comprising a strap 40, and the operator 20 (see FIG. 1) pulling the pull cord 92 (see FIG. 4C) to manually open the safety latch 142, inserting the hook end 134 through a first D-ring 48*a*, or large D-ring, attached to a strap first end 46*a* of the strap 40, capturing with the hook end 134 a second D-ring 48*b*, or small D-ring, attached to a strap second end 46*b* of the strap 40, and pulling the second D-ring 48*b* through the first D-ring 48*a*, until the strap 40 is secured and installed around the anchorage structure 14. Once the anchoring member 12, such as the strap 40, for example, the beam strap 40*a*, is secured to the anchorage structure 14, fall protection equipment, such as harnesses, lanyards, or other fall protection equipment, may be attached to it.

As shown in FIG. 10, the method 350 further comprises the step of remotely operating 360 the safety hook assembly 130, to remove the anchoring member 12, such as the strap 40, for example, the beam strap 40*a*, from the anchorage structure 14. The safety latch mechanism 140 of the safety hook assembly 130 is remotely operated by an operator 20, via a pull cord 92 attached to the safety latch mechanism 140, such that when the operator 20 pulls the pull cord 92, the safety latch 142 opens, and when the operator 20 releases the pull cord 92, the spring element 164 causes the safety latch 142 to close.

The step of remotely operating 360 the safety hook assembly to remove the anchoring member 12, such as the strap 40, from the anchorage structure 14 further comprises, remotely operating the safety hook assembly 130 to remove the anchoring member 12 comprising a strap 40, and the operator 20 pulling the pull cord 92 to open the safety latch 142, capturing with the hook end 134 a first D-ring 48*a*, or large D-ring, attached to a strap first end 46*a* of the strap 40, releasing the pull cord 92 to close the safety latch 142 to hold the first D-ring 48*a* securely, and pulling the strap 40 from the anchorage structure 14 to remove the strap 40 from the anchorage structure 14, and to eliminate an occurrence of the strap 40 falling free.

Figure 11:
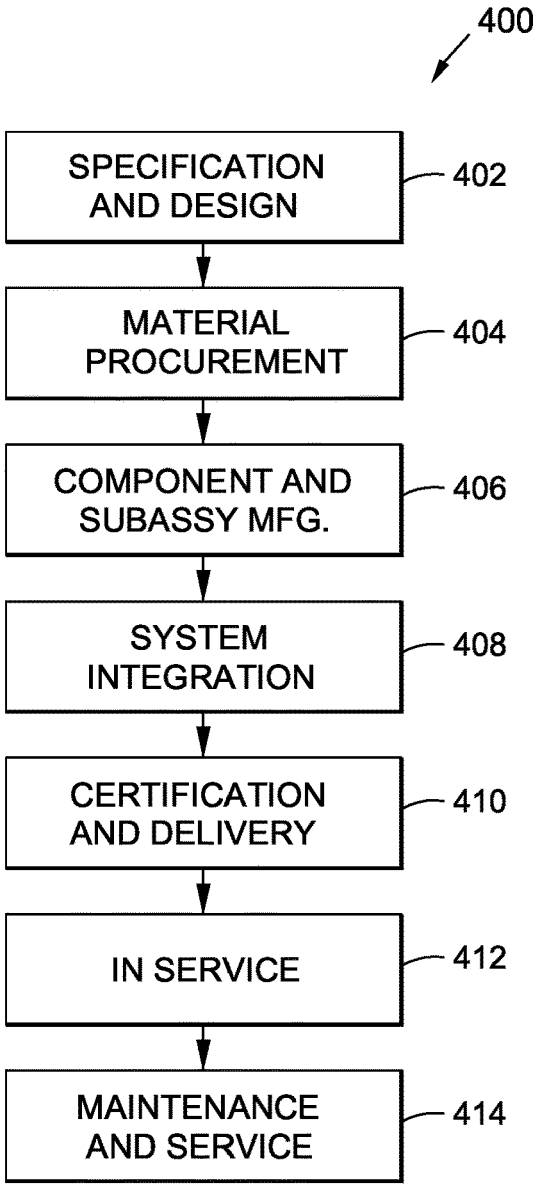
FIG. 11 is an illustration of a flow diagram of an exemplary aircraft manufacturing and service method.
Figure 12:
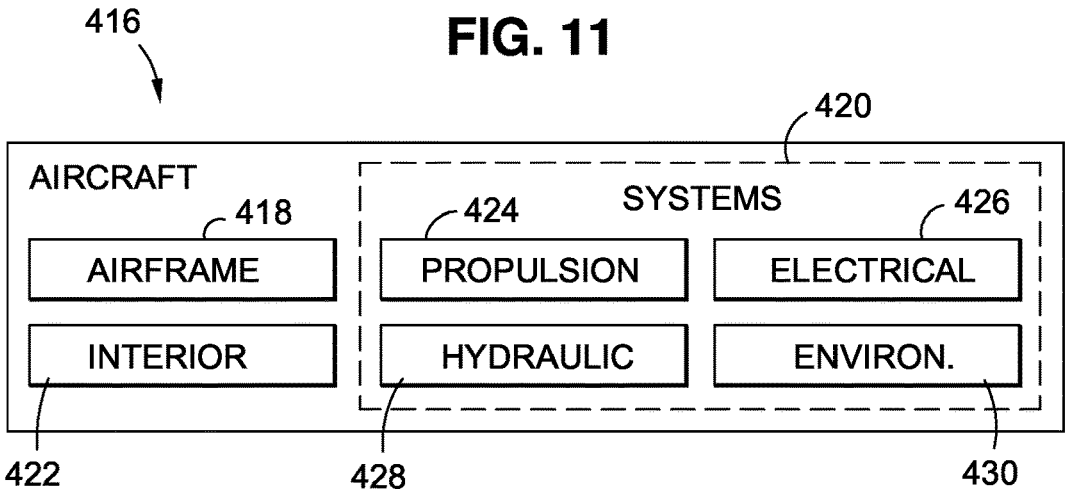
FIG. 12 is an illustration of an exemplary block diagram of an aircraft.

Now referring to FIGS. 11 and 12, FIG. 11 is an illustration of a flow diagram of an exemplary aircraft manufacturing and service method 400, and FIG. 12 is an illustration of an exemplary block diagram of an aircraft 416. Referring to FIGS. 11 and 12, versions of the disclosure may be described in the context of the aircraft manufacturing and service method 400 as shown in FIG. 11, and the aircraft 416 as shown in FIG. 12. The aircraft manufacturing and service method 400 may require manufacturing activities 30 (see FIG. 1) that use the system 10, such as the remote anchoring system 10*a*, disclosed herein.

During pre-production, exemplary aircraft manufacturing and service method 400 may include specification and design 402 of the aircraft 416 and material procurement 404. During manufacturing, component and subassembly manufacturing 406 and system integration 408 of the aircraft 416 takes place. Thereafter, the aircraft 416 may go through certification and delivery 410 in order to be placed in service 412. While in service 412 by a customer, the aircraft 416 may be scheduled for routine maintenance and service 414 (which may also include modification, reconfiguration, refurbishment, and other suitable services).

Each of the processes of the aircraft manufacturing and service method 400 may be performed or carried out by a system integrator, a third party, and/or an operator (e.g., a customer). For the purposes of this description, a system integrator may include, without limitation, any number of aircraft manufacturers and major-system subcontractors. A third party may include, without limitation, any number of vendors, subcontractors, and suppliers. An operator may include an airline, leasing company, military entity, service organization, and other suitable operators.

As shown in FIG. 12, the aircraft 416 produced by the exemplary aircraft manufacturing and service method 400 may include an airframe 418 with a plurality of systems 420 and an interior 422. Examples of the plurality of systems 420 may include one or more of a propulsion system 424, an electrical system 426, a hydraulic system 428, and an environmental system 430. Any number of other systems may be included. Although an aerospace example is shown, the principles of the disclosure may be applied to other industries, such as the automotive industry.

Methods and systems embodied herein may be employed during any one or more of the stages of the aircraft manufacturing and service method 400. For example, components or subassemblies corresponding to component and subassembly manufacturing 406 may be fabricated or manufactured in a manner similar to components or subassemblies produced while the aircraft 416 is in service 412. Also, one or more apparatus embodiments, method embodiments, or a combination thereof, may be utilized during component and subassembly manufacturing 406 and system integration 408, for example, by substantially expediting assembly of or reducing the cost of the aircraft 416. Similarly, one or more of apparatus embodiments, method embodiments, or a combination thereof, may be utilized while the aircraft 416 is in service 412, for example and without limitation, to maintenance and service 414

Disclosed versions of the system 10 (see FIGS. 1, 6C, 6F, 8D), such as the remote anchoring system 10*a* (see FIGS. 1, 6C, 6F, 8D), and the method 350 (see FIG. 10) provide an improved system to install, position, secure, release, and remove an anchoring member 12, such as a strap 40 (see FIG. 6A), such as a beam strap 40*a* (see FIG. 9A), a fall protection strap 40*b* (see FIG. 8A), a cross-arm strap 40*c* (see FIG. 1), an anchoring connector element 42 (see FIG. 1), such as an anchoring connector ring 42*a* (see FIG. 1), or another suitable anchoring member, to and from an anchorage structure 14, such as a beam 60 (see FIG. 6A), an overhead beam 60*a* (see FIG. 8A), a limited clearance overhead beam 60*b* (see FIG. 7B), an I-beam 60*c* (see FIG. 1), a steel beam 60*d* (see FIG. 1), an overhead scaffold 62 (see FIG. 1), a truss chord 64 (see FIG. 1), a pipe 66 (see FIG. 1), such as a metal pipe 66*a* (see FIG. 1), or another suitable anchorage structure, in an overhead area 16 (see FIGS. 1, 6A, 7A, 8A, 9A). The system 10, such as the remote anchoring system 10*a*, is particularly suited for installing the anchoring member 12, such as a fall protection strap 40*b*, onto the anchorage structure 14, such as a limited clearance overhead beam 60*b*, in an overhead area 16 having a limited clearance area 80 (see FIG. 1) or narrow width 82 (see FIG. 1), for example, a ceiling 68 (see FIGS. 1, 6A), a ceiling interface 70 (see FIGS. 1, 8A), a roof panel 74 (see FIG. 7A), an elevated platform 76 (see FIG. 1), a catwalk 78 (see FIG. 1), or another overhead area. The system 10, such as the remote anchoring system 10*a*, improves the safety of manufacturing operations by ensuring that fall protection is in place during a manufacturing activity 30 (see FIG. 1), a maintenance activity 32 (see FIG. 1), a construction activity 34 (see FIG. 1), or another activity, thus reducing the risk of falls. The system 10 contains devices, such as the positioning arm 94 and the safety hook assembly 130 that are connected one at a time, or together, to the pole first end 86*a* (see FIGS. 4B, 4D) of the pole 84 (see FIGS. 4B, 4D), such as the extension pole 84*a* (see FIGS. 4B, 4D), via the attachment tool assembly 124 (see FIG. 1), to install, position, secure, release, and remove the anchoring member 12, such as the fall protection strap 40*b*, to an the anchorage structure 14, or architectural structure.

Disclosed versions of the system 10 (see FIGS. 1, 6C, 6F, 8D), such as the remote anchoring system 10*a* (see FIGS. 1, 6C, 6F, 8D), and the method 350 (see FIG. 10) provide an improved positioning arm 94 (see FIGS. 1, 2A) with a low profile 102 (see FIG. 1), and having a first end 98*a* (see FIGS. 1, 2A) having a notched portion 112 (see FIG. 2A), and a second end 98*b* (see FIGS. 1, 2A) offset from the first end 98*a* at an offset angle 116 (see FIGS. 1, 2D). The positioning arm 94 is attached or connected to a pole 84 (see FIGS. 1, 4B), such as an extension pole 84*a* (see FIGS. 1, 4B), via an attachment tool assembly 124, such as shown in FIG. 5A, or another suitable attachment tool assembly, or attachment means, for attaching or connecting the positioning arm 94 to the pole 84. The improved positioning arm 94 has a recessed area 108 (see FIGS. 1, 2A) on an outboard portion 104 (see FIGS. 1, 2A) and a dogleg shaped portion 114 (see FIGS. 1, 2A) on an inboard portion 106 (see FIGS. 1, 2A).

The recessed area 108 allows for an improved clearance 110 (see FIG. 1) of both the outboard portion 104 and a D-ring 48 (see FIGS. 1, 7B), such as a second D-ring 48*b* (see FIG. 7B), or small D-ring, attached to the anchoring member 12, such as the beam strap 40*a*, to pass through a limited clearance area 80 (see FIGS. 1, 7B) in the overhead area 16. In addition, the dogleg shaped portion 114 and the offset angle 116 allow passage of the anchoring member 12, such as the strap 40, for example, the beam strap 40*a* or fall protection strap 40*b* through the overhead area 16 having the limited clearance area 80 (see FIG. 7B) or a narrow width 82 (see FIG. 1). Thus, the positioning arm 94 of the system 10, such as the remote anchoring system 10*a*, provides for improved access to limited clearance areas 80, for example, overhead areas 16 with limited clearance overhead beams 60*b*, when the positioning arm 94 is in use to install and position the anchoring member 12 on and over the anchorage structure 14.

Further, the positioning arm 94 of the system 10, such as the remote anchoring system 10*a*, avoids or eliminates having to use a messenger line, i.e., a small diameter cord or rope, to facilitate passing the anchoring member 12, such as the strap 40, over the anchorage structure 14, such as the overhead beam 60*a*, through the limited clearance area 80. Not having to use a messenger line may result in decreased time and complexity of installation of the anchoring member 12, such as the strap 40.

Moreover, the offset angle 116, for example, a 5° (five degree) angle 116*a* (see FIG. 2D), improves the center of balance 118 (see FIGS. 1, 6C), when the positioning arm 94 is in use, thus providing an improved ergonomic control 122 (see FIG. 1). With the disclosed system 10, such as the remote anchoring system 10*a*, the center of balance 118 of the positioning arm 94 is closer to the operator grip area 120 (see FIG. 6C) on the pole 84 (see FIG. 6C), thus requiring less effort by the operator 20 (see FIG. 6C) or user 22 (see FIG. 1), and affording the improved ergonomic control 122 of the pole 84 and the positioning arm 94. With known systems having an arm with a first end in a same plane as a second end and having a first end that is not offset from the second end, a center of balance is in front of an operator grip area near a bottom end of the pole, and may need greater effort to hold the arm and pole assembly upright.

In addition, disclosed versions of the system 10 (see FIGS. 1, 6C, 6F, 8D), such as the remote anchoring system 10*a* (see FIGS. 1, 6C, 6F, 8D), and the method 350 (see FIG. 10) provide an improved safety hook assembly 130 (see FIGS. 1, 3A, 3B) for securing, releasing, and removing the anchoring member 12, such as the strap 40, for example, the beam strap 40*a*, or fall protection strap 40*b*, from the anchorage structure 14, such as the beam 60, for example, an overhead beam 60*a* or a limited clearance overhead beam 60*b*. The safety hook assembly 130 is attached or connected to a pole 84 (see FIGS. 1, 4D), such as an extension pole 84*a* (see FIGS. 1, 4D), via an attachment tool assembly 124, such as shown in FIG. 5A, or another suitable attachment tool assembly, or attachment means, for attaching or connecting the safety hook assembly 130 to the pole 84.

The improved safety hook assembly 130 has moving parts in the form of a safety latch mechanism 140 (see FIGS. 3A, 3F, 3G), such as a remotely operated safety latch mechanism 140*a* (see FIG. 1). The safety latch mechanism 140 is housed between a hook cover 138 (see FIGS. 3A, 3B) attached to a hook body 136 (see FIGS. 3A, 3B) and has a safety latch 142 that can be remotely opened and closed by an operator 20 (see FIGS. 1, 8A) or user 22 (see FIG. 1). The safety latch mechanism 140 is remotely operated by the operator 20, or user 22, to secure or release the anchoring member 12 to or from the anchorage structure 14.

The safety hook assembly 130 secures the anchoring member 12 to the anchorage structure 14, by the operator 20 pulling a pull cord 92 (see FIG. 8B) to manually open the safety latch 142 (see FIG. 8B) so the safety hook assembly 130 is in the open position 314 (see FIG. 8B), inserting the hook end 134 (see FIG. 8B) through the first D-ring 48*a* (see FIG. 8B), or large D-ring, attached to the anchoring member 12, capturing with the hook end 134 the second D-ring 48*b* (see FIG. 8C), or small D-ring attached to the anchoring member 12, and pulling the second D-ring 48*b* through the first D-ring 48*a*, until the anchoring member 12 is tightly secured and installed around and against the anchorage structure 14, such as the overhead beam 60*a* (see FIG. 8D).

The safety hook assembly 130 releases and removes the anchoring member 12 from the anchorage structure 14, by the operator 20 pulling the pull cord 92 to open the safety latch 142, capturing the first D-ring 48*a* (see FIG. 8E) with the hook end 134 (see FIG. 8E), releasing the pull cord 92 (see FIG. 8E) to close the safety latch 142 (see FIG. 8E) to hold the first D-ring 48*a* securely, and pulling the anchoring member 12 (see FIGS. 8F, 8G) from the anchorage structure 14 (see FIGS. 8F, 8G), to remove the anchoring member 12 from the anchorage structure 14, and to eliminate an occurrence of the anchoring member 12 falling free. The safety latch 142 of the safety hook assembly 130 locks the D-ring 48, such as the first D-ring 48*a* to the safety hook assembly 130, so there is no opportunity for the anchoring member 12, such as the strap 40 or anchoring connector element 42, to come off or fall off safety hook assembly 130. This eliminates the risk that the anchoring member 12 falls on the operator 20, user 22, worker, personnel, material, or structures on the floor 24 (see FIG. 6A) or ground area 26 (see FIG. 8A) below. Thus, the remotely operated safety latch mechanism 140*a* (see FIG. 1) allows positive control of the anchoring member 12, such as a beam strap 40*a* (see FIG. 1) or a cross-arm strap 40*c* (see FIG. 1), when setting or recovering the beam strap 40*a* or cross-arm strap, reducing the risk of falling objects.

The pull cord 92 (see FIGS. 1, 4C, 8D), or accessory cord, has a clip 284 (see FIG. 8D) that is attached to a ring attachment 214 (see FIGS. 3K, 8D) attached to a lower end 250*a* (see FIGS. 3A, 3K) of the rack slider 158 (see FIG. 3A), of the safety hook assembly 130. The pull cord 92 is pulled by the operator 20 or user 22 to open the safety latch 142 to the open position 154 (see FIG. 3G), and when the operator 20 or user 22 releases the pull cord 92, the spring element 164 (see FIGS. 3A, 3F) causes the safety latch 142 to close to the closed position 152 (see FIG. 3F), via the rack slider 158 (see FIGS. 3A, 3F) and idler gear 156 (see FIGS. 3A, 3F) of the safety latch mechanism 140.

Disclosed versions of the system 10 (see FIGS. 1, 6C, 6F, 8D), such as the remote anchoring system 10*a* (see FIGS. 1, 6C, 6F, 8D), and the method 350 (see FIG. 10) may provide for improved parts, such as the improved positioning arm 94 and the improved safety hook assembly 130, that allow improved ease of placement and recovery of the anchoring member 12, such as the strap 40, or other anchoring device, reduced risk of falling objects, such as a falling anchoring member or strap, improved reliability and improved ergonomic benefit for positioning and removing the anchoring member 12, such as the beam strap 40*a*, to and from the anchorage structure 14, such as the beam 60, and cost savings for building and equipment maintenance.

The cost savings may result by faster installation, securement, and removal of the anchoring member 12 on anchorage structures 14 in overhead areas 16 with a limited clearance area 80 or in areas that are challenging to work in. The system 10, such as the remote anchoring system 10*a*, may be used where there are catwalks 78 (see FIG. 1) or elevated platforms 76 (see FIG. 1) overhead and places where it may not be possible or practical to bring a mobile area lift platform in. The improved system 10, such as the remote anchoring system 10*a*, allows a worker to have fall protection 28 (see FIG. 1) when they are working up above the catwalks 78 or elevated platforms 76. Disclosed versions of the system 10 (see FIGS. 1, 6C, 6F, 8D), such as the remote anchoring system 10*a* (see FIGS. 1, 6C, 6F, 8D), and the method 350 (see FIG. 10) provide a system to install a fall protection anchorage beam strap or connector in an overhead area 16 with limited or narrow clearance, such as a ceiling interface 70 (see FIG. 1) or a roof panel 74 (see FIG. 1). The system 10, such as the remote anchoring system 10*a*, facilitates elevated access to various systems in buildings and architectural structures, including lighting, plumbing, steam, fire protection, HVAC, communication, seismic, structural, painting, and other systems, and provides access to building elements above the handrails of platforms or catwalks where aerial work platforms cannot reach, such as for facility maintenance activities.

Many modifications and other versions of the disclosure will come to mind to one skilled in the art to which this disclosure pertains having the benefit of the teachings presented in the foregoing descriptions and the associated drawings. The versions described herein are meant to be illustrative and are not intended to be limiting or exhaustive. Although specific terms are employed herein, they are used in a generic and descriptive sense only and not for purposes of limitation. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

What is claimed is:

1. A system to install and remove an anchoring member on an anchorage structure in an overhead area, the system comprising:

a pole for providing access to the overhead area;

a positioning arm configured for attachment to the pole, to position the anchoring member over a top portion of the anchorage structure, the positioning arm comprising:

a first end, and a second end offset from the first end;

an elongated body having an outboard portion and an inboard portion;

a recessed area formed in the outboard portion at the first end; and a dogleg shaped portion formed along the inboard portion at the second end; and a safety hook assembly configured for attachment to the pole, to secure the anchoring member to, and to remove the anchoring member from, the anchorage structure, the safety hook assembly comprising:

a hook end; and a safety latch mechanism having a safety latch engageable with the hook end, wherein the safety latch mechanism is remotely operated by an operator, via a pull cord attached to the safety latch mechanism, such that when the operator pulls the pull cord, the safety latch opens, and when the operator releases the pull cord, the safety latch closes.

2. The system of claim 1, wherein the anchoring member comprises a strap, a beam strap, a fall protection strap, a cross-arm strap, an anchoring connector element, or an anchoring connector ring.

3. The system of claim 1, wherein the recessed area of the positioning arm allows for an improved clearance of both the outboard portion and a D-ring attached to the anchoring member, to pass through a limited clearance area in the overhead area.

4. The system of claim 1, wherein the safety hook assembly secures the anchoring member to the anchorage structure, by the operator pulling the pull cord to manually open the safety latch, inserting the hook end through a first D-ring attached to a first end of the anchoring member, capturing with the hook end a second D-ring attached to a second end of the anchoring member, and pulling the second D-ring through the first D-ring, until the anchoring member is secured and installed around the anchorage structure.

5. The system of claim 4, wherein the safety hook assembly removes the anchoring member from the anchorage structure, by the operator pulling the pull cord to open the safety latch, capturing the first D-ring with the hook end, releasing the pull cord to close the safety latch to hold the first D-ring securely, and pulling the anchoring member from the anchorage structure, to remove the anchoring member from the anchorage structure, and to eliminate an occurrence of the anchoring member falling free.

6. The system of claim 1, wherein the second end of the positioning arm is offset from the first end of the positioning arm at an offset angle, so that when the positioning arm is in use with the pole at the overhead area, a center of balance of the positioning arm is in proximity to an operator grip area on the pole, to provide an improved ergonomic control of the pole and the positioning arm.

7. The system of claim 6, wherein the offset angle is a 5° (five degree) angle.

8. The system of claim 1, wherein the safety hook assembly further comprises:

a hook body; and a hook cover attached to the hook body, via a plurality of fastener elements.

9. The system of claim 8, wherein the safety latch has an undercut portion that forms a gap with an interior surface portion in the hook body, to provide a stick-free actuation of the safety latch.

10. The system of claim 1, wherein the safety latch mechanism further comprises:

an idler gear engageable with the safety latch;

a rack slider engageable with the idler gear; and a spring element engageable with the rack slider, via a spring plunger element.

11. The system of claim 10, wherein the rack slider has a lower end with an opening through which a ring attachment is attached, the ring attachment configured for attachment to the pull cord.

12. The system of claim 1, wherein the system further comprises an attachment tool assembly attached to the pole, and configured to attach the positioning arm to the pole, and configured to attach the safety hook assembly to the pole.

13. A remote anchoring system to install and remove a beam strap on a beam in an overhead area, the remote anchoring system comprising:

an extension pole having a pole first end accessible to the overhead area, and a pole second end manually operated by an operator;

a positioning arm configured for attachment to the pole first end, via an attachment tool assembly, to position the beam strap over a top portion of the beam, the positioning arm comprising:

a first end having a notched portion;

a second end offset from the first end at an offset angle;

an elongated body having an outboard portion attached to an inboard portion;

a recessed area formed in the outboard portion at the first end; and a dogleg shaped portion formed along an area of the inboard portion at the second end; and a safety hook assembly configured for attachment to the pole first end, via the attachment tool assembly, to secure and install the beam strap to the beam, and to remove the beam strap from the beam, the safety hook assembly comprising:

a hook body;

a hook cover attached to the hook body;

a safety hook portion with a hook end; and a safety latch mechanism disposed between the hook body and the hook cover, the safety latch mechanism having a safety latch engageable with the hook end, and having a spring element in communication with the safety latch, wherein the safety latch mechanism is remotely operated by the operator, via a pull cord attached to the safety latch mechanism, such that when the operator pulls the pull cord, the safety latch opens, and when the operator releases the pull cord, the spring element causes the safety latch to close.

14. The remote anchoring system of claim 13, wherein the recessed area of the positioning arm allows for an improved clearance of both the outboard portion and a D-ring attached to the beam strap, to pass through a limited clearance area in the overhead area.

15. The remote anchoring system of claim 13, wherein the safety hook assembly removes the beam strap from the beam, by the operator pulling the pull cord to open the safety latch, capturing with the hook end a first D-ring attached to a strap first end of the beam strap, releasing the pull cord to close the safety latch to hold the first D-ring securely, and pulling the beam strap from the beam to remove the beam strap from the beam, and to eliminate an occurrence of the beam strap falling free.

16. The remote anchoring system of claim 13, wherein the safety latch mechanism further comprises:

an idler gear engageable with the safety latch;

a rack slider engageable with the idler gear; and a spring plunger element engageable with the rack slider and engageable with the spring element.

17. A method to install and remove an anchoring member on an anchorage structure in an overhead area, the method comprising the steps of:

attaching a positioning arm to an extension pole, via an attachment tool assembly, the positioning arm comprising:

a first end, and a second end offset from the first end at an offset angle;

an elongated body having an outboard portion and an inboard portion;

a recessed area formed in the outboard portion at the first end; and a dogleg shaped portion formed along the inboard portion at the second end;

using the positioning arm to position the anchoring member over a top portion of the anchorage structure;

attaching a safety hook assembly to the extension pole, via the attachment tool assembly, the safety hook assembly comprising:

a hook body;

a hook cover attached to the hook body;

a safety hook portion with a hook end; and a safety latch mechanism disposed between the hook body and the hook cover, the safety latch mechanism having a safety latch engageable with the hook end, and having a spring element in communication with the safety latch;

remotely operating the safety hook assembly, to secure and install the anchoring member around the anchorage structure; and remotely operating the safety hook assembly, to remove the anchoring member from the anchorage structure, wherein the safety latch mechanism of the safety hook assembly is remotely operated by an operator, via a pull cord attached to the safety latch mechanism, such that when the operator pulls the pull cord, the safety latch opens, and when the operator releases the pull cord, the spring element causes the safety latch to close.

18. The method of claim 17, wherein the step of using the positioning arm to position the anchoring member over the top portion of the anchorage structure further comprises, using the recessed area of the positioning arm to position the anchoring member comprising a strap, and using the recessed area to pass through a limited clearance area in the overhead area, to allow for an improved clearance of both the outboard portion and a D-ring attached to the strap.

19. The method of claim 17, wherein the step of remotely operating the safety hook assembly to secure and install the anchoring member around the anchorage structure further comprises, remotely operating the safety hook assembly to secure and install the anchoring member comprising a strap, and the operator pulling the pull cord to manually open the safety latch, inserting the hook end through a first D-ring attached to a strap first end of the strap, capturing with the hook end a second D-ring attached to a strap second end of the strap, and pulling the second D-ring through the first D-ring, until the strap is secured and installed around the anchorage structure.

20. The method of claim 17, wherein the step of remotely operating the safety hook assembly to remove the anchoring member from the anchorage structure further comprises, remotely operating the safety hook assembly to remove the anchoring member comprising a strap, and the operator pulling the pull cord to open the safety latch, capturing with the hook end a first D-ring attached to a strap first end of the strap, releasing the pull cord to close the safety latch to hold the first D-ring securely, and pulling the strap from the anchorage structure to remove the strap from the anchorage structure, and to eliminate an occurrence of the strap falling free.

* * * * *